US006401506B1

(12) United States Patent
Ogawa et al.

(10) Patent No.: US 6,401,506 B1
(45) Date of Patent: Jun. 11, 2002

(54) SHEET ROLLING METHOD AND SHEET ROLLING MILL

(75) Inventors: Shigeru Ogawa; Atsushi Ishii; Kenji Yamada, all of Futtsu; Satoru Ohta; Katsuhiko Koumoto, both of Tokai, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/403,791

(22) PCT Filed: Sep. 22, 1998

(86) PCT No.: PCT/JP98/04273

§ 371 (c)(1),
(2), (4) Date: Oct. 26, 1999

(87) PCT Pub. No.: WO99/43452

PCT Pub. Date: Sep. 2, 1999

(30) Foreign Application Priority Data

Feb. 27, 1998 (JP) ..... 10-047981
Mar. 17, 1998 (JP) ..... 10-066809
Mar. 18, 1998 (JP) ..... 10-068489

(51) Int. Cl.[7] ..... B21B 37/58

(52) U.S. Cl. ..... 72/14.4; 72/10.4; 72/14.5; 72/241.4; 72/241.8; 72/248; 72/247

(58) Field of Search ..... 72/10.1, 10.4, 72/10.6, 10.7, 14.4, 14.5, 237, 241.2, 241.4, 241.8, 245, 247, 248, 366.2

(56) References Cited

U.S. PATENT DOCUMENTS 4,320,643 A * 3/1982 Yasuda et al. ..... 72/10.6
4,415,976 A * 11/1983 Cook ..... 72/10.7
5,253,503 A * 10/1993 Barten et al. ..... 72/245
5,279,139 A * 1/1994 Sturm ..... 72/237
5,540,072 A * 7/1996 Nishimura ..... 72/10.4
6,142,000 A * 11/2000 Rohde ..... 72/10.4

FOREIGN PATENT DOCUMENTS

DE 19718529 * 2/1997 ..... B21B/37/58
JP 06297013 * 10/1994 ..... 72/10.7

* cited by examiner

*Primary Examiner*—Ed Tolan
(74) *Attorney, Agent, or Firm*—Kenyon & Kenyon

(57) ABSTRACT

In a rolling method applied to a multi-roll strip rolling mill composed of not less than four rolls, one of the zero point of the roll positioning devices and the deformation characteristic of the strip rolling mill or alternatively both the zero point of the roll positioning devices and the deformation characteristic of the strip rolling mill are found from a measured value of the thrust counterforces in the axial direction of the roll acting on at least all the rolls except for the backup rolls in the kiss-roll tightening state and also from a measured value of the roll forces of the backup roll acting on the backup roll chocks of the top and the bottom backup roll in the vertival direction. According to the thus obtained zero point of the roll positioning devices or the deformation characteristic of the strip rolling mill, the setting and control of the roll forces is executed when rolling is carried out.

10 Claims, 32 Drawing Sheets

SHEET ROLLING METHOD AND SHEET ROLLING MILL

This application is a 35 USC 371 of PCT/JP98/04273, filed Sep. 22, 1998.

FIELD OF THE INVENTION

The present invention relates to a method for rolling a strip made of a metal such as steel, and also relates to a rolling mill therefor.

DESCRIPTION OF THE PRIOR ART

In the case of rolling a metal strip, it is important that the ratio of the elongation, of a workpiece to be rolled, on the work side and on the drive side are made to be equal to each other. When the ratio of elongation on the work side and that on the drive side are different from each other, a defect, such as a camber, and a failure in the dimensional accuracy, such as wedge-shaped strip thickness occur. Further, problems may be caused when a strip is rolled. For example, (lateral) traveling or trail crash of a workpiece to be rolled may be caused in the process of threading.

In order to make the ratio of elongation of the workpiece to be rolled on the work side to be the same as that on the drive side, a difference between a position of reduction of a rolling mill on the work side and that on the drive side is adjusted, that is, leveling is adjusted. Leveling is usually adjusted by an operator in such a manner that he observes and adjusts leveling carefully when roll positioning devices are set before the start of rolling and also when roll positioning devices are set in the process of rolling. However, it is impossible to completely solve the above problems of defective quality such as camber and wedge-shaped strip thickness, and also it is impossible to completely solve the above problems of threading, such as (lateral) traveling and pinching, of a trailing end of a workpiece to be rolled.

Japanese Examined Patent Publicatior. No. 58-51771 discloses a technique in which leveling is adjusted according to a ratio of a difference between a load cell load of a rolling mill on the work side and that on the drive side, to the sum of the load cell load of the rolling mill on the work side and that on the drive side. However, the difference between the load cell load of the rolling mill on the work side and that on the drive side includes various disturbances in addition to an influence caused by (lateral) traveling of the workpiece to be rolled. Accordingly, when control is conducted according to the ratio of the difference between the work side load and the drive side load, there is a possibility that (lateral) traveling is facilitated by the control.

Further, Japanese Unexamined Patent Publication 59-191510 discloses a technique in which leveling is adjusted when a slippage of a piece of a work to be rolled is directly detected on the entry side of a rolling mill, that is, when a quantity of (lateral) traveling is directly detected on the entry side of a rolling mill. However, in the case of rolling a long workpiece or in the case of tandem-rolling, even if leveling is not adjusted appropriately, (lateral) traveling is not caused in many cases because of the weight of the workpiece to be rolled on the upstream side of the rolling mill and also because of a condition of restriction of the workpiece by the rolling mill on the upstream side. Therefore, according to the above methods disclosed in the Patent Publications, in the case of rolling a long workpiece or in the case of tandem-rolling, it is impossible to detect a quantity of (lateral) traveling although leveling is not adjusted appropriately. For the above reasons, it is impossible to use any of the above methods as the most appropriate method of controlling the leveling.

Further, for example, according to the method in which a quantity of (lateral) traveling is detected on the delivery side of a rolling mill, the detected value includes: a difference between the delivery speed of a workpiece on the work side and that on the drive side; and a displacement of the workpiece to be rolled in the width direction which already exists in the workpiece to be rolled on the delivery side of the rolling mill because of camber of the workpiece. For the above reasons, it is impossible to use the quantity of (lateral) traveling, which is measured, for optimizing control of leveling so that a ratio of elongation of the workpiece, which is in the roll bite of the rolling mill when the quality of traveling is measured, on the work side, and a ratio of elongation of the workpiece on the drive side, can be made to be equal to each other.

When a quantity of (lateral) traveling is directly measured by the above methods, it is impossible to optimize leveling only by these methods. Further, according to the above methods, a phenomenon occurring in the roll bite is not directly measured. Therefore, the methods tend to be affected by disturbance, and furthermore a delay is caused in the control of leveling, which is an essential defect of the methods.

On the other hand, a difference between a rolling load on the work side and that on the drive side transmits information of asymmetry with respect to the work and the drive side without delay. Therefore, this difference between the rolling load on the work side and that on the drive side can be the most important information for optimized control of leveling. However as described above, the difference between the rolling load on the work side and that on the drive side detected by the load cell includes not only a quantity of (lateral) traveling of the workpiece to be rolled but also various disturbance. Therefore, it is necessary to specify the disturbance and accurately estimate the difference between the rolling on the work side and that on the drive side.

As a result of a close investigation and analysis, the present inventors found the following. The difference between the rolling load measured by the load cell of the rolling mill on the work side and that on the drive side includes not only asymmetry of the rolling load distribution between the work rolls with respect to the mill center, but also thrust acting in the axial direction of the roll axis between the work roll and the backup roll in the case of a four rolling mill, and also between the work roll and the intermediate roll and also between the intermediate roll and the backup roll in the case of a six-high rolling mill. This thrust is the most important factor included in the difference between the rolling load on the work side and that on the drive side.

Thrust forces acting between these rolls give the rolls a redundant moment, and a difference between the rolling load on the work side and that on the drive side is changed so that the balance can be kept with respect to this moment. For the above reasons, this thrust force becomes a serious disturbance with respect to the object of determing, by the difference between the load measured by the load cells of the rolling mill on the work side and that on the drive side, asymmetry of the rolling load distribution on the work and the drive side. Further, concerning this thrust force generated between the rolls, not only the intensity of the thrust force is changed, but also the direction of the thrust force is inverted in the process of rolling. Therefore, it is very difficult to estimate the thrust force.

When the zero point adjustment of reduction of the rolling mill is conducted, rolls are tightened to a predetermined load of zero adjustment by the method of kiss-roll tightening. In this case, not only the above thrust force between the rolls but also the thrust force between the top and the bottom work roll becomes disturbed.

In the zero point adjustment of reduction, the reduction point is reset and the zero point of leveling is reset at the same time so that a load measured by the load cell on the work side and a load measured by the load cell on the drive side can be equal to a predetermined value. When the thrust force acts between the rolls at this time as described above and disturbance is included in the difference between the load measured by the load cell on the work side and the load measured by the load cell on the drive side, it becomes impossible to conduct an accurate zero point adjustment of leveling, and this error of zero point adjustment is caused at all times when leveling is conducted after that. Further, as disclosed in Japanese Unexamined Patent Publication No. 6-182418, when asymmetry of the rigidity of the rolling mill, that is, asymmetry of the deformation characteristic of the rolling mill between the work and the drive side with respect to the mill center is determined, the kiss-roll tightening test is made. Also in this case, the aforementioned thrust force generated between the rolls could be a serious error factor.

SUMMARY OF THE INVENTION

The present invention has been accomplished to solve the above various problems.

The present invention described in claim 1 provides a strip rolling method applied to a multi-roll strip rolling mill of not less than four rolls including at least a top and a bottom backup roll and a top and a bottom work roll, comprising the steps of: tightening the top and the bottom backup roll and the top and the bottom work roll by roll positioning devices under the condition that the backup rolls and the work rolls come into contact with each other; measuring thrust counterforces in the axial direction of the roll which acts on all the rolls except for the backup rolls; measuring thrust counterforces acting in the vertival direction of the backup roll on the backup roll chocks of the top and the bottom backup roll; finding one of or both of the zero point of the roll positioning devices and the deformation characteristic of the strip rolling mill according to the measured values of the thrust counterforces and the roll forces of the backup rolls; and conducting roll forces setting and/or roll forces control according to the thus found values when rolling is actually carried out.

The present invention described in claim 1 relates to a method of finding asymmetry of zero adjustment of reduction by tightening the kiss-roll on the work and the drive side and also finding asymmetry of the deformation characteristic of the rolling mill on the work and the drive side. When the kiss-roll tightening is conducted, thrust counterforces acting on the rolls except for the backup rolls is measured, and also roll forces of the backup roll acting on the backup roll chocks of the top and the bottom backup roll is measured.

In this case, the thrust counterforces is defined as follows. A thrust force is generated on a contact face of a barrel portion of each roll mainly by the existence of a minute cross angle between the rolls. While resisting a resultant force of the thrust force with respect to each roll, a force of reaction is caused so that the roll can be held at a predetermined position. This force of reaction is the aforementioned thrust counterforces. This reaction forces is usually given to a keeper strip via a roll chock, however, in the case of a rolling mill having a shift device in the axial direction of the roll, this reaction forces is given to the shift device. The roll forces of the backup roll acting on each roll fulcrum position of the top and the bottom backup roll is usually measured by a load cell. However, in the case of a rolling mill having a hydraulic roll positioning devices, it is possible to adopt a method in which the roll forces is calculated by the measured hydraulic pressure in a reduction cylinder.

When the thrust counterforces and the roll forces of the backup roll are measured, for example, in the case of a four rolling mill, the unknowns in the forces, which relate to the equilibrium condition of force and moment acting on each roll, are the following eight items.

$T_B^T$: Thrust counterforce acting on the top backup roll chock $T_{WB}^T$: Thrust force acting between the top work roll and the top backup roll $T_{WW}$: Thrust force acting between the top and the bottom work roll $T_{WB}^B$: Thrust force acting between the bottom work roll and the bottom backup roll $T_B^B$: Thrust counterforce acting on the bottom backup roll chock $p^{df}_{WB}{}^T$: Difference between the linear load distribution on the work side and that on the drive side between the top work roll and the top backup roll $p^{df}_{WB}{}^B$: Difference between the linear load distribution on the work side and that on the drive side between the bottom work roll and the bottom backup roll $p^{df}_{WW}$: Difference between the linear load distribution on the work side and that on the drive side between the top and the bottom work roll.

In this case, the linear load distribution is defined as a distribution in the axial direction of the roll of the tightening load acting on the barrel portion of each roll. A load per unit barrel length is referred to as a linear load.

If it is possible to measure thrust counterforces acting on a roll chock of the backup roll, the accuracy of calculation can be enhanced. Therefore, it is preferable to measure the thrust counterforces acting on the roll chock of the backup roll. However, the roll chock of the backup roll is simultaneously given a force of reaction of the backup roll which is much stronger than the thrust counterforces. For the above reasons, it is not easy to measure the thrust counterforces. Therefore, explanations will be made under the condition that it is impossible to obtain a measured value of the thrust counterforces of the backup roll. Supposing that the thrust counterforces of the backup roll can be measured, the number of equations becomes larger than the number of unknowns in the following explanations. Therefore, when the unknowns are found as the least square solutions of all the equations, the accuracy of calculation can be enhanced.

The equations to be applied so as to find the above eight unknowns are four equations of equilibrium condition of the force in the axial direction of each roll and four equations of equilibrium condition of the moment of each roll. That is, the number of the equations is eight in total. In this connection, it is assumed that the equation of condition of equilibrium of the force of each roll in the vertical direction is already been considered, and the unknowns relating to the equation of condition of equilibrium of the force of each roll in the vertical direction are removed. When the equation of condition of equilibrium of the force and moment of each roll is solved with respect to the eight unknowns, it is possible to find all the above unknowns.

When all the forces relating to asymmetry on the work and the drive side with respect to the mill center are found, the deformation of the roll can be accurately calculated including asymmetry on the work and the drive side. When a quantity of contribution to the deformation of the roll is independently subtracted on the work and the drive side from a quantity of mill stretch which can be found from a relation between the tightening load in the case of kiss-roll tightening and the position of reduction, the deformation characteristic of the housings on the work and the drive side can be accurately found, and also the deformation characteristic of the reduction system can be accurately found.

On the other hand, the zero point of the roll positioning devices is shifted from a position, at which the work and the drive side are equally reduced in the case where no thrust is generated between the rolls, by a difference of flattening of the roll between the work and the drive side which is caused by the linear distribution of the load acting between the rolls. Therefore, this error is corrected at all times when the reduction is set. Alternatively, it is more practical that the zero point itself is corrected giving consideration to a quantity of the error. In any case, it is necessary to measure the thrust counterforces of the backup roll on the backup roll chocks of the backup roll and the thrust counterforces of the rolls except for the backup roll, and it is necessary to estimate a difference between the distribution of the linear load of the rolls on the work side and that on the drive side. If any of the above measured values is missing, the number of the above unknowns is not less than eight. Therefore, it becomes impossible to estimate a difference of the distribution of the linear load of the rolls between the work and the drive side.

In this connection, when the rolling mill is not a four mill but it is a rolling mill in which the number of the intermediate rolls is increased, each time the number of the intermediate rolls is increased by one, the number of the contact regions between the rolls is increased by one. Even in the above case, when the thrust counterforces of the intermediate roll concerned is measured, the unknowns, which have increased this time, are two, wherein one is a thrust force acting in the contact region added this time, and the other is a difference of the distribution of the linear load on the work and the drive side. On the other hand, the number of the available equations increases by two, wherein one is an equation of condition of equilibrium of the force in the axial direction of the intermediate roll, and the other is an equation of the condition of equilibrium of the moment. When these equations are formed into simultaneous equations together with other equations relating to other rolls, it is possible to find all the solutions. As described above, in the cases of multi-roll rolling mills of not less than four rolls, when the thrust counterforces of all the rolls at least except for the backup rolls is measured, it is possible to find a difference of the distribution of the linear load acting on all the rolls between the work and the drive side. Therefore, the zero point adjustment of the roll positioning devices and the characteristic of deformation of the rolling mill can be accurately carried out including asymmetry on the work and the drive side.

The present invention described in claim 2 provides a strip rolling method applied to a multi-roll strip rolling mill of not less than four rolls including at least a top and a bottom backup roll and a top and a bottom work roll, comprising the steps of: measuring thrust counterforces in the axial direction of the rolls acting on all the rolls except for the backup rolls in one of the top and the bottom roll assembly or preferably in both the top and the bottom roll assembly; measuring roll forces of the backup roll acting in the vertival direction on the backup roll chocks of the backup roll in the top and the bottom backup roll on the side of measuring the thrust counterforces; calculating a target increments of roll positioning devices of the strip rolling mill according to the measured values of the thrust counterforces and the roll forces of the backup roll; and controlling a roll forces according to the target increments of roll positioning devices of the strip rolling mill.

The present invention described in claim 3 provides a strip rolling method applied to a multi-roll strip rolling mill of not less than four rolls including at least a top and a bottom backup roll and a top and a bottom work roll, comprising the steps of: measuring thrust counterforces in the axial direction of the rolls acting on all the rolls except for the backup rolls in one of the top and the bottom roll assembly or preferably in both the top and the bottom roll assembly; measuring roll forces of the backup roll acting in the vertival direction on the backup roll chocks of the backup roll in the top and the bottom backup roll on the side of measuring the thrust counterforces; calculating asymmetry of the distribution of a load, which acts between a workpiece to be rolled and the work roll, in the axial direction of the roll with respect to the rolling mill center while consideration is given to a at least thrust force acting between the backup roll and a roll in contact with the backup roll; calculating a target increments of roll positioning devices of the strip rolling mill according to the result of the calculation; and controlling reduction according to the target increments of roll positioning devices.

The present invention described in claims 2 and 3 relates to a strip rolling method in which leveling control is accurately conducted in the process of rolling according to the measured value of the roll forces of rolling. For example, in the case of a common four rolling mill, when the thrust counterforces in the axial direction of the roll acting on the top work roll and the roll forces of the backup roll acting in the vertival direction on the backup roll chocks of the top back up roll are measured, unknowns of the forces relating to the equation of condition of equilibrium of the force and the moment acting on the top work roll and the top backup roll in the axial direction of the roll are the following four items.

$T_B{}^T$: Thrust counterforce acting on a top backup roll chock $T_{WB}{}^T$: Thrust force acting on a top work roll and a top backup roll $p^{df}{}_{WB}{}^T$: Difference of the linear load distribution of a top work roll and a top backup roll between the work and the drive side $p^{df}$: Difference of the linear load distribution of a workpiece to be rolled and a work roll between the work and the drive side.

In the above unknowns, a thrust force acting on a workpiece to be rolled and a work roll is not included. The reason is described as follows.

Thrust counterforces between the rolls is generated by the contact of elastic bodies, and the circumferential speed of one roll is substantially the same as the circumferential speed of the other roll on the contact surface. Therefore, when a component of the circumferential speed vector in the axial direction of one roll does not coincide with a component of the circumferential speed vector in the axial direction of the other roll by the generation of a minute cross angle between the rolls, a vector of the frictional force is directed in the axial direction of the roll. For example, even in the case of a minute cross angle of 0.2°, a ratio of the thrust force in the axial direction of the roll to the rolling load becomes about 30% which is approximately the same as the coefficient of friction.

On the other hand, in the case of a thrust force acting between a workpiece to be rolled and the work roll, since a speed of the workpiece to be rolled does not coincide with the circumferential speed of the work roll at positions except for the neutral point in the roll bite, even if a cross angle of about 1° is given in the same manner as that of a roll cross mill, a direction of the vector of the frictional force does not coincide with the axial direction of the roll. For the above reasons, a thrust force, which is obtained when a component of the vector of the frictional force in the roll bite in the axial direction of the roll is integrated, is far lower than the coefficient of friction, that is, the thrust force is about 5%. Accordingly, in the case of a common rolling mill in which the work roll is not positively crossed, a cross angle caused by a clearance between the roll chock and the housing window is usually not more than 0.1°. Therefore, it is possible to neglect the thrust force generated between the workpiece to be rolled and the work roll.

Equations capable of being utilized for finding the above four unknowns are two equations of equilibrium conditions of the forces of the work roll and the backup roll in the axial direction of the roll, and two equations of equilibrium conditions of the moment of the work and the backup roll. That is, equations capable of being utilized for finding the above four unknowns are is four in total. When the above equations are solved as simultaneous equations, it is possible to find all the unknowns. When the above unknowns are found, it is possible to accurately calculate deformation of the top roll system including asymmetrical deformation on the work and the drive side.

Concerning the bottom roll system, the difference of the linear load distribution of the workpiece to be rolled and the work roll between the work and the drive side has already been found. According to the condition of equilibrium of the force acting on the workpiece, the above difference is the same with respect to the top and the bottom roll system. Therefore, when the difference of the linear load distribution of the bottom work roll and the bottom backup roll on the work and the drive side is found, it is possible to calculate deformation of the bottom roll system including asymmetrical deformation on the work and the drive side.

Equations capable solving the above problems are two equations of equilibrium conditions of the forces of the bottom work roll and the bottom backup roll in the axial direction of the roll, and two equations of equilibrium conditions of the moment of the bottom work and the bottom backup roll. That is, the number of equations is four in total. For example, when neither the force of reaction of the bottom roll system nor the force of reaction of the backup roll can be measured, the unknowns relating to the above equation system are the following five items.

$T_B{}^B$: Thrust counterforce acting on a bottom backup roll chock $T_{WB}{}^B$: Thrust force acting on a bottom work roll and a bottom backup roll $T_W{}^B$: Thrust counterforce acting on a bottom work roll chock $p^{df}{}_{WB}{}^B$: Difference of the linear load distribution of a bottom work roll and a bottom backup roll between the work and the drive side $p^{dfB}$: Difference of the roll forces of a backup roll at the roll fulcrum position of the bottom backup roll on the work and the drive side.

In the case of a rolling mill which is completely maintained, in the above unknowns, thrust force $T_{WB}{}^B$ acting on the bottom work roll and the bottom backup roll is negligibly small. In this case, when $T_{WB}{}^B=0$, all the residual unknowns can be found. Even if the above condition is not established, when at least one of the above unknowns is already known or actually measured, it is possible to find all the residual unknowns. Preferably, when it is possible to measure the difference of the thrust counterforces of the bottom work roll and the bottom backup roll between the work and the drive side, the number of unknowns becomes smaller than the number of equations. Therefore, when the solution of least squares is found, it becomes possible to conduct more accurate calculation.

When the above unknowns are found, it becomes possible to accurately calculate deformation of the bottom roll system including asymmetry on the work and the drive side. When the deformation of the rolls of the top and bottom roll system is totaled and the deformation of the housing and reduction system, which is calculated as a function of the roll forces of the backup roll, is superimposed on the above deformation and consideration is given to the present roll forces, it becomes possible to accurately calculate asymmetry of the gap of the top and the bottom work roll between the work and the drive side. In this way, it is possible to calculate a wedge-shaped thickness generated as a result of deformation of the rolling mill. After the completion of the above preparation, from the viewpoint of controlling (lateral) traveling or camber, in order to accomplish a target value of the wedge-shaped thickness, it becomes possible to calculate a quantity of operation of the roll forces, especially it becomes possible to calculate a target value of a quantity of operation of leveling. Therefore, roll forces control may be conducted according to the above target values. In this connection, even if the top roll and the bottom roll system are changed with each other, of course, the present invention can be applied in the same manner.

In the above explanations, concerning the asymmetry of the linear load distribution of a workpiece to be rolled and the work roll, only a difference between the work and the drive side is considered. However, concerning the asymmetry of the linear load distribution in the axial direction of the roll, not only the above asymmetry of the linear load, but also a phenomenon in which a workpiece to be rolled is threading at a position different from the rolling mill center can be considered. In the present invention, a distance from the center of the workpiece to be rolled to the rolling mill center is referred to as a quantity of off-center. Concerning the quantity of off-center, it is essential that the quantity of off-center is restricted to be in a predetermined range by a side guide arranged on the entry side of the rolling mill. In the case where the quantity of off-center is too large even if it is restricted by the side guide, for example, it is preferable to estimate the quantity of off-center by a measured value which has been measured by a sensor to detect (lateral) traveling arranged on the entry or delivery side of the rolling mill. In the case where it is impossible to arrange the above sensor and an unnegligibly large quantity of off-center is caused, for example, the following method may be adopted.

It is impossible to separate and extract the following two unknowns by the equation of equilibrium condition of the moment of the work rolled. In this case, one unknown is a quantity of off-center, and the other unknown is a difference of the linear load distribution of the workpiece to be roll and the work roll between the work and the drive side. Therefore, a target value of the quantity of operation of leveling is calculated in the following two cases. One is a case in which the quantity of off-center is zero and only the difference of the linear load between the work and the drive side is an unknown, and the other is a case in which the difference between the linear load on the work side and that on the drive side is zero and the quantity of off-center is an unknown. For example, a target value of actual leveling operation is determined by a weighted mean obtained from the results of both calculations. In this case, weighting is conducted in such a manner that weighting is appropriately adjusted while an operator is observing the circumstances of rolling. In general, weight is given to a side on which a quantity of operation of leveling is small, or a value on a side on which a quantity of operation is small is adopted. Further, a tuning factor, which is usually not more than 1.0, is multiplied with this so that a control output can be obtained.

In this connection, when the rolling mill is not a four mill but it is a rolling mill in which the number of the intermediate rolls is increased, each time the number of the intermediate rolls is increased by one, the number of the contact regions between the rolls is increased by one. Even in the above case, when the thrust counterforces of the intermediate roll concerned is measured, the unknowns, which have increased this time, are two, wherein one is a thrust force acting in the contact region added this time, and the other is a difference of the distribution of the linear load on the work and the drive side. On the other hand, the number of the available equations increases by two, wherein one is an equation of condition of equilibrium of the force in the axial direction of the intermediate roll, and the other is an equation of the condition of equilibrium of the moment. When these equations are formed into simultaneous equations together with other equations relating to other rolls, it is possible to find all the solutions. As described above, in the cases of a multi-roll rolling mill of not less than four rolls, when the thrust counterforces of all the rolls at least except for the backup rolls is measured, it is possible to find all the unknowns including a difference of the distribution of the linear load acting on the rolls between the work and the drive side. Therefore, it becomes possible to calculate the most appropriate quantity of leveling operation in the same manner as that of the four rolling mill.

The present invention described in claim 4 provides a strip rolling mill of multiple stages of not less than four rolls having a top and a bottom work roll and also having a top and a bottom backup roll arranged in contact with the top and the bottom work roll, the strip rolling mill comprising: a measurement device for measuring thrust counterforces in the axial direction of the roll acting all the rolls except for the backup rolls; and a measurement device for measuring roll forces of the backup rolls acting in the vertival direction on the backup roll chocks of the top and the bottom backup roll.

According to the strip rolling mill described in claim 4, it is possible to carry out the rolling methods of claims 1, 2 and 3. As explained above, in order to carry out the rolling methods of claims 1, 2 and 3, it is necessary to arrange a measurement device for measuring thrust counterforces in the axial direction of the roll acting on all the rolls except for the backup rolls, and also it is necessary to arrange a measurement device for measuring roll forces of the backup rolls acting in the vertival direction on the backup roll chocks of the top and the bottom backup roll.

In this case, examples of the measurement device for measuring thrust counterforces in the axial direction of the roll are: a detection device for detecting a load acting on a stud bolt to restrict a keeper strip which restricts a movement of the roll in the axial direction via the roll chock; a device for detecting a load given to a shifting device in the case of a rolling mill having a shifting function to shift the roll in the axial direction; and a device for directly detecting a thrust force acting on an outer race of a thrust bearing, wherein the device is attached in the roll chock.

An example of the measurement device for measuring roll forces of the backup roll acting on the backup roll chocks of the top and the bottom backup roll in the vertival direction is a load cell arranged at the roll fulcrum position. For example, in the case of a rolling mill having a hydraulic roll positioning devices, it is possible to adopt a method in which the roll forces of the backup roll is calculated from a measured value of hydraulic pressure in a reduction cylinder or in a pipe directly connected to the reduction cylinder. However, in this case, when a roll forces is quickly changed by the hydraulic cylinder, there is a possibility that a great error occurs in the measured value. Therefore, the roll forces should be temporarily kept at a predetermined position when the pressure is measured.

The present invention described in claim 5 provides a strip rolling mill of multiple stages of not less than four rolls having a top and a bottom work roll and also having a top and a bottom backup roll arranged in contact with the top and the bottom work roll, the strip rolling mill comprising: a measurement device for measuring thrust counterforces in the axial direction of the roll acting all the rolls except for the backup rolls; a measurement device for measuring roll forces of the backup rolls acting in the vertival direction on the backup roll chocks of the top and the bottom backup roll; and a calculating device connected to the measurement device for measuring thrust counterforces and also connected to the measurement device for measuring roll forces of the backup roll, calculating asymmetry of the distribution of a load, which acts between a workpiece to be rolled and the work roll, in the axial direction of the roll with respect to the rolling mill center while consideration is given to a at least thrust force acting between the backup rolls and the rolls in contact with them, also calculating asymmetry of the distribution of a load acting between the top and the bottom work roll in the axial direction of the roll with respect to the rolling mill center.

The strip rolling mill described in claim 5 is a more specific rolling mill for executing the rolling methods of claims 1, 2 and 3. As explained before, in order to execute the rolling method of claims 1, 2 and 3, the rolling mill must include: a measurement device for measuring thrust counterforces in the axial direction of the roll acting on all the rolls except for the backup rolls; and a measurement device for measuring roll forces of the backup rolls acting in the vertival direction on the backup roll chocks of the top and the bottom backup roll. In addition to the above devices, the rolling mill must includes a calculating device into which the above measurement data is inputted, and the calculating device calculates asymmetry of the linear load distribution acting between the rolls and also calculates asymmetry of the thrust force, and further the calculating device calculates asymmetry of the linear load distribution acting between the workpiece to be rolled and the work roll and also calculates asymmetry of the thrust force.

In this case, for the purpose of setting and controlling of the leveling, analysis of asymmetrical deformation on the work and the drive side of the roll system must be finally executed. For executing this analysis of asymmetrical deformation, it is essential to determine asymmetry of the distribution of the load in the axial direction of the roll acting between the workpiece to be rolled and the work roll, and also it is essential to determine asymmetry of the distribution of the load in the axial direction of the roll acting between the top and the bottom work roll with respect to the rolling mill center in the state of kiss-roll. The strip rolling mill described in claim 5 includes a calculating device into which a measured value of the thrust counterforces in the axial direction acting on the rolls except for at least the backup roll is inputted and also a measured value of the roll forces of the backup roll acting on the backup roll chocks of the top and the bottom backup roll in the vertival direction is inputted.

In this connection, in the case where thrust counterforces acting on the rolls except for the backup roll is measured, in the above measurement devices except for the measurement device of a system in which a load is given to an outer race of a thrust bearing in a roll chock, an external force for holding the roll chock in the axial direction of the roll is measured. When the above type thrust reaction forces measuring device is used, a roll balance force acting on each roll or a frictional force in the axial direction of the roll caused by a roll bending force could be a serious disturbance when a thrust reaction forces is measured. By a resultant force of the thrust forces acting on the barrel portions of the rolls, the roll concerned is a little moved in the direction of the thrust force, and an elastic deformation of the keeper strip, which fixes the roll chock in the axial direction of the roll, and the roll shifting device is induced by this small displacement. Due to the foregoing, the thrust counterforces can be measured. When the roll chock is a little displaced, a frictional force to obstruct a displacement of the roll chock is given by the roll bending device, which comes into contact with the roll chock, and also by load members of the roll balance device. In general, it is difficult to measure this frictional force itself. Therefore, this frictional force becomes a factor of disturbance of the measured thrust counterforces.

In order to solve the above problems, the rolling mills described in claims 6 to 10 are provided.

In this connection, in the explanations of the present invention and also in the claims of the present invention, in order to simplify the expression, the terminology of roll bending device includes a roll balance device, and also the terminology of a roll bending force includes a roll balance force.

The present invention described in claim 6 provides a strip rolling mill according to claim 4, wherein roll bending device is arranged in at least one set of rolls except for the backup rolls, a roll chock of at least one roll in the rolls having the roll bending device includes a roll chock for supporting a radial load and a roll chock for supporting thrust counterforces in the axial direction of the roll, and the strip rolling mill includes a device for measuring thrust counterforces acting on the roll chock for supporting thrust counterforces.

In this case, the roll chock for supporting a radial load can be composed in such a manner that the inner race of the bearing and the roll shaft are fitted to each other while a clearance is left between them or that a cylindrical roll bearing having no inner race is used. Due to the above arrangement, no thrust force is given to the roll chock for supporting a radial load. By the above arrangement, even when a roll bending force is acting, a small displacement in the axial direction of the top work roll is transmitted to only the chock for supporting thrust counterforces. Therefore, it is possible to reduce disturbance given to the measured value of thrust counterforces, that is, disturbance can be reduced negligibly small.

On the other hand, in the structure in which the chock is not separated from the bottom work roll, unlike the top work roll, when a thrust force acts on the bottom work roll, a frictional force corresponding to a roll bending force is generated between the top and the bottom work roll chock. However, since the chock of the top work roll does not support the thrust force, the top work roll chock is a little displaced in the direction of the thrust force together with the bottom work roll. Finally, thrust counterforces acting on the bottom work roll can be accurately detected via the chock of the bottom work roll.

The present invention described in claim 7 provides a strip rolling mill according to claim 4, wherein roll bending device is arranged in at least one set of rolls except for the backup rolls, and the roll bending device has a mechanism capable of giving an oscillation component of not less than 5 Hz to the roll bending force which has been set.

When a predetermined force is given to the roll bending force and a component of oscillation is superimposed on the roll bending force, a frictional force generated between the load members of the roll bending force and the roll chock can be greatly reduced, so that the measurement accuracy of the thrust force can be greatly enhanced. The reason is described as follows. When a thrust force acts on the work roll, the work roll is a little displaced in the axial direction of the roll, so that the thrust force can be measured. When the roll bending force is oscillated, at the moment when the roll bending force is decreased to the minimum, the work roll is displaced in the axial direction of the roll, so that the thrust force can be transmitted. When the frequency of the oscillation component to be given is less than 5 Hz, the bend of the work roll is greatly changed according to the oscillation of the roll bending force. Therefore, the crown and profile of a strip are affected by the bend of the work roll, and further the effect of decreasing the frictional force in the axial direction of the roll is reduced. For the above reasons, the frequency of the oscillation component to be given is determined to be not less than 5 Hz, and it is preferable that the frequency of the oscillation component to be given is determined to be not less than 10 Hz.

The present invention described in claim 8 provides a strip rolling mill according to claim 4, wherein roll bending device is arranged in at least one set of rolls except for the backup rolls, and the strip rolling mill includes a slide bearing having the degree of freedom in the axial direction of the roll arranged between the load members of the roll bending device and a roll chock in contact with the load members.

As described above, by the existence of the slide bearing, the frictional force between the load members of the roll bending force and the roll chock can be greatly reduced, and the measurement accuracy of measuring the thrust counterforces can be greatly enhanced.

The present invention described in claim 9 provides a strip rolling mill according to claim 4, wherein roll bending device is arranged in at least one set of rolls except for the backup rolls, the roll bending device includes load members for giving a load to a roll chock when the load members comes into contact with the roll chock, and a load transmission member, in the closed space of which liquid is enclosed, at least a portion of the closed space being covered with thin skin, the elastic deformation resistance with respect to out-of-plane deformation of which is not more than 5% of the maximum value of the roll bending force, is arranged between the load members of the roll bending device and the roll chock.

This load transmission member is disposed between the load members of the roll bending device and the roll chock with pressure. The mechanical strength of thin skin is sufficiently high so that a liquid film formed inside can not be broken. Since resistance of thin skin to the deformation of out-of-plane is not more than 5% of the maximum value of the roll bending force. Therefore, it is possible to sufficiently reduce an apparent frictional force acting from the load members of the roll bending device with respect to a small displacement of the roll chock in the axial direction. In the case where the aforementioned load transmission member is not arranged, the load members of the roll bending device and the roll chock come into solid contact with each other. Therefore, the coefficient of friction is approximately 30%. On the other hand, in the case where the load transmission member of the invention is inserted, it is possible to neglect the shearing deformation resistance of the liquid film formed inside. Accordingly, an apparent frictional force is not more than 5% of the maximum value of the roll bending force. As a result, the measurement accuracy of measuring thrust counterforces can be greatly enhanced.

The present invention described in claim 10 provides a strip rolling mill, which includes a roll shifting device, which is arranged in at least one set of rolls except for the backup rolls, for shifting a roll in the axial direction, and the roll shifting device has a function of giving a minute oscillation, the amplitude of which is not less than 1 mm, the period of which is not more than 30 seconds, to the roll.

When the roll shifting device is given the oscillating function as described above and oscillation is actually caused by the roll shifting device, a direction of the frictional force acting between the load members of the roll bending device and the roll chock is, inverted. Therefore, when the mean value of the measured shifting force is taken, that is, when the mean value of the thrust counterforces is taken, it becomes possible to accurately measure the thrust counterforces. The reason why the amplitude is not less than 1 mm is described as follows. When the amplitude is smaller than 1 mm, oscillation is absorbed by play between the roll chock and the bearing in the axial direction of the roll, and also oscillation is absorbed by deformation of the load members of the roll bending device in the axial direction of the roll. As a result, the direction of the frictional force can not be inverted even if oscillation is given. Concerning the period of oscillation, when the mean value is taken by this period, one point of data of the thrust counterforces can be obtained for the first time, and it becomes possible to conduct control of the roll forces. For the above reasons, in order to conduct a meaningful roll forces control for rolling operation, the cycle time is determined to be not more than 30 seconds.

In the rolling mills described in claims 6 to 10, problems of disturbance caused in the process of measuring the thrust counterforces are solved by the equipment technique. However, the strip rolling methods described in claims 11 to 14 solve the above problems by improvements in the rolling methods.

The present invention described in claim 11 provides a strip rolling method applied to a multi-roll strip rolling mill of not less than four rolls including at least a top and a bottom backup roll and a top and a bottom work roll, comprising the steps of: tightening the top and the bottom backup roll and the top and the bottom work roll by roll positioning devices under the condition that the backup rolls and the work rolls come into contact with each other; measuring thrust counterforces in the axial direction of the roll which acts on all the rolls except for the backup rolls; measuring a roll force acting in the vertical direction on the backup roll chokes of the top and the bottom backup roll; setting an absolute value of the force of the roll balance device or the roll bending device, which gives a load to the roll chock to be measured, at a value not more than ½ of the force of the roll balanced condition, preferably at zero; finding one of or both of the zero point of the roll positioning devices and the deformation characteristic of the strip rolling mill according to the measured values of the thrust counterforces and the roll forces of the backup rolls; and conducting roll forces setting and/or roll forces control according to the thus found values when rolling is actually carried out.

When the thrust counterforces in the axial direction of the roll is measured, the roll chock, the thrust counterforces of which is measured, is given a force by the roll balance device or the roll bending device. When this force is made to be not more than ½ of the roll balance force, or preferably when this force is made to be zero, it becomes possible to accurately measure the thrust counterforces, and it becomes possible to suppress a factor of disturbance with respect to the equation of equilibrium condition of moment acting on the roll. Therefore, it becomes possible to set a roll forces accurately, and also it becomes possible to control a roll forces accurately.

In this connection, the roll balance condition is defined as follows. When rolling is not conducted, a gap is formed between the top and the bottom work roll. In the above condition, the top work roll is lifted up onto the top backup roll side, and further the bottom work roll is pressed against the bottom backup roll side, that is, each chock is given a predetermined force so that no slippage is caused between the rolls. The above state is referred to as a roll balance condition.

The present invention described in claim 12 provides a strip rolling method applied to a multi-roll strip rolling mill of not less than four rolls including at least a top and a bottom backup roll and a top and a bottom work roll, comprising the steps of: measuring thrust counterforces in the axial direction of the rolls acting on all the rolls except for the backup rolls in one of the top and the bottom roll assembly or preferably in both the top and the bottom roll assembly; measuring roll forces acting in the vertival direction of the backup roll on the backup roll chocks of the top and the bottom backup roll; calculating a target increments of roll positioning devices of the strip rolling mill according to the measured values of the thrust counterforces and the roll forces of the backup roll; setting an absolute value of the force of the roll balance device or the roll bending device, which gives a load to the roll chock, the thrust counterforces of which is measured, at a value not more than ½ of the force of the roll balanced condition, preferably at zero; and controlling reduction according to the target increments of roll positioning devices of the strip rolling mill.

The present invention described in claim 13 provides a strip rolling method applied to a multi-roll strip rolling mill of not less than four rolls including at least a top and a bottom backup roll and a top and a bottom work roll, comprising the steps of: measuring thrust counterforces in the axial direction of the rolls acting on all the rolls except for the backup rolls in one of the top and the bottom roll assembly or preferably in both the top and the bottom roll assembly; measuring roll forces acting in the vertival direction of the backup roll on the backup roll chocks of the top and the bottom backup roll; setting an absolute value of the force of the roll balance device or the roll bending device, which gives a load to the roll chock, the thrust counterforces of which is measured, at a value not more than ½ of the force of the roll balance condition, preferably at zero, at the time of measuring at least the thrust counterforces in the process of rolling; calculating asymmetry of a distribution of a load in the axial direction of the roll acting at least between a workpiece to be rolled and the work roll with respect to the rolling mill center; calculating a target value of a quantity of operation of the roll forces of the strip rolling mill according to the result of calculation; and conducting control of the roll forces according to the increments of the roll positioning devices.

In the strip rolling method described in claims 12 and 13, it is necessary to accurately measure the thrust counterforces in the axial direction of the roll acting on all the rolls except for the backup rolls. As described before, in order to accurately measure the thrust counterforces and calculate the most appropriate quantity of operation of the roll forces, it is necessary to suppress a frictional force caused by the roll balance device or the roll bending device which gives a load to the chock of the roll, the thrust counterforces of which is to be measured. According to the present invention, the above problems are solved in such a manner that only while rolling is being conducted, is a force given by the above device made to be not more than ½ of the force acting in the roll balance state. However, in some cases, it is impossible to control the crown profile of a rolled strip at a predetermined value by the above roll balance force or the roll bending force. In the above cases, an absolute value of the roll balance force or the roll bending force may be decreased as described before only in a limited period of time in which the thrust force of rolling is measured.

In the strip rolling method described in claims 12 and 13, it is important to decrease an absolute value of the roll balance force or the roll bending force in order to accurately measure the thrust counterforces. However, in the case of a rolling mill having only the roll bending device as a control means for controlling a strip crown and flatness, there is a possibility that a predetermined strip crown and flatness can not be obtained when the above rolling method is adopted. On the other hand, in the case of a strip rolling mill having a roll shift mechanism or a roll cross mechanism which is different from the roll bending device, although an absolute value of the bending force is set at not more than ½ of the normal roll balance force, preferably, although an absolute value of the bending force is set at zero, when the roll shift mechanism or the roll cross mechanism is put into practical use, it becomes possible to accomplish a predetermined strip crown and flatness.

The present invention described in claim 14 relates to a strip rolling method characterized in that: while the above rolling mill is used and a predetermined strip crown and flatness is accomplished at all times, thrust counterforces of the rolls except for the backup rolls are accurately measured, so that the most appropriate roll forces control on the work and the drive side can be conducted.

The present invention described in claim 14 provides a strip rolling method applied to a multi-roll strip rolling mill of not less than four rolls including at least a top and a bottom backup roll and a top and a bottom work roll also including a strip crown and flatness control means in addition to roll bending device, comprising the steps of: measuring thrust counterforces in the axial direction of the rolls acting on all the rolls except for the backup rolls in one of the top and the bottom roll assembly or preferably in both the top and the bottom roll assembly; measuring roll forces of the backup roll acting in the vertival direction on the backup roll chocks of the top and the bottom backup roll: calculating a strip rolling mill setting condition so that an absolute value of the roll bending force can be made to be a value not more than ½ of a value of the roll balance condition, preferably an absolute value of the roll bending force can be made to be zero by the strip crown and flatness control means except for the roll bending device in the process of setting calculation for obtaining a predetermined strip crown and flatness; and carrying out rolling by changing the roll bending force from the value of the roll balance condition to the setting calculation value immediately after the start of rolling according to the result of calculation.

In general, the above thrust force caused between the rolls in the top roll system is different from the thrust force caused between the rolls in the bottom roll system, that is, the direction and intensity of the thrust force in the top roll system is different from the direction and intensity of the thrust force in the bottom roll system. The above loads which are not symmetrical with respect to the upper and lower sides cannot be balanced only by the internal forces of the rolling mill housings on the work and the drive side. When an additional force is given via a foundation of the rolling mill housing and also via a member connecting the housing on the work side with that on the drive side, the above asymmetrical load can be balanced. Accordingly, in the above load condition, the deformation characteristic of the rolling mill is different from the deformation characteristic of the rolling mill to which the load is symmetrically given with respect to the upper and lower sides so that the rolling mill can be balanced only by the internal force of the housing. The above phenomenon is individually caused in the housings on the work and the drive side of the rolling mill. Therefore, a deformation of the rolling mill asymmetrical with respect to the work and the drive side is caused by the load which is asymmetrical with respect to the upper and lower sides. The above deformation has a great influence on a distribution of thickness of a workpiece to be rolled in the width direction and on a difference of the elongation ratio on the work and the drive side.

In order to realize a rolling operation in which ratios of elongation on the work and the drive side are made equal to each other, the present invention provides a strip rolling mill calibration method and a strip rolling mill calibration device by which a deformation characteristic of the rolling mill with respect to the asymmetrical load on the upper and lower sides caused by a thrust force generated between the rolls can be accurately identified.

The present invention described in claim 15 provides a method of calibration of a strip rolling mill for finding a deformation characteristic of the strip rolling mill with respect to a thrust force acting between the rolls of the multi-roll strip rolling mill of not less than four rolls including at least a top and a bottom backup roll and a top and a bottom work roll, comprising the steps of: giving a load in the vertical direction corresponding to a rolling load to a housing of the strip rolling mill; measuring at least one of the loads in the vertical direction given to an upper and a lower portion of the strip mill housing via load cells for measuring a rolling load; giving a load, which is asymmetrical with respect to the upper and lower sides, to the housing of the strip rolling mill by giving an external force in the vertical direction from the outside of the strip rolling mill under the condition that the load in the vertical direction is being given; and measuring the load cell load.

In this case, the external force in the vertical direction given from the outside to the rolling mill is defined as a force, the roll forces of which is not supported by the housing of the rolling mill, that is, the external force in the vertical direction given from the outside to the rolling mill is not a roll bending force or a roll balance force, the roll forces of which is supported by the housing of the rolling mill.

Referring to FIG. 27 in which a four rolling mill is shown, when the rolling mill is driven, a thrust force onto work side WS is generated in the top backup roll by the existence of a minute cross angle between the rolls, and also a thrust force onto drive side DS is generated in the bottom backup roll by the existence of a minute cross angle between the rolls. FIG. 27 is a schematic illustration showing a model of the above circumstances. Concerning the load given to the housing of the rolling mill on work side WS, the upper load is heavier than the lower load. As a result, the load given to the housing on the work side can not be balanced by the single body of the housing on the work side. Therefore, this load is balanced when an external force is given from a foundation of the housing or a member connecting the housing on the work side with the housing on the drive side.

On the other hand, for example, in many cases, the roll bending force is given to the roll chock by a project block fixed to the rolling mill housing. Even if the roll chock is given a load, which is asymmetrical with respect to the upper and lower sides, by an actuator arranged in the project block, the roll forces is transmitted to the housing of the rolling mill via the project block. Therefore, the roll forces is balanced in the housing, that is, no external force is given from the foundation of the housing. In other words, this load is entirely different from the asymmetrical load with respect to the upper and lower sides caused by the thrust force generated between the rolls. Accordingly, when the deformation characteristic of the rolling mill for the asymmetrical load with respect to the upper and lower sides generated by the thrust force is identified, it is necessary to give an asymmetrical load with respect to the upper and lower sides, the roll forces of which is received by an external structure except for the housing of the rolling mill, that is, it is necessary to give an external force.

As described above, when an external force in the vertical direction is given to the rolling mill from the outside of the rolling mill, it is possible to calculate a load asymmetrical with respect to the upper and lower side generated by the thrust force between the rolls, further it is possible to identify the characteristic of deformation of the rolling mill. That is, by obtaining a measured value of the load cell for measuring a rolling load when an external force in the vertical direction is given from the outside of the rolling mill, it is possible to calculate a quantity of deformation except for the rolling mill housing and the reduction system. By the equation of condition to which this quantity of deformation and a quantity of deformation of the rolling mill housing and the reduction system are fitted, it becomes possible to find a deformation characteristic of the rolling mill housing and the reduction system by the asymmetrical load with respect to the upper and lower sides.

In this connection, concerning the deformation characteristic of the roll system, for example, as disclosed in Japanese Examined Patent Publication No. 4-74084 and Japanese Unexamined Patent Publication No. 6-182418, if the outside dimension and the elastic coefficient of the roll are determine, it is possible to accurately calculate the deformation characteristic of the roll system even when the asymmetrical load is generated. Therefore, if the deformation characteristic of the housing and the reduction system can be accurately identified, it is possible to determine the deformation characteristic of the entire rolling mill. In this connection, according to claim 15, as long as the rolling mill housing can be given a load asymmetrical with respect to the upper and lower sides, the object of the present invention can be satisfied. Therefore, the following method can be an embodiment of the present invention. For example, under the condition that all the rolls are removed from the rolling mill, a calibration device is inserted into the rolling mill instead of the rolls, and then a predetermined load in the vertical direction is given. On the contrary, the present invention includes a method in which kiss-roll-tightening is conducted by the roll positioning devices of the rolling mill while all the rolls are incorporated into the rolling mill, and further an external force in the vertical direction is given from the outside of the rolling mill.

The present invention described in claim 16 provides a method of calibration of a strip rolling mill for finding a deformation characteristic of the strip rolling mill with respect to a thrust force acting between the rolls of the multi-roll strip rolling mill of not less than four including at least a top and a bottom backup roll and a top and a bottom work roll, comprising the steps of: giving a load in the vertical direction corresponding to a rolling load to a barrel portion of the backup roll under the condition that at least the top and the bottom backup roll are incorporated into the strip rolling mill; measuring at least one of the loads in the vertical direction given to an upper and a lower portion of the strip mill housing via load cells for measuring a rolling load; giving a load, which is asymmetrical with respect to the upper and lower sides, to the housing of the strip rolling mill via the roll chocks of the top and the bottom backup roll by giving an external force in the vertical direction from the outside of the strip rolling mill under the condition that the load in the vertical direction is being given; and measuring the load cell load.

According to this method of calibration, a load in the vertical direction corresponding to a rolling load is given while at least the backup rolls used for rolling are incorporated, and further a load which is asymmetrical with respect to the upper and lower sides is also given. Accordingly, it is possible to determine a deformation characteristic of the backup roll chocks and the reduction system of the rolling mill including a deformation characteristic of an elastic contact face with the housings. Therefore, it is possible to identify the deformation characteristic more accurately.

The present invention described in claim 17 provides a method of calibration of a strip rolling mill for finding a deformation characteristic of the strip rolling mill with respect to a thrust force acting between the rolls of the multi-roll strip rolling mill of not less than four rolls including at least a top and a bottom backup roll and a top and a bottom work roll, comprising the steps of: drawing out at least one of the rolls except for the backup rolls; incorporating a calibration device into a position of the roll which has been removed; giving a load in the vertical direction corresponding to a rolling load to a barrel portion of the backup roll; measuring at least one of the loads in the vertical direction given to an upper and a lower portion of the strip rolling mill via a load cell for measuring the rolling load; giving a load asymmetrical with respect to the upper and lower sides to the housings of the strip rolling mill via the top and the bottom backup roll chock when an external force in the vertical direction is given to the calibration device from the outside of the rolling mill under the condition that the load in the vertical direction is being given; and measuring the load given to the load cell.

According to the above calibration method, calibration is carried out while the backup rolls are incorporated into the rolling mill. Therefore, in the same manner as that of claim 16, it is possible to identify the deformation characteristic of the rolling mill more accurately. Further, for example, the work rolls are removed from the rolling mill, and the calibration device is incorporated into the rolling mill instead of the work rolls, and then a load in the upward direction is given by an overhead crane via the calibration device. Due to the foregoing, a load asymmetrical with respect to the upper and lower sides can be easily given.

The present invention described in claim 18 provides a calibration device of a strip rolling mill for finding a deformation characteristic of the strip rolling mill with respect to a thrust force acting between the rolls of the multi-roll strip rolling mill of not less than four rolls including at least a top and a bottom backup roll and a top and a bottom work roll, the configuration of the calibration device being formed so that the calibration device can be incorporated into the strip rolling mill, from which the work roll has been removed, instead of the work roll which has been removed, the calibration device comprising: a member capable of receiving an external force in the vertical direction given from the outside of the strip rolling mill, wherein the member is arranged at an end portion of the calibration device protruding outside from one of the work and the drive side of the strip rolling mill or from both the work and the drive side of the strip rolling mill.

This calibration device is provided for carrying out the method of calibration of a strip rolling mill described in claim 17. For example, when an upward force is given by an overhead crane to the member of the end portion of the calibration device for receiving an external force in the vertical direction, a load asymmetrical with respect to the upper and lower sides can be easily given.

The present invention described in claim 19 provides a calibration device of a strip rolling mill according to claim 18, wherein the size of the calibration device in the vertical direction is approximately the same as the total size of the top and the bottom work roll of the strip rolling mill, the calibration device can be incorporated into the strip rolling mill from which the top and the bottom work rolls have been removed, and the calibration device can be given a load in the vertical direction corresponding to a rolling load by roll positioning devices of the strip rolling mill.

In this calibration device, the size in the vertical direction is approximately the same as the total size of the top and the bottom work roll. This means that the calibration device can be given a load in the vertical direction approximately corresponding to a rolling load by the roll positioning devices of the rolling mill. In order to keep the quality of rolled products high, it is usual to replace the top and the bottom work roll simultaneously in the operation of rolling. In order to conduct the replacement of the work rolls effectively, a specific device such as a roll changing carriage used for replacing the rolls is provided in many cases. In addition to the advantages provided by the calibration device of a rolling mill described in claim 18, the calibration device of a rolling mill described in claim 19 can provide the following advantages. Since the size of the calibration device in the vertical direction is approximately the same as the total size of the top and the bottom work roll of a rolling mill, the work rolls can be removed and the calibration device can be incorporated into the rolling mill by the roll changing carriage used for replacing the rolls in the same manner as that of the usual operation of replacing the rolls, Therefore, the working efficiency can be greatly enhanced.

The present invention described in claim 20 provides a calibration device of a strip rolling mill according to claim 18, further comprising a measurement device for measuring the external force in the vertical direction acting on an end portion of one of the work and the drive side of the calibration device or end portions of both the work and the drive side of the calibration device.

When the above calibration device is used, the external force in the vertical direction, which is given from the outside of the rolling mill so that a load asymmetrical with respect to the upper and lower sides can be given, can be measured by the calibration device itself. Therefore, for example, it is possible to use an overhead crane as it is, in which it is difficult to accurately measure the external force to be given.

The present invention described in claim 21 provides a calibration device of a strip rolling mill according to claim 18, wherein the member in contact with one of the top and the bottom roll of the strip rolling mill has a sliding mechanism capable of substantially releasing a thrust force given from the roll of the strip rolling mill.

In the case where the device of calibration of a strip rolling mill described in claim 18 is used and the method of calibration of a strip rolling mill described in claim 17 is executed, when an external force is given in the vertical direction from the outside of the rolling mill to the calibration device, the device of calibration generally receives moment. Due to the moment received in this way, there is a possibility that a thrust force is generated by friction on a contact face of the calibration device with the roll of the rolling mill. This thrust force causes a disturbance to the load cell used for measuring a rolling load. Therefore, this thrust force also causes a disturbance when the deformation characteristic is determined by giving a load asymmetrical with respect to the upper and lower sides which is an object of the method of calibration of the rolling mill.

On the other hand, according to the device of calibration of a strip rolling mill described in claim 21, even if a frictional force in the direction of thrust is generated between the rolls and the device of calibration, it can be released and it is possible to make it zero substantially. Therefore, the deformation characteristic of the rolling mill can be more accurately identified.

The present invention described in claim 22 provides a calibration device of a strip rolling mill for finding a deformation characteristic of the strip rolling mill with respect to a thrust force acting between the rolls of the multi-roll strip rolling mill of not less than four rolls including at least a top and a bottom backup roll and a top and a bottom work roll, wherein the calibration device can be attached to a roll chock of the strip rolling mill or an end portion of the roll protruding outside the roll chock, and the calibration device can receive an external force in the vertical direction from the outside of the strip rolling mill.

When the above device for calibration of a strip rolling mill is used, under the condition that the rolling rolls are usually incorporated into the rolling mill, it is possible to execute the method of calibration of a strip rolling mill described in claim 15 or 16.

The present invention described in claim 23 provides a calibration device of a strip rolling mill according to claim 22, further comprising a measurement device for measuring the external force in the vertical direction acting on the calibration device.

When the above calibration device is used, the external force in the vertical direction given from the outside of the rolling mill for the purpose of giving a load asymmetrical with respect to the upper and lower sides can be measured by the calibration device itself. Therefore, for example, an overhead crane, in which it is difficult to measure a load to be used as an external force, can be utilized as it is.

The thrust force generated between the rolls can be measured by a device which directly detects a load acting on a thrust bearing in the roll chock. Also, the thrust force generated between the rolls can be measured by a device for detecting a force acting on a structure, which fixes the roll chock in the axial direction of the roll, such as a roll shifting device and a keeper strip. However, even if the thrust force can be measured and the thrust force acting on the backup rolls can be measured, it is not clear how the measured thrust force has an influence on the load cell load. The circumstances are described as follows. The load cell load is measured in such a manner that a load acting on the backup roll chock in the vertical direction is measured by the load cell. A moment generated by a difference between the load cell load on the work side and the load cell load on the drive side is determined when the moment generated by the thrust force acting on the backup roll via the contact face with the work roll is balanced with the moment generated by the thrust counterforces generated for fixing the backup roll in the axial direction of the roll so that the thrust counterforces can resist the above thrust force. However, the backup roll is given a heavy load from not only the keeper strip but also the roll positioning devices and the roll balance device. A frictional force caused by the above load in the vertical direction can be a portion of the thrust counterforces. Therefore, in general, a position of the point of application of the thrust counterforces; which is a resultant force, is unknown. Accordingly, it is an important task to find the position of the point of application of the thrust counterforces.

The present invention described in claim 24 provides a method of calibration of a strip rolling mill for finding a dynamic characteristic of the strip rolling mill with respect to a thrust force acting between the rolls of the multi-roll strip rolling mill of not less than four rolls including at least a top and a bottom backup roll and a top and a bottom work roll, comprising the steps of; drawing out rolls except for the backup rolls; giving a load in the vertical direction corresponding to a rolling load to a barrel portion of the backup roll under the condition that the rolls except for the backup rolls haven been removed; measuring loads in the vertical direction acting on both end portions of at least one of the top and the bottom backup roll via the load cells for measuring the rolling load; causing a thrust force to act on a barrel portion of the backup roll under the condition that the load in the vertical direction is given; and measuring the load of the load cell.

According to the above method, by the difference between the work and the drive side of the load cell load before and after a thrust force, the intensity of which has already been known, is loaded, the moment generated in the backup roll by the above thrust force can be calculated. This additional moment can be given by a distance in the vertical direction between the position of the point of application of the thrust counterforces and the position of the point of application of the thrust force and also by the thrust force. Therefore, when an equation into which the above are incorporated is solved, the position of the point of application of the thrust counterforces can be immediately found.

The present invention described in claim 25 provides a calibration device of a strip rolling mill for finding a dynamic characteristic of the strip rolling mill with respect to a thrust force acting between the rolls of the multi-roll strip rolling mill of not less than four rolls including at least a top and a bottom backup roll and a top and a bottom work roll, the configuration of the calibration device being such that the calibration device can be incorporated into the strip rolling mill from which the rolls except for the backup rolls are removed, the calibration device further comprising a means for giving a thrust force in the axial direction of the roll to the backup rolls under the condition that a load in the vertical direction corresponding to the rolling load is being given between the backup rolls and the calibration device.

When the calibration device having the above function is used, it becomes possible to execute the method of calibration of a strip rolling mill described in claim 24 and, as described above, it is possible to find the position of the point of application of the thrust counterforces acting on the backup rolls by the known thrust force given from the present device of calibration and the measured value of the load cell load of the rolling mill.

The present invention described in claim 26 provides a calibration device of a strip rolling mill according to claim 25, wherein the calibration device is capable of measuring a distribution in the axial direction of the roll of the load given in the vertical direction acting between the backup rolls and the calibration device.

When the above function is added to the device of calibration of a strip rolling mill described in claim 25, when a known thrust force is given according to the method of calibration of a strip rolling mill described in claim 24, deformation of the rolling mill is changed. Accordingly, even if a distribution in the axial direction of the roll of the load in the vertical direction acting between the backup roll and the device of calibration is changed, it is possible to directly measure a quantity of the change. Therefore, it is possible to separate an influence of the quantity of the change in the distribution of the load in the vertical direction acting on a difference between the load cell load on the work side and the load cell load on the drive side of the rolling mill. Accordingly, it becomes possible to accurately find the position of the point of application of the thrust counterforces acting on the backup roll.

The present invention described in claim 27 provides a calibration device of a strip rolling mill according to claim 25, wherein a member for supporting a resultant force of the thrust counterforces acting on the calibration device is arranged at a middle point in the vertical direction on a face in contact with the top and the bottom backup roll of the calibration device.

In the device for calibration of a strip rolling mill described in claim 25, since a thrust force in the axial direction of the roll, the intensity of which has already been known, is given to the backup roll, thrust counterforces corresponding to the above force acts on the main body of the device of calibration. Concerning this thrust counterforces, for example, when the direction of the thrust force given to the top backup roll is reverse to the direction of the thrust force given to the bottom backup roll and the intensity of the thrust force given to the top backup roll is the same as the intensity of the thrust force given to the bottom backup roll, the thrust counterforces keep an equilibrium condition with each other. Therefore, the resultant force of the thrust counterforces of the overall calibration device becomes zero. However, as described later, the present device of calibration is not necessarily used under the condition that the thrust force acting on the top roll and the thrust force acting on the bottom roll are balanced with each other. That is, in general, the resultant force of the thrust counterforces acting on the present device of calibration does not become zero. Therefore, it is necessary to provide a member to support the resultant force of the thrust counterforces. According to claim 27, a position of this member is specified. That is, as described in claim 27, when the member to support the resultant force of the thrust counterforces is located on a face on which the device of calibration comes into contact with the top and the bottom backup roll, that is, when the member to support the resultant force of the thrust counterforces is located at a position of the middle point of the upper and the lower point of application of the thrust force, no moment is newly generated in the device of calibration by the resultant force of the thrust counterforces. Accordingly, a distribution in the axial direction of the roll of the load in the vertical direction, which is given between the backup roll and the device of calibration, is not changed. Therefore, the position of the point of application of the thrust counterforces of the backup rolls can be highly accurately identified by the method of calibration of a strip rolling mill described in claim 24.

The present invention described in claim 28 provides a calibration device of a strip rolling mill according to claim 27, wherein a roll is provided in a portion in which a member for supporting a resultant force of the thrust counterforces acting on the calibration device comes into contact with the housing of the strip rolling mill.

A resultant force of the thrust counterforces of the entire calibration device of a rolling mill is finally supported by the fixing member such as a housing and a keeper strip of the rolling mill. However, not only the resultant force of the thrust counterforces but also a frictional force in the vertical direction following this resultant force acts between the above fixing members and the support member for supporting the thrust counterforces of the calibration device. Since this frictional force generates a redundant moment in the calibration device, it becomes a disturbance when the position of the point of application of the thrust counterforces of the backup rolls is identified by the calibration method of the strip rolling mill described in claim 24. In order to solve the above problems, as described in claim 28, when a contact portion, in which the support member of the thrust counterforces of the calibration device is contacted with the housing of the rolling mill or the fixing members, is composed of a roll type structure, a frictional force caused by the thrust counterforces can be substantially released. Therefore, the position of the point of application of the thrust counterforces of the backup roll can be highly accurately identified.

The present invention described in claim 29 provides a calibration device of a strip rolling mill according to claim 27, wherein a member for supporting a resultant force of the thrust counterforces acting on the calibration device is arranged on the work side of the calibration device, and an actuator giving a thrust force in the axial direction of the roll to the backup roll is also arranged on the work side.

Due to the above structure, compared with a case in which the same support member is arranged on the drive side, the calibration device can be easily incorporated, and further the thrust counterforces given to the backup roll is balanced only on the work side of the calibration device. Therefore, no redundant forces act on the center and the drive side of the calibration device. Accordingly, no redundant deformations are caused in the calibration device by the thrust counterforces. As a result, it becomes possible to execute the calibration method of a strip rolling mill described in claim 24 with high accuracy.

The present invention described in claim 30 provides a calibration device of a strip rolling mill according to claim 25, wherein a member for receiving a force in the vertical direction from the outside is arranged at an end portion of the calibration device protruding from one of the work and the drive side of the rolling mill or from both the work and the drive side under the condition that the calibration device is incorporated into a strip rolling mill.

When the above device is used, it is possible to identify the position of the point of application of thrust of the backup rolls, and further, for example, when the member concerned is given a force in the vertical direction by an overhead crane, it is possible to give a load asymmetrical with respect to the upper and lower sides to the rolling mill. Therefore, by a change in the load cell load of the rolling mill before and after giving the external force, it is possible to identify the deformation characteristic of the rolling mill for a load asymmetrical with respect to the upper and lower sides.

The present invention described in claim 31 provides a calibration device of a strip rolling mill according to claim 30, further comprising a measurement device for measuring the external force in the vertical direction acting at an end portion of one of the work and the drive side of the calibration device or at end portions of both the work and the drive side of the calibration device.

Due to the above structure, for example, even when a device for giving an external force such as an overhead crane, the force given in the vertical direction of which can not be accurately measured, is used, the external force given to the calibration device can be accurately determined. Therefore, the deformation characteristic of the rolling mill by the asymmetrical load with respect to the upper and lower sides can be accurately found.

BRIEF DESCRIPTION OF THE DRAWINGS

FIG. 35 is a flow chart showing a method of finding a deformation characteristic in the case where a difference is caused between an upper load and a lower load of a rolling mill.

THE MOST PREFERRED EMBODIMENT

Referring to the appended drawings, embodiments of the present invention will be explained below. In order to simplify the explanations, a four rolling mill is taken as an example here, however, as explained before, it is possible to apply the present invention to a five-high rolling mill or a six-high or more rolling mill to which the intermediate rolls are added.

Figure 1:
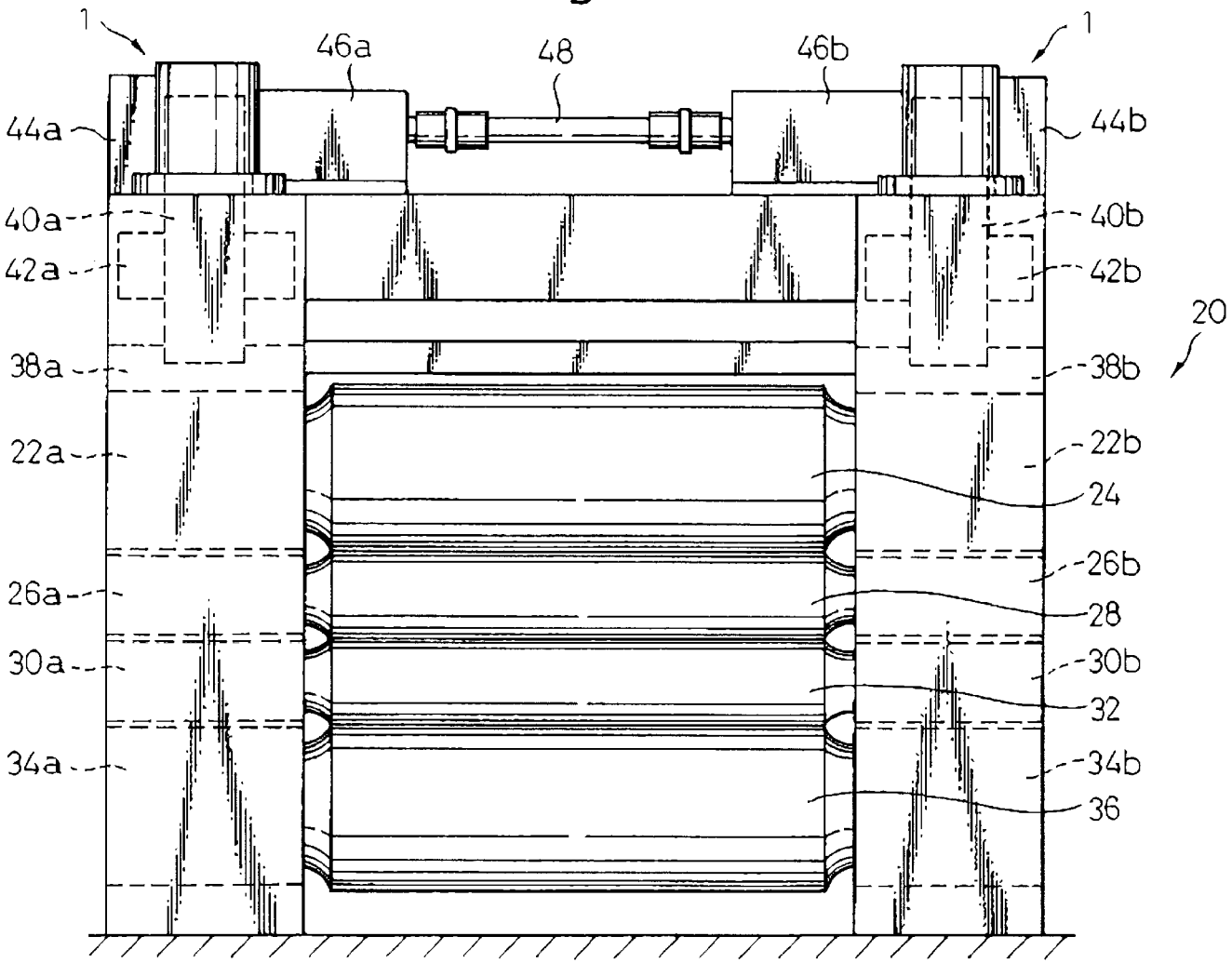
FIG. 1 is a front view of a four rolling mill to which the present invention is applied.
Figure 2:
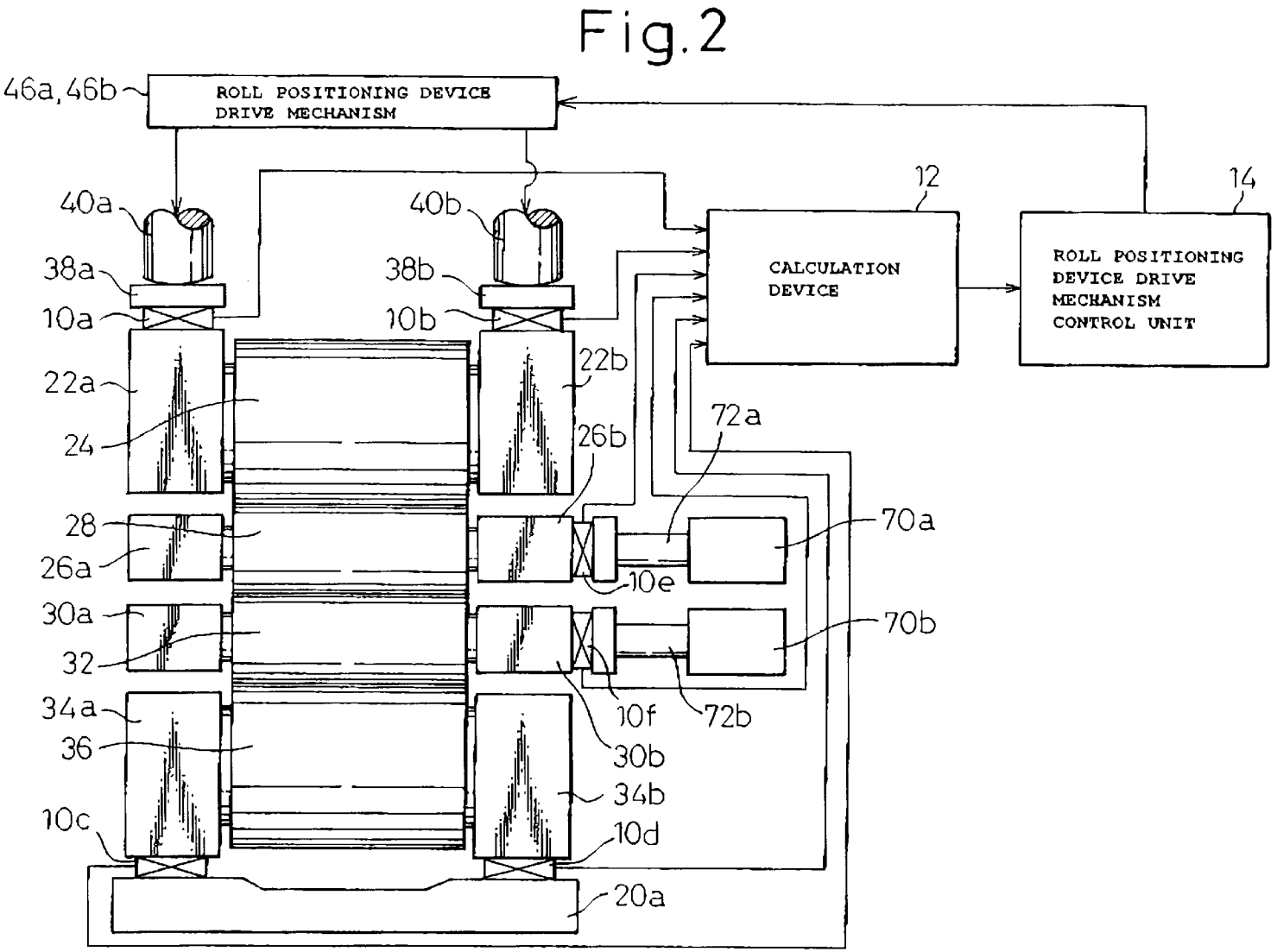
FIG. 2 is a schematic illustration showing an outline of a four rolling mill of an embodiment of the present invention.

First, referring to FIGS. 1 and 2, there is shown an example of a four rolling mill having roll positioning devices to which the present invention is applied. In this rolling mill, there are provided housings 20 of the gate type. By these housings 20, a top 24 and a bottom backup roll 36 and a top 28 and a bottom work roll 32 are rotatably supported via top 22*a*, 22*b* and bottom backup roll chocks 34*a*, 34*b* and top 26*a*, 26*b* and bottom work roll chocks 30*a*, 30*b*. The top and bottom backup roll chocks 22*a*, 22*b*, 34*a*, 34*b* and the top and bottom work roll chocks 26*a*, 26*b*, 30*a*, 30*b* are supported by the housings 20 in such a manner that the roll chocks can be moved in the vertical direction. In order to give a predetermined load to the top 28 and the bottom work roll 32, roll positioning devices 1 are arranged in an upper portion of the housings 20. Roll positioning devices in which a reduction screw is driven by an electric motor will be explained below, however, it is possible to apply the present invention to a hydraulic roll positioning devices.

The roll positioning devices 1 includes: screws 40*a*, 40*b* in contact with the top backup roll chocks 22*a*, 22*b* via pressure blocks 38*a*, 38*b*; and a pair of drive motors 46*a*, 46*b* connected with the screws 40*a*, 40*b* via reduction gears 44*a*, 44*b*. The drive motors 46*a*, 46*b* are connected with each other via a shaft 48. In upper portions of the housings 22*a*, 22*b*, there are provided nuts 42*a*, 42*b* which engage with the screws 40*a*, 40*b*. When the screws 40*a*, 40*b* are rotated by the drive motors 46*a*, 46*b*, the screws 40*a*, 40*b* are moved in the vertical direction, and the top backup roll chocks 22*a*, 22*b* can be positioned in the vertical direction. Due to the foregoing, a predetermined rolling load can be given between the top 28 and the bottom work roll 32. Referring to FIG. 1 which is an enlarged cross-membersal view showing contact portions in which the screws 40*a*, 40*b* are contacted with the top backup roll chocks 22*a*, 22*b*, there are provided pressure blocks 38*a*, 38*b* having thrust bearings for supporting end portions of the screws 40*a*, 40*b*. The screws 40*a*, 40*b* come into contact with the top backup roll chocks 22*a*, 22*b* via the pressure blocks 38*a*, 38*b*. The rolling mill of the present invention includes a work roll shifting device 70 for shifting the top 28 and the bottom work roll 32 respectively in the longitudinal direction. The work roll shifting device 70 is connected with the top 26*a*, 26*b* and the bottom work roll chocks 30*a*, 30*b* via connecting rods 72.

Between the pressure blocks 38*a*, 38*b* and the top backup roll chocks 22*a*, 22*b* and also between the bottom backup roll chocks 34*a*, 34*b* and the base 20*a* of the rolling mill, there are provided load cells 10*a* to 10*d* for measuring roll forces of the backup roll. Further between the connecting rods 72 of the work roll shifting device 70 and the top 26*a*, 26*b* and the bottom work roll chocks 30*a*, 30*b*, there are provided load cells 10*e*, 10*f* for measuring thrust counterforces of the top 28 and the bottom work roll 32.

The load cells 10*a* to 10*f* are connected to a calculation device 10. The calculation device 10 calculates at least asymmetry of a distribution of a load acting on the work rolls 28, 32 in the axial direction of the roll with respect to the mill center.

A result of calculation conducted by the calculation device 10 is sent to roll positioning devices drive mechanism control device 14. According to the result of calculation, the drive motors 46*a*, 46*b* for driving the screws 40*a*, 40*b* are controlled, that is, the roll positioning devices drive mechanism is controlled. In this connection, a process computer is usually used for the calculation device 10. However, it is unnecessary that the calculation device is an independent computer. If a portion of the program performing the above function exists in a computer having a more comprehensive function, the portion of the program and the computer can be assumed to be the above calculation device 10.

In the case of a hydraulic roll positioning devices, of course, the reduction drive mechanism includes a hydraulic pump and other hydraulic components.

In this connection, when hydraulic cylinders (not shown) are used as the actuators of the work roll shifting devices 70*a*, 70*b*, a pressure measurement device (not shown) for measuring pressure in the hydraulic cylinder or pressure in the hydraulic pipe (not shown) connected with the hydraulic cylinder may be used for measuring thrust counterforces of the work rolls 28, 32 instead of the load cells 10*e*, 10*f*. In the case where the work roll shifting devices 70*a*, 70*b* are not provided, as explained before, roll forces measuring device (not shown) arranged in the chocks 26*a*, 26*b*, 30*a*, 30*b* of the work rolls 28, 32 may be used for measuring the load, or alternatively keeper strips (not shown) for restricting the work roll chocks 26*a*, 26*b*, 30*a*, 30*b* in the axial direction of the roll may be used as a device for measuring the load.

Next, referring to FIG. 3, a preferred embodiment of zero point adjustment conducted in the roll positioning devices of the rolling mill shown in FIGS. 1 and 2 will be explained as follows.

Zero point adjustment of reduction is conducted after the rolls have been replaced. Usually, kiss-roll tightening is conducted by the roll positioning devices 1 until the roll forces of the backup rolls reaches a predetermined zero point adjustment load, for example, 1000 t (step S10). At this time, leveling adjustment of the screws 40*a*, 40*b* is conducted on both the work and the drive side so that the roll forces of the backup roll on the work side can be the same as the roll forces of the backup roll on the drive side, and then the roll forces is temporarily set at zero (step S12). In this case, one of the following two reaction forces can be independently used as roll forces of the backup roll. One is roll forces of the top work roll, that is, roll forces measured by the load cells 10*a*, 10*b* arranged between the pressure blocks 38*a*, 38*b* and the top backup roll chocks 22*a*, 22*b*. The other is roll forces of the bottom work roll, that is, roll forces measured by the load cells 10*c*, 10*d* arranged between the bottom roll chocks 34*a*, 34*b* and the base 20*a*. In this case, a mean value of the roll forces of the top and the bottom backup roll, that is, a mean value of the roll forces measured by the load cells 10*a* to 10*d* may be used.

Next, in step S14, reaction forces of the backup rolls 24, 36 are measured by the load cells 10*a* to 10*d* under the condition that the kiss-rolls are tightened. Next, in step S16, thrust counterforces of the top 28 and the bottom work roll 32 are measured by the load cells 10*e*, 10*f*. By the thus measured values, as described later, from the equation of equilibrium condition of the force in the axial direction of the roll acting on the backup rolls 24, 36 and the work rolls 28, 32, and also from the equation of equilibrium condition of moment, thrust counterforces of the backup rolls 24, 36 and thrust forces acting between the rolls 24, 28, 32, 36 are calculated, and also a difference of the linear load distribution between the work and the drive side is calculated by the calculation device 12 (step S18). A specific example of this calculation will be explained below.

Figure 4:
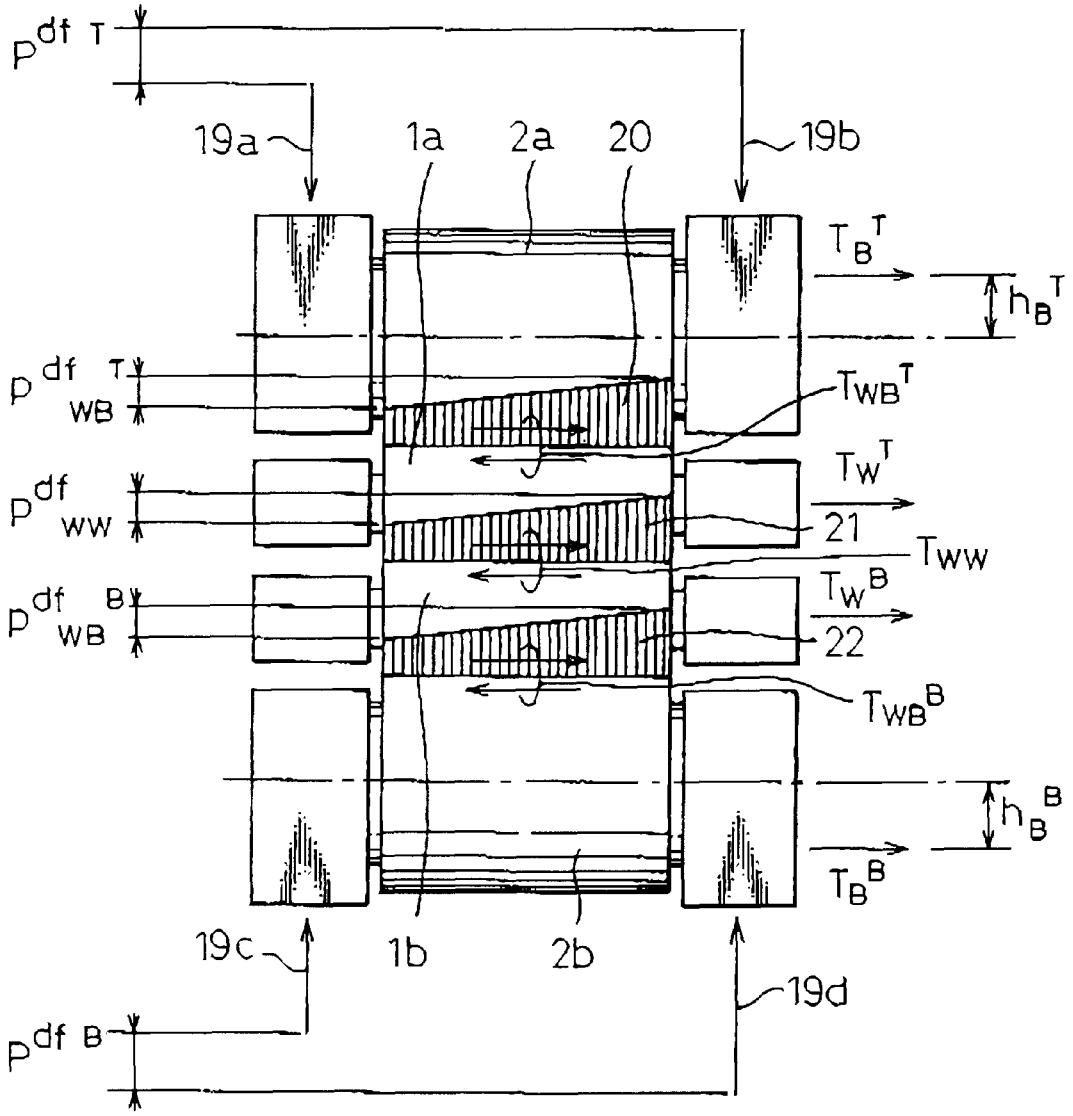
FIG. 4 is a schematic illustration showing an asymmetrical component with respect to the work and the drive side of the thrust force and the force in the vertical direction acting on the rolls of a four rolling mill.

In FIG. 4, forces in the axial direction of the roll acting on the rolls 24, 28, 32, 36 and forces relating to moment of the rolls 24, 28, 32, 36 are schematically shown. In this case, concerning the forces in the vertical direction, consideration is given to only asymmetrical components on the work and the drive side relating to moment of the roll. Further, in order to simplify the explanations, consideration is given to only components in the width direction in the asymmetrical components on the work and the drive side in the linear load distribution acting between the rolls, that is, consideration is given to only linear equation components of the coordinate in the longitudinal direction of the roll. When it is put into practical use, it is possible to adopt asymmetrical components in which cubic components and more of the coordinate in the width direction are superimposed according to the deformation characteristic of the rolling mill.

Measured values of the following four components of forces shown in FIG. 4 can be used.

$P^{dfT}$: Difference between the roll forces of the backup roll on the work side and that on the drive side at the roll fulcrum position of the top backup roll $P^{dfB}$: Difference between the roll forces of the backup roll on the work side and that on the drive side at the roll fulcrum position of the bottom backup roll $T_W{}^T$: Thrust counterforce acting on the top work roll $T_W{}^B$: Thrust counterforce acting on the bottom work roll The following eight variables become unknown numbers.

$T_B{}^T$: Thrust counterforce acting on the top backup roll chocks 22*a*, 22*b*

$T_{WB}{}^T$: Thrust force acting between the top work roll 28 and the top backup roll 24

$T_{WW}$: Thrust force acting between the top 28 and the bottom work roll 32

$T_{WB}{}^B$: Thrust force acting between the bottom work roll 32 and the bottom backup roll 36

$T_B{}^B$: Thrust counterforce acting on the bottom backup roll chocks 34*a*, 34*b*

$p^{df}{}_{WB}{}^T$: Difference between the linear load distribution on the work side and that on the drive side between the top work roll 28 and the top backup roll 24

$p^{df}{}_{WB}{}^B$: Difference between the linear load distribution on the work side and that on the drive side between the bottom work roll 32 and the bottom backup roll 36

$p^{df}{}_{WW}$: Difference between the linear load distribution on the work side and that on the drive side between the top 28 and the bottom work roll 32.

In this connection, distances $h_B{}^T$ and $h_B{}^B$ between the position of the point of application of the thrust counterforces acting on the backup roll and the axial center of the backup roll are previously determined, for example, in such a manner that a known thrust force is given and then a change in the roll forces of the backup roll is observed.

In FIG. 4, the position of the point of application of the thrust counterforces of the work roll agrees with the axial centers of the work rolls 28, 32. However, there is a possibility that the position of the point of application of the thrust counterforces deviates from the axial center of the roll due to the type of the work roll chocks 26*a*, 26*b*, 30*a*, 30*b* and the support mechanism. In this case, when a known thrust force is given to the work rolls 28, 32, the position of the thrust counterforces is previously determined.

According to FIG. 4, the equations of equilibrium condition of the forces in the axial directions of the top backup roll 24, top work roll 28, bottom work roll 32 and bottom backup roll 36 are respectively expressed as follows.

$$-T_{WB}^{T}=T_{B}^{T} \quad (1)$$

$$T_{WB}^{T}-T_{WW}=T_{W}^{T} \quad (2)$$

$$T_{WW}-T_{WB}^{B}=T_{W}^{B} \quad (3)$$

$$T_{WB}^{B}=T_{B}^{B} \quad (4)$$

The equations of equilibrium condition of moment of the top backup roll 24, top work roll 28, bottom work roll 32 and bottom backup roll 36 are respectively expressed as follows.

$$T_{WB}^{T}\cdot(D_{B}^{T}/2+h_{B}^{T})+p^{df}_{WB}{}^{T}(l_{WB}^{T})^{2}/12=P_{df}^{T}\cdot a_{B}^{T}/2 \quad (5)$$

$$T_{WB}^{T}\cdot D_{W}^{T}/2+T_{WW}\cdot D_{W}^{T}/2-p^{df}_{WB}{}^{t}(l_{WB}^{T})^{2}/12+p^{df}_{WW}(l_{WW})^{2}/12=0 \quad (6)$$

$$T_{WB}^{B}\cdot D_{W}^{B}/2+T_{WW}\cdot D_{W}^{B}/2+p^{df}_{WB}{}^{B}(l_{WB}^{B})^{2}/12-p^{df}_{WW}(l_{WW})^{2}/12=0 \quad (7)$$

$$T_{WB}^{B}\cdot(D_{B}^{B}/2+h_{B}^{B})-p^{df}_{WB}{}^{B}(l_{WB}^{B})^{2}/12=-P_{df}^{B}\cdot a_{B}^{B}/2 \quad (8)$$

In this case, $D_{B}^{T}$, $D_{B}^{B}$, $D_{W}^{T}$ and $D_{E}^{B}$ are respectively diameters of the top 24 and the bottom backup roll 36 and the top 28 and the bottom work roll 32. Also, in this case, $l_{WB}^{T}$, $l_{WW}$ and $l_{WB}^{B}$ are respectively lengths in the axial direction of the roll of a contact region between the top backup roll 24 and the top work roll 28, a contact region between the top 28 and the bottom work roll 32, and a contact region between the bottom work roll 32 and the bottom backup roll 36.

In this connection, in equations (5) and (8), $T_{B}^{T}$ and $T_{B}^{B}$ are eliminated by using equations (1) and (4). When the above eight equations are simultaneously solved, all the above eight unknown numbers can be found.

Next, by using the result of the above calculation, a difference between the quantity of deformation on the work side of each roll 24, 28, 32, 36 and that on the drive side is calculated under the condition that the zero point of the roll positioning devices is adjusted. This difference between the work and the drive side is converted into the fulcrum positions of the reduction screws 40*a*, 40*b*, that is, this difference between the work and the drive side is converted into the central axial lines of the reduction screws 40*a*, 40*b*, so that a quantity of correction of the position of the zero point of the roll positioning devices is calculated (step S20).

A difference between the quantity of deformation of a roll on the work side and that on the drive side is mainly generated by an asymmetrical component of the linear load distribution on the work side and that on the drive side acting between the rolls 24, 28, 32, 36. This deformation of a roll includes a flattening deformation of the roll, a bending deformation of the roll, and a bending deformation of the roll at the neck members. The difference between the deformation of the roll on the work side and that on the drive side is mainly caused by a difference between a quantity of deformation of a flattened roll on the work side and that on the drive side. This difference between a quantity of deformation of a flattened roll on the work side and that on the drive side can be immediately calculated by $p^{df}_{WB}{}^{T}$, $p^{df}_{WB}{}^{B}$ and $p^{df}_{WW}$ which have already been found. When a difference between a total of the quantity of deformation of the flattened roll at the end position of the roll barrel on the work side and that on the drive side which can be found by the result of calculation is extrapolated to the position of the fulcrum of reduction of the backup roll, a quantity of correction of the zero point position of the roll positioning devices can be calculated, and the zero point position is adjusted to a position at which no difference is caused between the quantity of deformation of the roll on the work side and that on the drive side (step S22). In this connection, in the case of extrapolation of the quantity of deformation of the flattened roll, consideration may be given to asymmetry of the bend of the roll and asymmetry of the deformation of the roll neck members.

The thrust force generated between the rolls in the process of zero adjustment seldom occurs in the process of rolling in the same manner. Therefore, it is preferable that the zero point of reduction, which is a reference of the position of reduction, is determined when a thrust force between the rolls is zero. Therefore, it is desirable that a true zero point of reduction is determined in an ideal condition in which asymmetrical load is not caused between the work and the drive side by the thrust generated between the rolls. That is, the true zero point of reduction is determined in such a manner that the position of reduction is moved in a direction so that the asymmetrical component between the quantity of deformation of the roll on the work side and that on the drive side can be eliminated. When the zero point of the position of reduction is set in the above manner, it becomes possible to conduct an accurate reduction setting while consideration is given to the asymmetrical load and deformation generated in the actual process of rolling on the work and the drive side.

Figure 3:
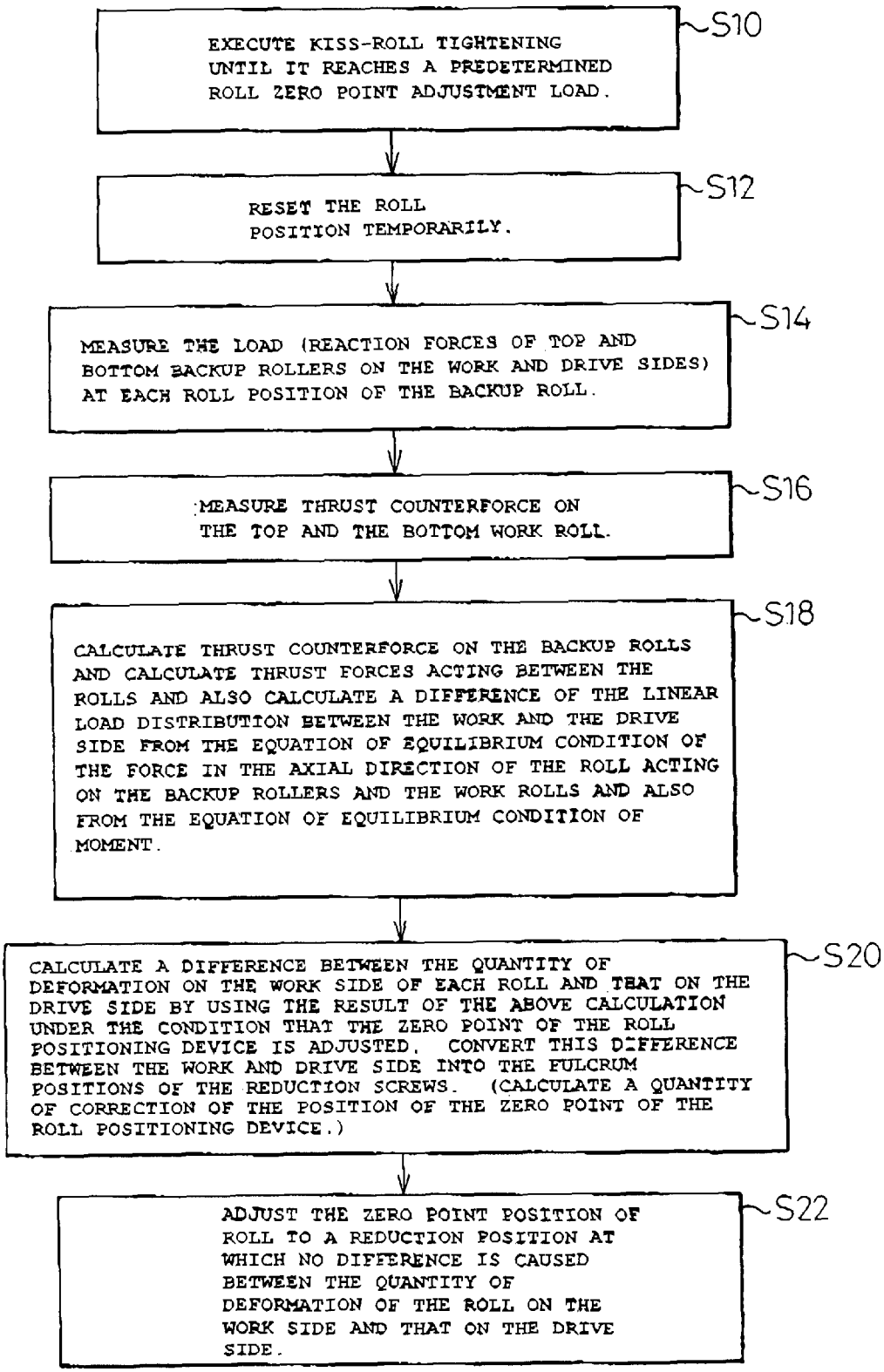
FIG. 3 is a flow chart showing a method of adjusting a zero point of reduction of a rolling mill of an embodiment of the present invention.

In this connection, in order to obtain the same object, the method is not limited to the method shown in FIG. 3 in which the zero point is adjusted. It is possible to adopt a method in which a quantity of asymmetrical deformation of the roll is stored in the process of adjusting the zero point and correction is conducted according to the thus stored quantity of asymmetrical deformation of the roll in the actual process of setting the reduction. Even when the above method is adopted, the zero point is substantially corrected in the process of setting the reduction. Therefore, it is clear that the above method can be another embodiment of the present invention.

Explanations have been made while attention is being given to the asymmetrical deformation between the work and the drive side. However, in the case where a total of the roll forces of the backup roll on the work side and that on the drive side in the actual process of adjusting the zero point is different from a target value, that is, in the case where a total of the load of zero point adjustment on the work side and that on the drive side is different from a target value, it is important from the viewpoint of enhancing the accuracy of strip thickness that the zero point position of the roll positioning devices is adjusted including the symmetrical component on the work and the drive side. Also in this case, it is possible to adopt a method in which an actual zero point adjustment load is stored and the thus stored actual zero point adjustment load is used as a reference load.

In general, the zero point adjustment load is determined so that a difference between the load on the work side and that on the drive side can be made to be zero. However, when a meaningful difference between the zero adjustment load on the work and that on the drive side is generated, as described before, the zero point adjustment load including the difference between the work and the drive side is stored, and when reduction setting is calculated, the actual zero adjustment load including the difference between the work and the drive side is used as a reference value. In this way, the zero point adjustment can be accurately conducted. In the case where an actual zero point adjustment load can not be used when reduction setting is calculated, not only the difference between the quantity of roll deformation on the work side and that on the drive side shown in FIG. 3, but also a difference between the quantity of deformation of the housing and the reduction system on the work side which is caused by a difference between the roll forces of the backup roll and the quantity of deformation of the housing and the reduction system on the drive side must be corrected.

Figure 5:
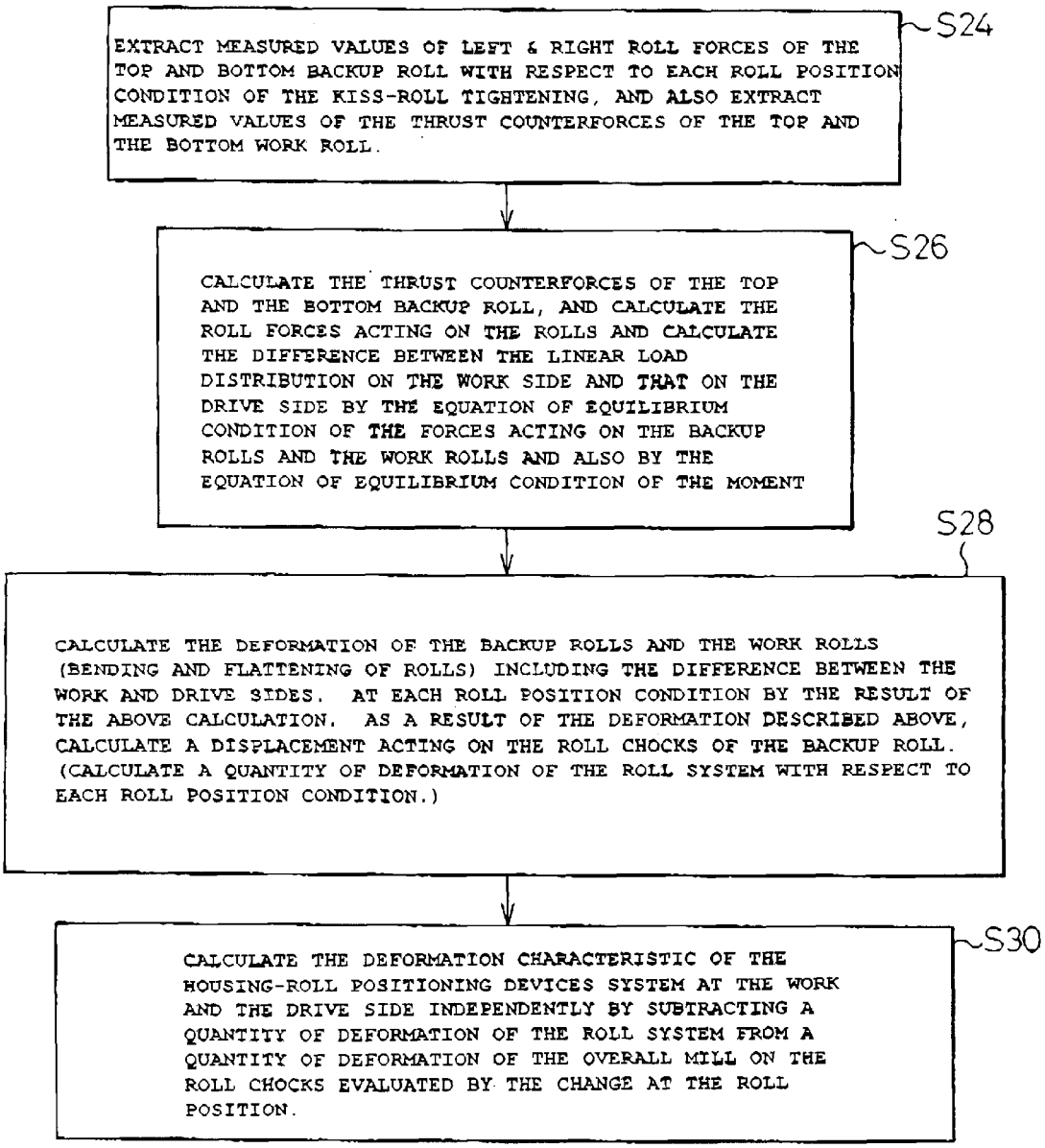
FIG. 5 is a flow chart showing a method of calculation of the deformation characteristic of a housing and reduction system of a four mill.

Next, referring to FIG. 5, a method of finding the deformation characteristic of a four rolling mill, that is, a method of finding mill-stretch will be explained as follows. In this case, mill-stretch means a change in the gap between the top and the bottom work roll which is caused as a result of elastic deformation of a rolling mill when a rolling load is given to the rolling mill. When this mill-stretch is found, it is possible to accurately find the mill-stretch with respect to the deformation of the roll system. However, with respect to the deformation of the housing and reduction system except for the roll system, it is generally difficult to accurately find the mill-stretch because a large number of elastic contact faces are included.

Japanese Examined Patent Publication NO. 4-74084 discloses the following method. Before the start of rolling, the kiss-roll tightening test is previously made. According to the quantity of deformation with respect to the tightening load, a quantity of deformation of the roll system is calculated and separated, so that a deformation characteristic of the housing and reduction system is separated. Japanese Unexamined Patent Publication No. 6-182418 discloses a method in which a deformation characteristic of the housing and the reduction system on the work side and that on the drive side are independently separated.

However, according to the method disclosed in Japanese Unexamined Patent Publication No. 6-182418, no consideration is given to an influence of the thrust force caused between the rolls. Therefore, when an intensity of the thrust force caused between the rolls is increased to a certain value, it is impossible to ensure a sufficiently high accuracy. According to the present invention, as explained before referring to FIG. 4, when the kiss-roll tightening test is made, the thrust counterforces of the top and the bottom backup roll on the work and the drive side are measured, and also the roll forces of the top and the bottom work roll on the work and the drive side are measured. Therefore, the above problems can be solved.

First, the roll forces of the top 24 and the bottom backup roll 36 are measured and also the roll forces of the top 28 and the bottom work roll 32 are measured by the load cells 10*a* to 10*d* for each condition of the roll forces (step S24). Next, in the same manner as that of the case of adjusting the reduction zero point, by the equation of equilibrium condition of the forces acting on the backup rolls 24, 36 and the work rolls 28, 32 and also by the equation of equilibrium condition of the moment, the thrust counterforces of the top 24 and the bottom backup roll 36, the thrust forces acting on the rolls 24, 28, 32, 36 and the difference between the linear load distribution on the work side and that on the drive side are calculated (step S26).

When the load distribution between the rolls is found, it is possible to calculate the bend deformation of the backup rolls 24, 36 and the work rolls 28, 32 and also it is possible to calculate the deformation of the flattened backup rolls 24, 36 and the flattened work rolls 28, 32 by the method disclosed in Japanese Examined Patent Publication No. 4-74084. In this case, the deformation can be calculated including the difference between the work and the drive side. As a result of the deformation described above, it is possible to calculate a displacement generated at the roll fulcrum position of each backup roll 24, 36 (step S28). Finally, since a quantity of deformation of the overall rolling mill is evaluated by a change in the roll forces, a quantity of deformation of the roll system at the roll fulcrum position is subtracted from it, and the deformation characteristic of the housing and reduction system is independently calculated on the work and the drive side (step S30).

When the deformation of the rolls is calculated according to the thrust force between the rolls which has been accurately found, it is possible to accurately find the deformation characteristic of the housing and the reduction system including a difference between the work and the drive side.

In this connection, in the case where the present method is applied to a rolling mill in which an intensity of thrust force generated between the rolls is increased to a considerably high value, a big difference is caused between the roll forces of the top backup roll and that of the bottom backup roll. Therefore, the difference between the roll forces of the top backup roll and that of the bottom backup roll affects the deformation characteristic of the housing and the reduction system. In this case, for example, a difference between the top and the bottom roll is generated by various means such as a means for giving a minute cross angle between the rolls, and the deformation characteristic of the housing and the reduction system is found by the aforementioned procedure, and the thus found deformation characteristic is organized as a function of the difference between the top and the bottom roll. In this way, the accurate deformation characteristic of the rolling mill can be obtained.

Figure 6:
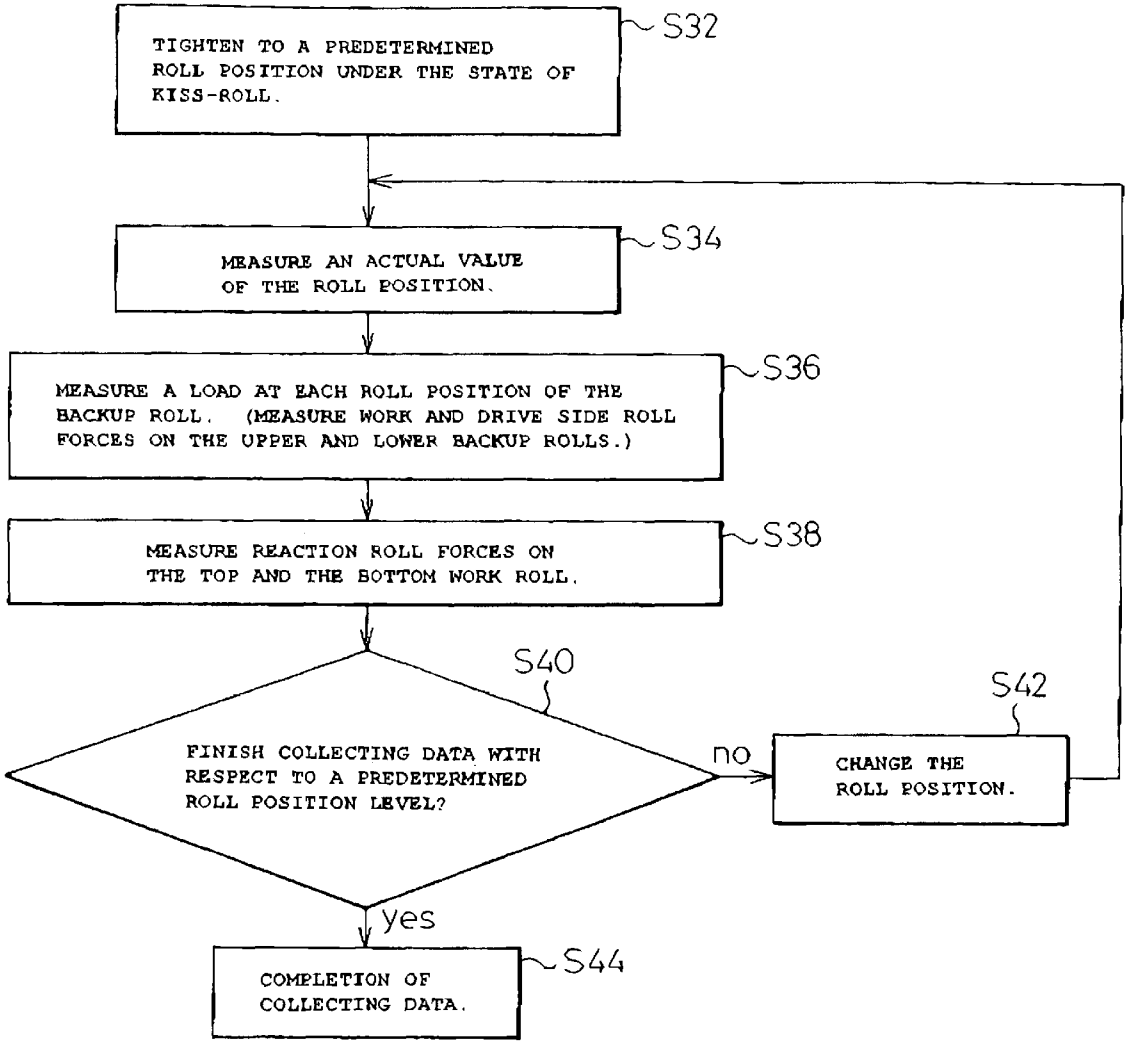
FIG. 6 is a flow chart showing a method of measurement of roll forces of the backup roll and a thrust force of the work roll of an embodiment of the present invention.

In general, the deformation characteristic of the housing and reduction system is changed by a rolling load. Therefore, it is necessary that data is collected with respect to a plurality of roll forcess and a plurality of levels of tightening loads. FIG. 6 is a view showing an algorithm for collecting data with respect to a plurality of roll forcess and a plurality of levels of tightening loads.

First, in step S32, under the condition of kiss-rolling in which all the rolls 24, 28, 32 36 are contacted with each other, the rolls are tightened to a predetermined roll forces by the roll positioning devices 1 (step S34). Next, the reduction load is measured by the load cells 10*a* to 10*d* (step S36). Then, the thrust counterforces of the top 28 and the bottom work roll 32 are measured by the load cells 10*e*, 10*f*. Next, in step S40, it is judged whether or not the collection of data is completed with respect to a predetermined roll forces level. If the collection of data is not completed, that is, in the case of No in step S40, the roll forces is changed in step S42, and the program returns to step S34. Then, the above procedure is repeated. When the collection of data is completed with respect to a predetermined roll forces level, that is, in the case of Yes in step S40, the collection of data is completed in step S44.

It is preferable that the number of roll forces levels at which data is collected is large. However, in the case of a usual rolling mill, it is practical to collect data, the number of which is approximately 10 to 20, because the accuracy is sufficiently high when the data of the above number are collected. However, in this case, mill-hysteresis is caused in which a difference is caused between the direction of tightening the roll positioning devices and the direction of releasing the roll positioning devices. In this case, it is preferable that data is collected with respect to at least one reciprocating motion of the tightening direction and the releasing direction and the thus measured data is averaged.

Figure 7:
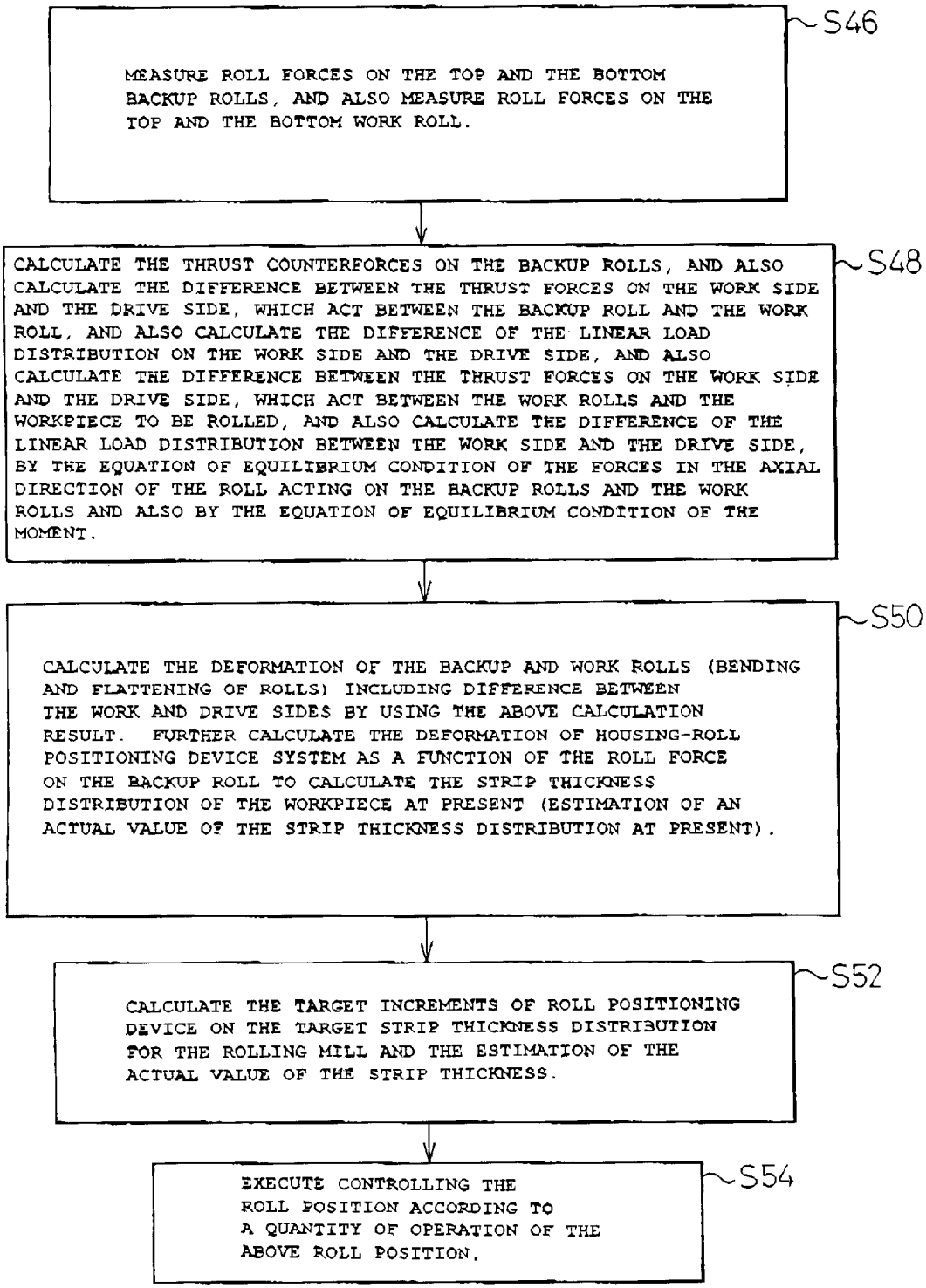
FIG. 7 is a flow chart showing a method of controlling a roll forces of an embodiment of the present invention.

Referring to FIG. 7, a preferable embodiment of roll forces control of a cross-roll type four rolling mill is explained below. In this cross-roll type four rolling mill, a thrust force acting between the work roll and a workpiece to be rolled can not be neglected.

First, the roll forces of the backup rolls acting on the roll fulcrum positions of the top 24 and the bottom backup rolls 36 are measured by the load cells 10*a* to 10*d*, and the thrust forces of the top 28 and the bottom work roll 32 are measured by the load cells 10*e*, 10*f* (step S46). Next, by the equation of equilibrium condition of the forces in the axial direction of the roll acting on the backup rolls 24, 36 and the work rolls 28, 32 and also by the equation of equilibrium condition of the moment, the thrust counterforces of the backup rolls 24, 36 are calculated, and also the difference between the thrust forces on the work side and the drive side, which act between the backup roll 24 and the work roll 28 and also between the work roll 32 and the backup roll 36, is calculated, and also the difference of the linear load distribution on the work side and the drive side is calculated, and also the difference between the thrust forces on the work side and the drive side, which act between the work rolls 28, 32 and the workpiece to be rolled (not shown), is calculated, and also the difference of the linear load distribution between the work side and the drive side is calculated (step S48).

In this example, a quantity of off-center of the workpiece to be rolled is already known because it is measured by a sensor. Therefore, the above procedure of calculation can be carried out in the same manner as that of the case of the adjustment of the zero point of reduction shown in FIG. 3. When the load distribution between the rolls is used and also the load distribution between the workpiece to be rolled and the work roll is used, the bend deformation and the flattening deformation of the backup rolls 24, 36 and the work rolls 28, 32 are calculated including a difference between the work and the drive side. At the same time, the deformation of the housing and the reduction system is calculated as a function of the roll forces of the backup rolls 24, 36 measured by the load cells 10*a* to 10*d*, so that the strip thickness distribution at the present time is calculated (step S50). At this time, concerning the deformation characteristic of the housing and reduction system, it is preferable to use the deformation characteristic obtained by the method shown in FIG. 6.

From the strip thickness distribution which is previously determined as a target of the rolling operation and also from the estimated values of the actual result of the strip thickness distribution at the present time which has been calculated in the above manner, a increments of the roll positioning devices to accomplish the above target value is calculated (step S52). According to this target value, the roll forces control is executed (step S54).

When the above method is adopted, asymmetry of the strip thickness distribution which occurs right below the roll bite can be accurately determined without causing any delay of time. Therefore, this method can provide a great effect to stabilize the threading of a leading end and a trailing end of a steel strip in the process of finish-rolling of a hot strip mill for which a quick and appropriate roll forces control is required.

In this connection, it is effective that the above information obtained from the single body of the rolling mill is combined with the information obtained from a detection device arranged on the entry side and the delivery side of the rolling mill such as a (lateral) traveling sensor and a looper load cell. Further, in the case of tandem rolling, it is effective that the above information obtained from the single body of the rolling mill is combined with the information obtained from other rolling mills arranged on the upstream side and the downstream side.

In FIG. 7, the roll-cross type rolling mill is an object, and a control method in which consideration is given to a thrust force acting between the work rolls 28, 32 and the workpiece to be rolled is shown. However, in the case of a common four rolling mill which is not a roll-cross type rolling mill, a thrust force acting between the work roll and the workpiece to be rolled is negligibly small as explained before. Therefore, it is possible to conduct the same control as that shown in FIG. 7 even when information of one of the top and the bottom roll system is obtained. When the measured values of both the top and the bottom roll system can be utilized, the number of unknowns can be decreased by one. Accordingly, when the least square solution is found by utilizing all of the equation of equilibrium condition of the force in the axial direction of the roll and the equation of equilibrium condition of the moment, it becomes possible to find a more accurate solution.

Figure 8:
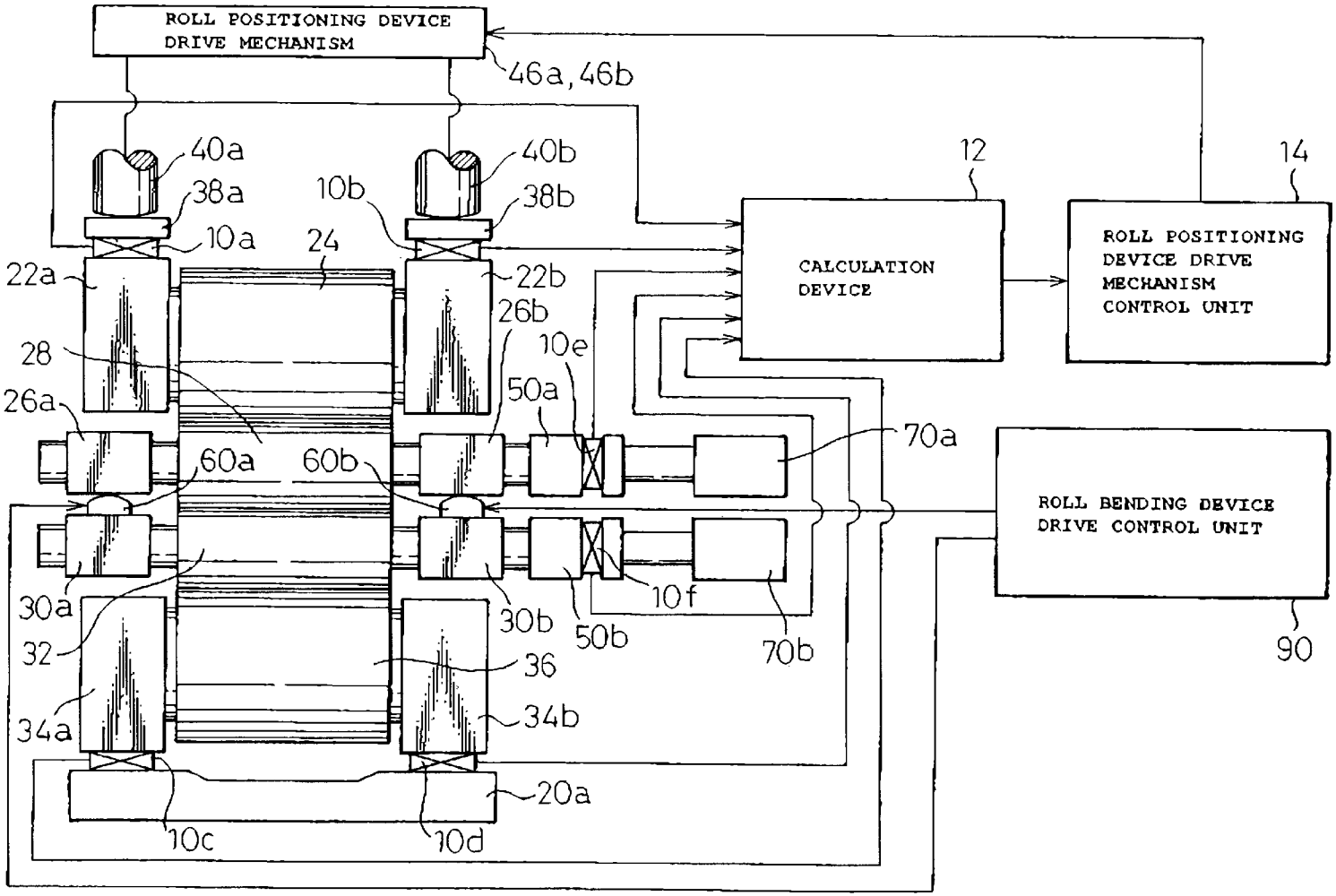
FIG. 8 is a schematic illustration showing a four rolling mill having roll bending device of another embodiment of the present invention.

FIG. 8 is a view showing a four rolling mill of another embodiment of the present invention. The rolling mill of this embodiment includes: a pair of roll bending devices 60*a*, 60*b* arranged between the top work roll chocks 26*a*, 26*b* and the bottom work roll chocks 30*a*, 30*b*; and thrust reaction forces support chocks 50*a*, 50*b* for supporting thrust counterforces in the axial direction of the work rolls 28, 32. Except for the above points, the structure of the rolling mill shown in FIG. 8 is approximately the same as that of the rolling mill shown in FIG. 2.

Roll bending forces of the roll bending devices 60*a*, 60*b* are controlled by the roll bending control unit 90. In the strip rolling mill shown in FIG. 8, thrust forces in the axial direction of the work rolls 28, 32 are supported by the chocks 50*a*, 50*b* for supporting thrust counterforces, and the top work roll chocks 26*a*, 26*b* and the bottom work roll chocks 30*a*, 30*b* support only the radial forces acting in the vertical and the rolling direction.

Since the roll bending forces are given to the work roll chocks 26*a*, 26*b*, 30*a*, 30*b*, frictional forces in the axial directions of the work rolls 28, 32 are given to the roll bending devices 60*a*, 60*b*, especially frictional forces in the axial directions of the work rolls 28, 32 are given between the load giving portion and the work roll chocks 26*a*, 26*b*, 30*a*, 30*b*. These frictional forces could be a cause of an error when the thrust counterforces is measured. In order to solve the above problems, the following countermeasures are taken in the embodiment shown in FIG. 8. There are provided chocks 50*a*, 50*b* for supporting the thrust counterforces in the embodiment shown in FIG. 8. Therefore, the work roll chocks 26*a*, 26*b*, 30*a*, 30*b* for supporting the roll bending forces are not given the thrust forces. In this way, the frictional force acting in the axial direction of the roll can be minimized. Due to the foregoing, the accuracy of measuring the thrust counterforces can be remarkably enhanced.

In this connection, in the case where the rolling mill includes a work roll shifting device 70 as shown in FIG. 8, since the shifting direction of the work roll 28 is reverse to the shifting direction of the work roll 32. Therefore, it is preferable that the chocks 26*a*, 26*b*, 30*a*, 30*b* for supporting the radial load are restricted by keeper strips and others so that the chocks can not be moved in the axial direction.

In the embodiment shown in FIG. 8, load cells 10*e*, 10*f* for measuring the thrust counterforces are arranged in the work roll shifting device 70. However, in the case of a rolling mill having no work roll shifting device, the chocks 50*a*, 50*b* for supporting the thrust counterforces are restricted in the axial direction of the roll by the keeper strips (not shown) via the load cells 10*e*, 10*f* for measuring the thrust counterforces.

In the case of a rolling mill having no work roll shifting device, a distance of movement in the axial direction of the roll is very small. Therefore, when only one of the top work roll chocks 26*a*, 26*b* and the bottom work roll chocks 30*a*, 30*b* are separated into the chock for supporting the radial load and the chock for supporting the thrust counterforces, the same effect can be provided.

Figure 9:
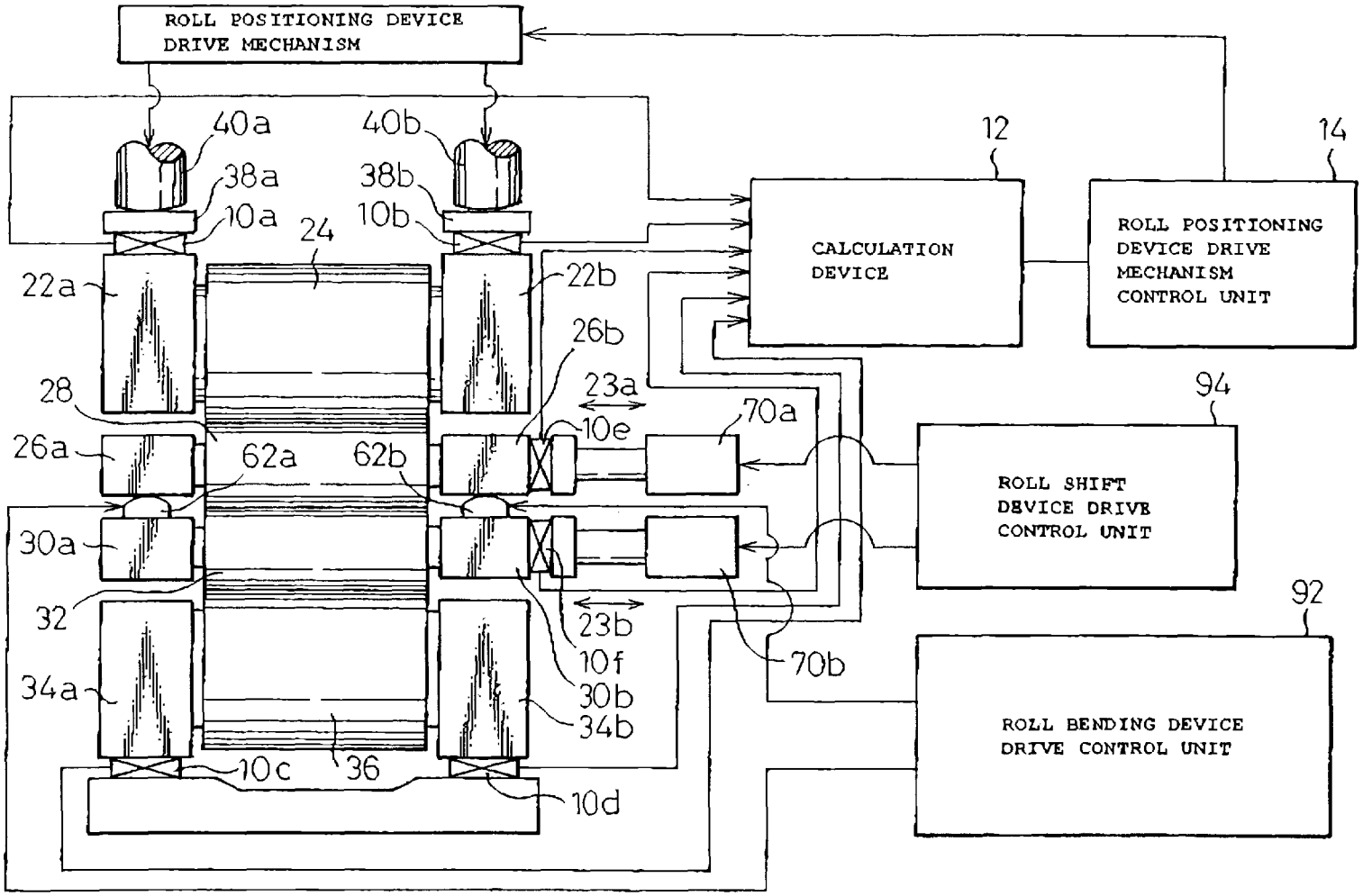
FIG. 9 is a schematic illustration showing a four rolling mill having a roll shifting device of still another embodiment of the present invention.

Next, referring to FIG. 9, still another embodiment of the present invention will be explained below. The rolling mill of the embodiment shown in FIG. 9 includes hydraulic servo type work roll bending devices 62*a*, 62*b*. Except for that, the rolling mill of the embodiment shown in FIG. 9 is approximately the same as the rolling mill of the embodiment shown in FIG. 2. Like reference characters are used to indicate like parts in FIGS. 2 and 9.

In the embodiment shown in FIG. 9, the roll bending device drive control unit 92 controls the roll bending devices 62*a*, 62*b* in such a manner that predetermined work roll bending forces are given to the roll bending devices 62*a*, 62*b* and further oscillation components of 10 Hz can be superimposed. As described before, when an oscillation component is superimposed on a predetermined roll bending force in the case of measuring thrust counterforces in the above strip rolling mill, it is possible to enhance the measurement accuracy of the thrust counterforces.

The roll shifting device drive control unit 94 moves the top 28 and the bottom work roll 32 to predetermined positions. In addition to that, the roll shifting device drive control unit 94 drives and controls the work roll shifting devices 70*a*, 70*b* so that the top 28 and the bottom work roll 32 can be given a minute shifting oscillation in the axial direction, the amplitude of which is not less than 1 mm and the period of which is not more than 30 seconds, as shown by the arrows 23*a*, 23*b* in the drawing. This function can be realized as follows. For example, in the case of a hydraulic servo type work roll shifting device, in the roll shifting device drive control unit 94, a signal corresponding to a predetermined oscillation is superimposed on an output signal for giving a target roll shifting position by a function generator.

In the case of collecting data of the thrust counterforces of the work roll, a minute shifting oscillation is given, preferably a minute sine curve shifting oscillation, the amplitude of which is ±3 mm and the period of which is approximately 5 seconds, is given by the above work roll shifting devices 70*a*, 70*b*, and the measured values of the thrust counterforces corresponding to at least one period is averaged, so that it can be used as the aforementioned thrust counterforces. Due to the foregoing, a direction of the frictional force acting between the work roll bending devices 62*a*, 62*b* and the work roll chocks 26*a*, 26*b* is inverted and the thrust counterforces is measured. When this is averaged, it becomes possible to eliminate an influence of the above frictional force.

In this connection, concerning the amplitude, it is necessary to select the most appropriate value according to the mechanical accuracy of the work roll shifting devices 70*a*, 70*b*. For example, in the case where mechanical play of the work roll shifting devices 70*a*, 70*b* exceeds 6 mm, an effective oscillation is given to the work rolls 28, 32. In order to invert a frictional force between the roll bending devices 62*a*, 62*b* and the work roll chocks 26*a*, 26*b*, it is necessary to give an oscillation, the amplitude of which is at least ±4 mm.

When the amplitude is too large, the rolling operation is affected. Therefore, it is preferable that the minimum amplitude is adopted so that the above frictional force can be inverted. Concerning the frequency of oscillation, from the viewpoint of decreasing the measurement period of the thrust counterforces, it is preferable that the frequency of oscillation is short. However, when the frequency of oscillation is too short, a peak value of the thrust counterforces is increased to an excessively high value, so that the rolling operation is affected and further the thrust counterforces exceeds a load limit of the work roll shifting device. In this case, it is preferable that the oscillation period is extended while the measuring period of the necessary thrust counterforces is set at an upper limit.

Figure 10:
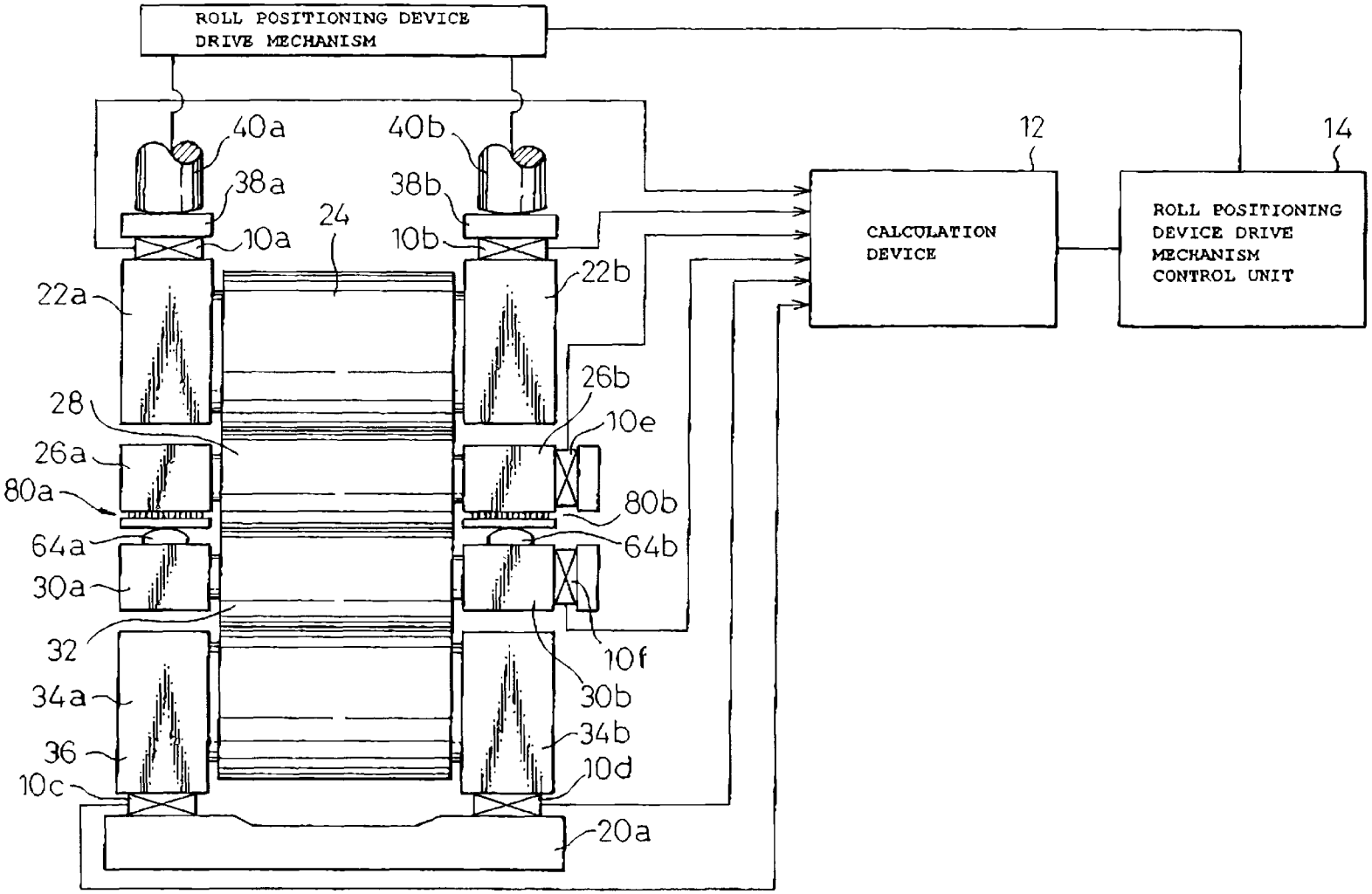
FIG. 10 is a schematic illustration showing a four rolling mill having roll bending device of still another embodiment of the present invention.

Referring to FIG. 10, a rolling mill of still another embodiment of the present invention will be explained below. In the rolling mill of the embodiment shown in FIG. 10, there are provided slide bearings 80*a*, 80*b*, which can be freely slid in the axial direction of the roll, between the roll bending devices 64*a*, 64*b* and the top work roll chocks 26*a*, 26*b*. Due to the above arrangement, even when a roll bending force is acting, frictional forces in the axial direction of the roll acting between the roll bending devices 64*a*, 64*b* and the work roll chocks 26*a*, 26*b*, 30*a*, 30*b* can be decreased so that the frictional forces can be neglected. Therefore, the thrust counterforces acting on the work rolls 28, 32 can be accurately measured.

In this connection, an operation range of the slide bearing is limited. At a position of the limit of the operation range of the slide bearing, it is impossible to decrease a frictional force which acts in a direction exceeding the operation limit. In order to solve the above problems, it is preferable to adopt the following structure. For example, there is provided a mechanism for returning the slide bearing to the center by a spring when no load is given to the slide bearing. Kiss-roll tightening is periodically carried out, and the roll bending force is released, so that the slide bearings 80*a*, 80*b* can be returned to the centers of the operation ranges. In this case, an intensity of the restoring force of this spring mechanism must be sufficiently lower than the intensity of the thrust force acting on the top 28 and the bottom work roll 32, and higher than a resistance of operation of the sidle bearings 80*a*, 80*b* when no loads are given.

In the structure shown in FIG. 10, the slide bearings 80*a*, 80*b* are arranged in the top work roll chocks 26*a*, 26*b*, and the roll bending devices 64*a*, 64*b* are arranged in the bottom work roll chocks 30*a*, 30*b*. However, the positional relation between the slide bearings 80*a*, 80*b* and the roll bending devices 64*a*, 64*b* may be changed with respect to the upward and downward direction. Further, the slide bearings may be arranged in the load giving portions of the roll bending devices.

The strip rolling mill shown in FIG. 10 is not provided with a work roll shifting device for shifting a work roll in the axial direction of the roll. However, even when the strip rolling mills not provided with the work roll shifting device, it is possible to arrange the slide bearings. However, there is a possibility that the slide bearing reaches a position of the operation limit when the work roll position is changed by the work roll shifting device. In the above case, it is preferable that the slide bearing is returned to the center of the operation range by releasing the work roll bending force as described above.

Figure 11:
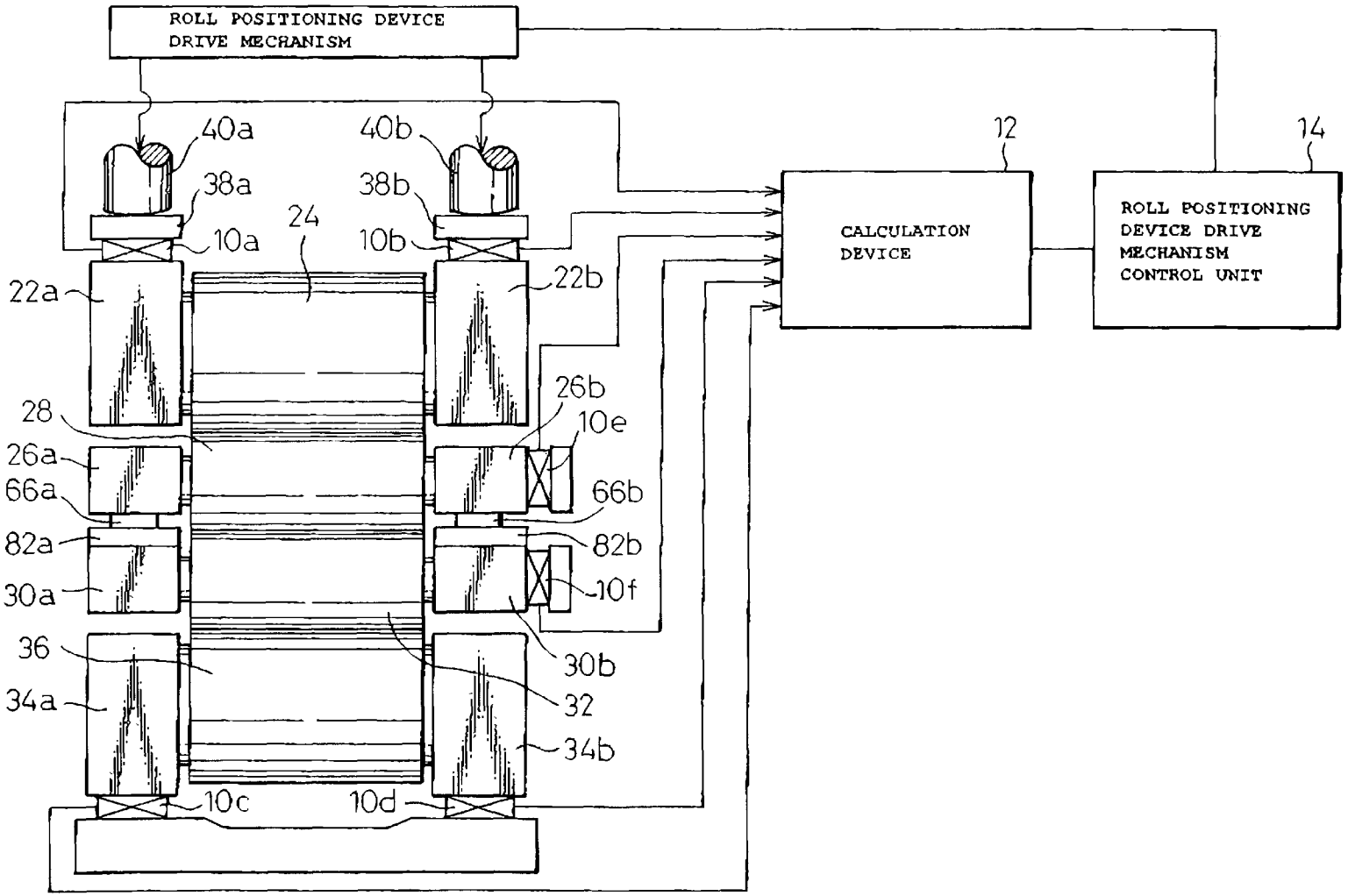
FIG. 11 is a schematic illustration showing a four rolling mill having roll bending device of still another embodiment of the present invention.

Referring to FIG. 11, a rolling mill of still another embodiment of the present invention will be explained below. In the embodiment shown in FIG. 11, there are provided load transmission members 82*a*, 82*b* between the work roll bending devices 66*a*, 66*b* and the work roll chocks 26*a*, 26*b* which come into contact with the work roll bending devices 66*a*, 66*b*. The load transmission member 82*a*, 82*b* has a closed space in which liquid is enclosed, and at least a portion of the closed space is covered with thin skin, the elastic deformation resistance with respect to out-of-plane deformation of which is not more than 5% of the maximum value of the roll bending force. Therefore, even if the maximum roll bending force is given, the liquid film is not cut off.

Figure 12:
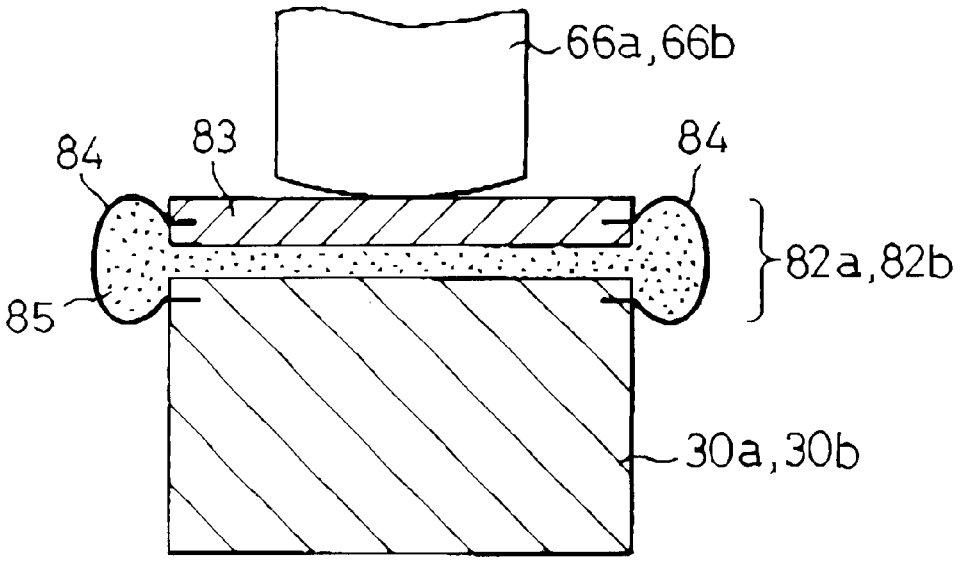
FIG. 12 is an enlarged view of a load transmission member.

FIG. 12 is a view showing an example of the load transmission member 82*a*, 82*b*. In the example shown in FIG. 12, the load transmission member 82*a* includes: a metallic strip 83 arranged in an upper portion of the bottom work roll chock 30*a*, 30*b* while a space is left between the metallic strip 83 and the bottom work roll chock 30*a*, 30*b*; and a thin skin 83*a* arranged between a lower face of the metallic strip 83 and an upper face of the bottom work roll chock 30*a*, 30*b* in such a manner that the thin skin 83*a* covers a space between the metallic strip 83 and the bottom work roll chock 30*a*, 30*b*. The space left between the lower face of the metallic strip 83 and the upper face of the bottom work roll chock 30*a*, 30*b* is surrounded by the skin 84 and filled with liquid 85. Concerning the material of the skin 84, for example, it is possible to use high polymer of high mechanical strength or compound material in which textile fabrics of carbon fiber is coated with lining for preventing liquid from leaking out.

When the thin skin 84, the mechanical strength of which is sufficiently high, is used as described above, even when the roll bending devices 66*a*, 66*b* and the work roll chocks 30*a*, 30*b* are a little displaced in the axial direction of the roll, that is, even when the roll bending devices 66*a*, 66*b* and the work roll chocks 30*a*, 30*b* are a little displaced in the traverse direction in FIG. 12, a shearing deformation resistance generated in the load giving members 82*a*, 82*b* can be decreased to a negligibly small value, that is, an apparent coefficient of friction can be decreased to a negligibly small value. Concerning the liquid to be put into the space, it is preferable to use liquid having a rust prevention property, for example, fat and oil may be used, or alternatively grease may be used.

Figure 13:
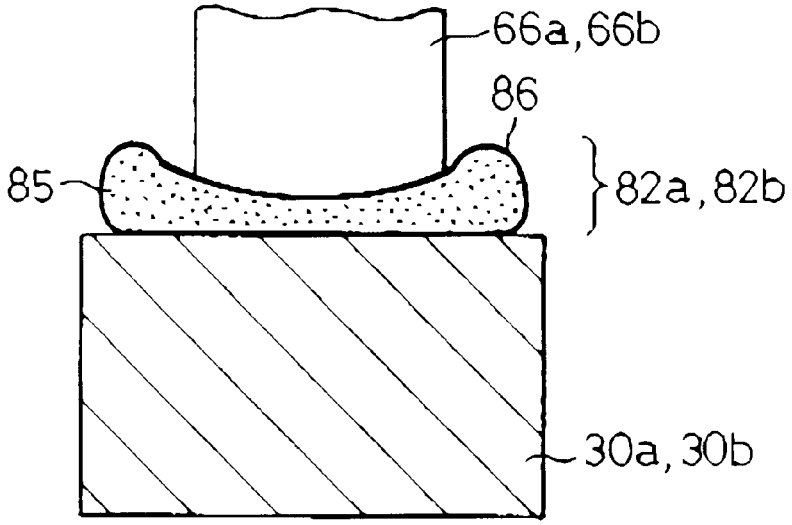
FIG. 13 is an enlarged view of a load transmission member of another embodiment.

FIG. 13 is a view showing another embodiment of the load transmission member 82*a*, 82*b*. The load transmission member 82*a*, 82*b* of the embodiment shown in FIG. 13 is composed in such a manner that liquid 85 is enclosed in a bag-shaped closed space formed by the thin skin 86. Due to the above structure, compared with the load transmission member shown in FIG. 12, it is easy to replace the load transmission member 82*a*, 82*b* when it is deteriorated with time.

In this connection, the strip rolling mill shown in FIG. 11 is not provided with the roll shifting device for shifting the work rolls 28, 32. However, even in the case of a rolling mill having the roll shifting device, the load transmission member shown in FIG. 12 can be incorporated into the rolling mill. However, in this case, in the same manner as that of the slide bearing explained in FIG. 10, it is preferable that the mechanism for returning the operation limit position to the center is provided and the necessary operation is carried out.

In this connection, in the arrangement shown in FIG. 11, the roll bending devices 66*a*, 66*b* are arranged in the top work roll chocks 26*a*, 26*b*, and the load transmission members 82*a*, 82*b* are arranged in the bottom work roll chocks 30*a*, 30*b*. However, the roll bending devices 66*a*, 66*b* and the load transmission members 82*a*, 82*b* may be replaced with each other with respect to the upward and downward direction. Further, the load transmission members 82*a*, 82*b* may be arranged in the roll bending devices 66*a*, 66*b*.

Figure 14:
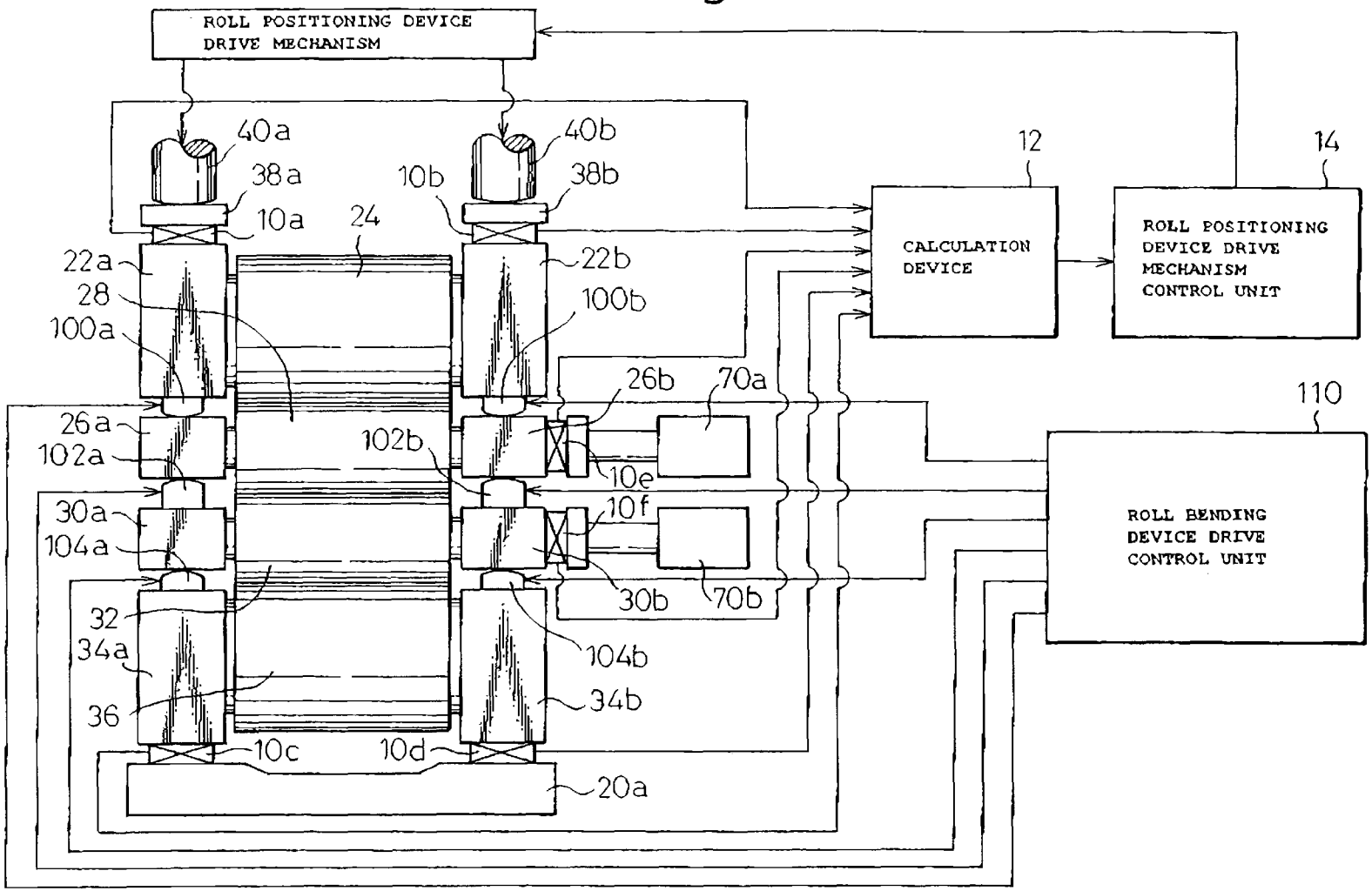
FIG. 14 is a schematic illustration showing a four rolling mill having a work roll bending device, a work roll shifting device and a thrust reaction forces measuring mechanism.

FIG. 14 is a view showing a four rolling mill having a work roll shifting mechanism. In the rolling mill shown in FIG. 4, the work roll 28, 32 is connected with the work roll shifting device 70*a*, 70*b* via the load cell 10*e*, 10*f* for measuring the thrust counterforces. Therefore, the thrust counterforces of the work roll 28, 32 is measured by the load cell 10*e*, 10*f*. In the same manner as that of the embodiments described before, the load cells 10*a* to 10*f* are connected with the calculation device 12. The work roll chocks 26*a*, 26*b*, 30*a*, 30*b* are respectively given forces in the vertical direction by the increase work roll bending devices 102*a*, 102*b* or the decrease work roll bending devices 100*a*, 100*b*, 104*a*, 104*b*. The increase work roll bending devices 102*a*, 102*b* and the decrease work roll bending devices 100*a*, 10*b*, 104*a*, 104*b* are driven and controlled by the roll bending device drive control unit 110.

In the prior art, the frictional forces acting between the roll bending devices 102*a*, 102*b*, 10*a*, 100*b*, 104*a*, 104*b* and the work roll chocks 26*a*, 26*b*, 30*a*, 30*b* can be a factor of disturbance when the thrust counterforces are measured by the load cells 10*e*, 10*f*.

In order to solve the above problems, in this embodiment, when the thrust counterforces in the axial direction of the work rolls 28, 32 are measured, the roll bending device drive control unit 110 conducts controlling so that an absolute value of the force of the roll balance device to give a load to a roll chock, the thrust counterforces of which is measured, can be not more than ½ of a force in the roll balance condition, or preferably zero, or alternatively the roll bending device drive control unit 110 conducts control so that an absolute value of the force of the roll bending device can be not more than ½ of a force in the roll balance condition, or preferably zero. Due to the foregoing, the thrust counterforces can be accurately measured, and the factor of disturbance with respect to the equation of equilibrium condition of the moment acting on the roll can be minimized. Therefore, the roll forces can be set and controlled more accurately.

In this case, the roll balance condition is defined as follows. Under the condition that a gap is formed between the top 28 and the bottom work roll 32 when rolling is not conducted, the top work roll 28 is lifted up onto the top backup roll 24 side, and the top work roll 28 is pressed against the top backup roll 24 so that the rolls 28, 24 cannot slip against each other, and the bottom work roll 32 is pressed against the bottom backup roll 36 so that the rolls 32, 36 cannot slip against each other. In order to press the top work roll 28 and the bottom work roll 32 against the top backup roll 24 and the bottom backup roll 36, predetermined forces are previously given to the roll chocks. This condition is defined as the roll balance condition.

Figure 15:
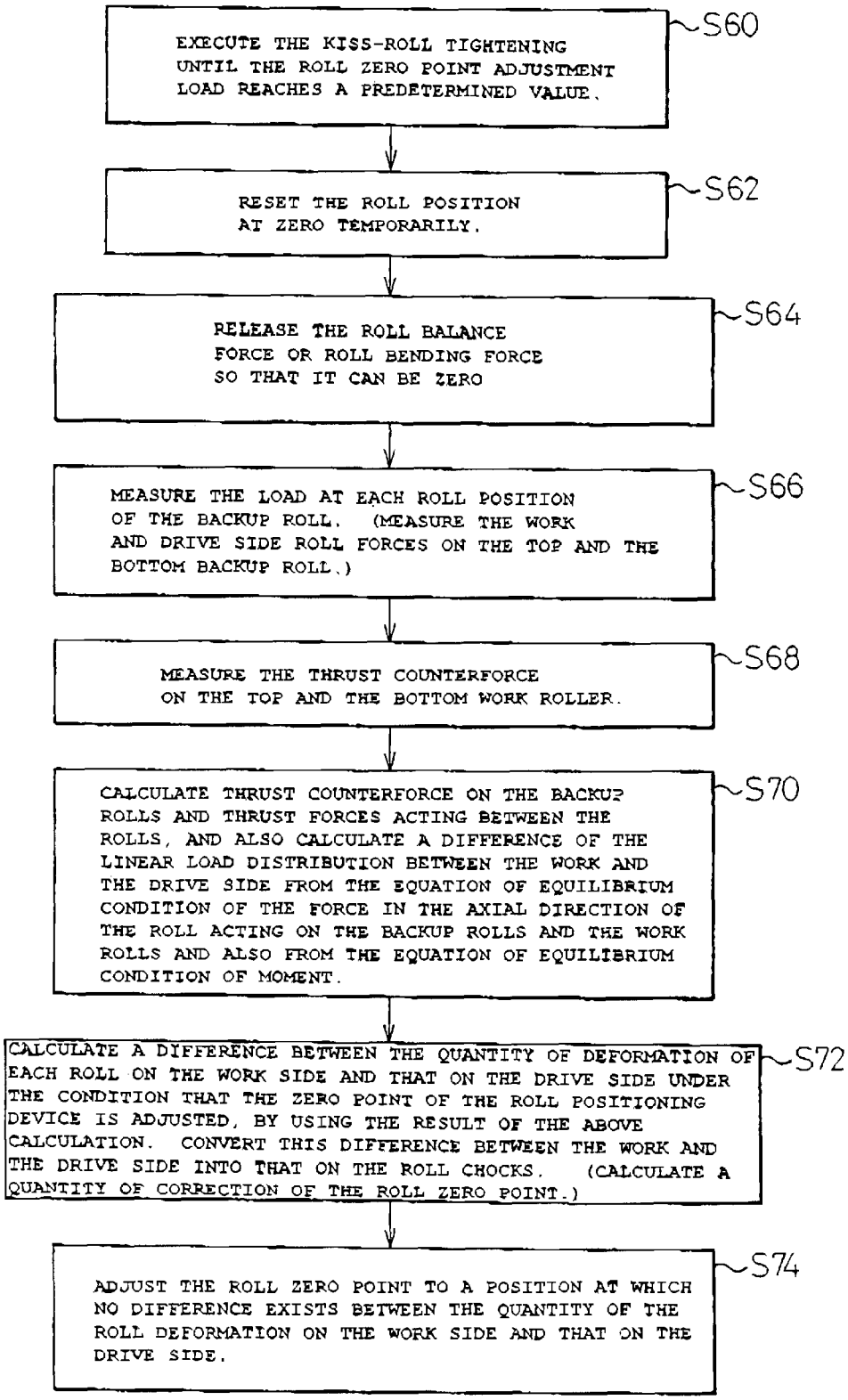
FIG. 15 is a flow chart showing still another embodiment of a method of adjusting a zero point of reduction in the case of a four rolling mill.

FIG. 15 is a flow chart showing a method of adjusting the reduction zero point of the rolling mill shown in FIG. 14. As described before, the adjustment of the reduction zero point is conducted after the roll has been changed. In the usual adjustment of the reduction zero point, the kiss-roll tightening is carried out until the roll forces of the backup roll reaches a predetermined zero adjustment load (step S60). At this time, the reduction leveling is adjusted so that the roll forces of the backup roll on the work side and that on the drive side can be the same with each other, and then the roll forces is temporarily set at zero (step S62). Concerning the roll forces of the backup roll, either the roll forces of the top backup roll 24 measured by the load cells 10*a*, 10*b* or the roll forces of the bottom backup roll 36 measured by the load cells 10*c*, 10*d* may be singly used. Alternatively, an average value of the roll forces of the top 24 and the bottom backup roll 36 measured by the load cells 10*a*, 10*b*, 10*c*, 10*d* may be used.

Next, under the condition of the tightening of kiss-roll, the roll balance force of the work roll or the roll bending force is released so that it can be zero (step S64). As described before, the reason why the roll bending force is made to be zero at this time is to enhance the accuracy of the measurement of the thrust counterforces of the work roll to be conducted next time. Accordingly, the roll bending force is not necessarily made to be zero. The roll bending force may be set in such a manner that an appropriate value of not more than ½ of the force in the normal roll balance condition is found by experience and the roll bending force is set at the value. The essential point is that the roll bending force is set at a lower value so that it cannot be a factor of disturbance when the thrust counterforces is measured.

When the roll bending force is charged at this time, the load cell load is also changed. Whether or not the zero point adjustment of the roll forces is conducted in this state causes no problems. The reason is described as follows. As disclosed in Japanese Examined Patent Publication No. 4-74084, the deformation of the roll caused in the zero point adjustment of reduction is calculated in a different way. Therefore, only the roll bending force used in this calculation is changed.

Next, in the above condition, the roll forces of the top 24 and the bottom backup roll 36 are measured by the load cells 10*a* to 10*d* (step S66), and the roll forces of the top 28 and the bottom work roll 32 are measured by the load cells 10*e*, 10*f* (step S68). As described before, since the roll balance force or the roll bending force acting on the work rolls is substantially set at zero at this time, it is possible to accurately measure the thrust counterforces acting on the work roll.

Next, when the equations (1) to (8) described before are solved according to the above measured values, as described before by referring to FIGS. 3 and 4, from the equation of equilibrium condition of the force in the axial direction of the roll acting on the backup rolls 24, 36 and the work rolls 28, 32, and also from the equation of equilibrium condition of moment, thrust counterforces of the backup rolls 24, 36 and thrust forces acting between the rolls 24, 28, 32, 36 are calculated, and also a difference of the linear load distribution between the work and the drive side is calculated (step S70).

Next, a difference between the quantity of deformation of each roll 24, 28, 32, 36 on the work side and that on the drive side under the condition that the zero point of the roll positioning devices is adjusted is calculated by using the result of the above calculation This difference between the work and the drive side is converted into a position of the fulcrum of the screw 40*a*, 40*b*, that is, this difference between the work and the drive side is converted into the central axial line of the screw 40*a*, 40*b*, so that a quantity of correction of the zero point of the roll positioning devices is calculated (step S72).

The difference of the quantity of the deformation of the roll between the work and the drive side is mainly generated by an asymmetrical component of the linear load distribution between the work and the drive side acting between the rolls 24, 28, 32, 36. In this case, the deformation of the roll includes a deformation of the flattened roll, a deformation of the bent roll, and a deformation of the bent neck portion of the roll. The difference between the roll deformation on the work side and that on the drive side is mainly caused by the difference between the deformation of the flattened roll on the work side and that on the drive side. This difference between the deformation of the flattened roll on the work side and that on the drive side can be immediately calculated by $p^{df}{}_{WB}{}^{T}$, $p^{df}{}_{WB}{}^{B}$, $p^{df}{}_{WW}$ which have already been found. When a difference between the total of the quantity of the deformation of the flattened roll at the roll end position calculated above on the work side and that on the drive side is extrapolated to the roll fulcrum position of the backup roll, a quantity of correction of the zero point of the roll positioning devices is calculated. In this way, the zero point of the reduction is adjusted to a position at which no difference exists between the quantity of the roll deformation on the work side and that on the drive side (step S74). In this connection, when the quantity of the deformation of the flattened roll is extrapolated, consideration may be given to asymmetry of the bent roll and asymmetry of the deformation of the roll neck portion.

As described before, there is a small possibility that the thrust force generated between the rolls in the process of zero point adjustment is also generated in the process of rolling in the same manner. Accordingly, the zero point of reduction, which is a reference of the position of reduction, is preferably determined when the thrust force between the rolls is zero. Therefore, it is desired that an ideal condition, in which an asymmetrical load on the work and the drive side caused by the thrust force between the rolls is not generated, is made to be a true zero point of reduction. That is, when the roll forces is moved in a direction so that a quantity of asymmetry of the roll deformation on the work and the drive side can be eliminated, the roll forces can be set at the true zero point. When the zero point of reduction is set in this way, it becomes possible to conduct an accurate reduction setting while consideration is given to the asymmetrical load and deformation on the work and the drive side generated in the actual process of rolling.

As described before referring to FIG. 5, the deformation characteristic of the housing and the reduction system on the work side and that on the drive side are independently found.

Further, as described before referring to FIG. 6, in general, the deformation characteristic of the housing and the reduction system is changed by a rolling load. Therefore, it is necessary to collect data with respect to a plurality of roll forcess and tightening load levels.

Figure 16:
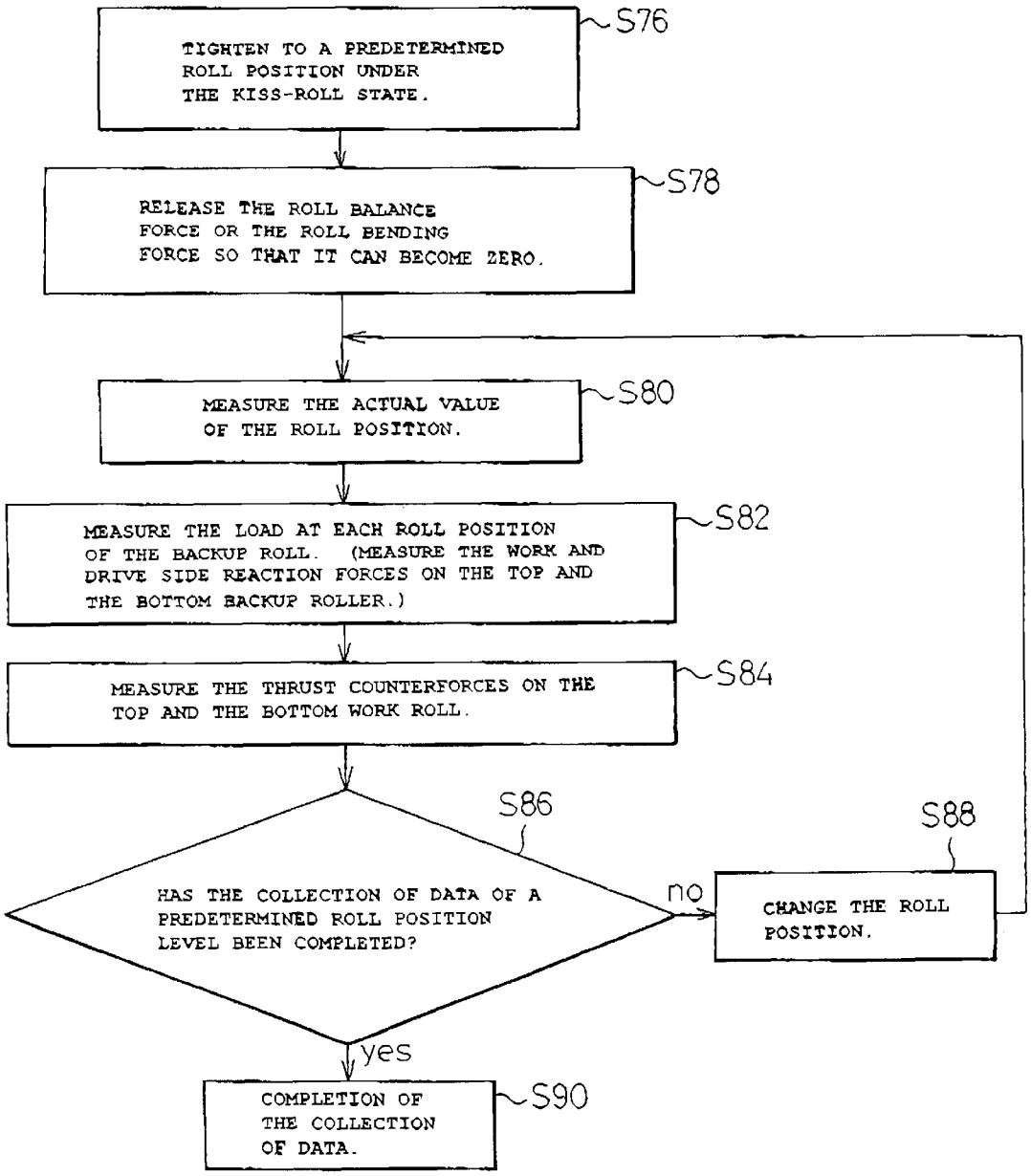
FIG. 16 is a flow chart showing a method of measuring roll forces of the backup roll and a thrust force of the work roll of an embodiment of the present invention.

Referring to FIG. 16, first, in step S76, the kiss-roll tightening test is started in such a manner that the rolls are tightened to a predetermined roll forces under the condition of a kiss-roll. Next, the roll balance force or the roll bending force is released to zero (step S78). As described before, the reason why the roll bending force is made to be zero is that the thrust counterforces of the work roll is accurately measured in the next process. Accordingly, the roll balance force or the roll bending force is not necessarily made to be zero. That is, it is sufficient that the roll balance force or the roll bending force is made to be a low value at which no disturbance is substantially caused when the thrust counterforces is measured. When an appropriate value of not more than ½ of the force of a normal roll balance condition is found by experience and the roll balance force or the roll bending force is set at the value, the object can be accomplished.

Next, an actual value of the roll forces under the above condition is measured (step S80). The roll forces of the top 24 and the bottom backup roll 36 are measured by the load cells 10*a* to 10*d* (step S82). The roll forces of the top 28 and the bottom work roll 36 are measured by the load cells 10*e*, 10*f* (step S84).

As described before, in general, the deformation characteristic of the housing and the reduction system is changed by a rolling load. Therefore, in the kiss-roll tightening test shown in FIG. 16, it is necessary to collect data with respect to a plurality of roll forcess and tightening load levels. In step S86, it is judged whether or not the collection of data has been completed with respect to a predetermined roll forces level. When the collection of data has not been completed, that is, in the case of NO in step S86, the roll forces is changed in step S88, and the program is returned to step S34, and the above procedure is repeated. When the collection of data with respect to a predetermined roll forces level is completed, that is, in the case of YES in step S86, the collection of data is completed in step S90.

It is desirable that the number of the roll forces levels is large. However, in the case of a common rolling mill, it is possible to obtain a practically high accuracy by obtaining data, the number of which is approximately 10 to 20. However, in this case, a difference is caused between the tightening load given in the tightening direction of the roll positioning devices and the tightening load given in the releasing direction of the roll positioning devices. In other words, mill-hysteresis is caused. In order to avoid the influence of this mill-hysteresis, it is preferable that data is collected in at least one reciprocation of the tightening and the releasing direction, and the thus obtained data is averaged.

Figure 17:
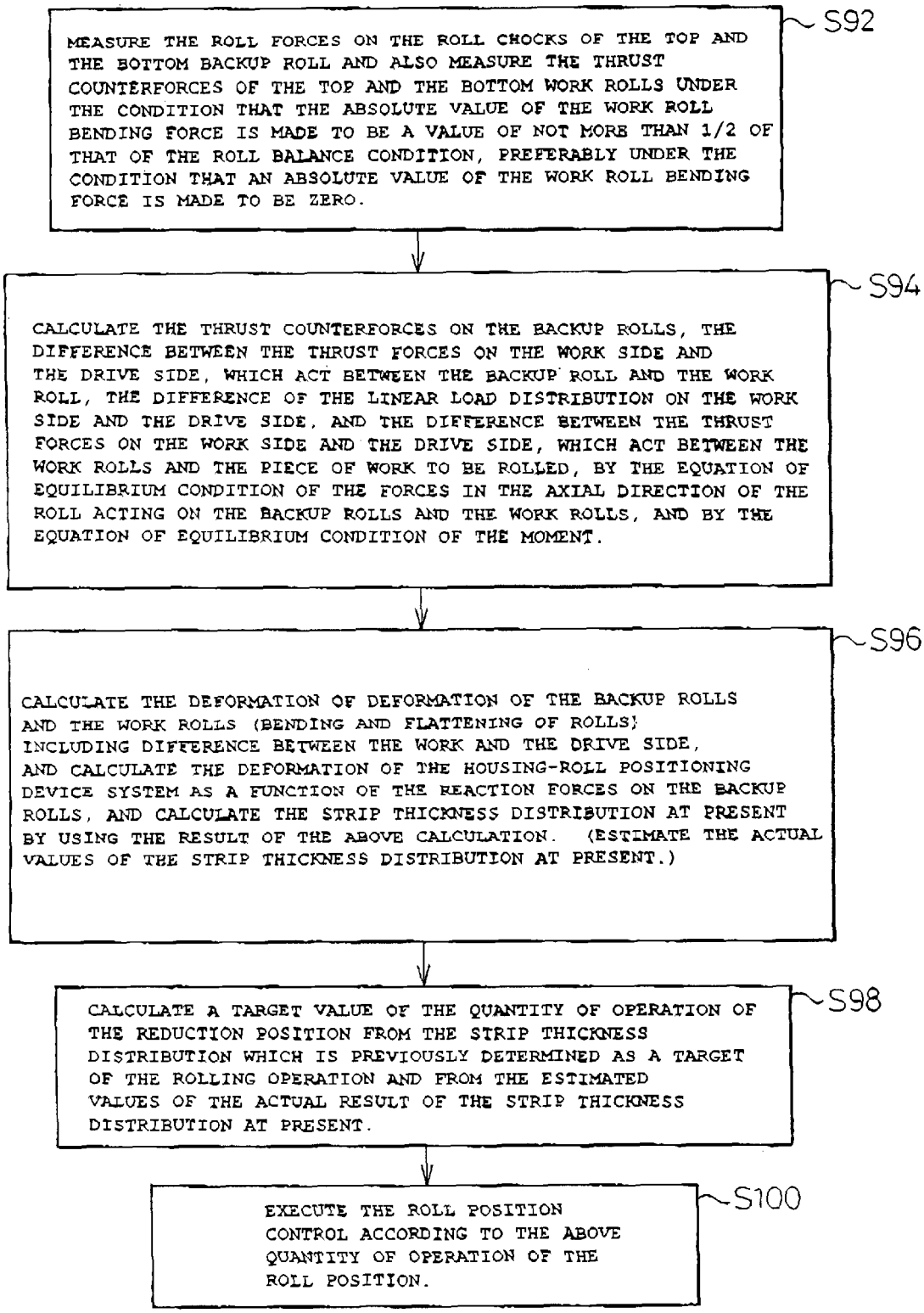
FIG. 17 is a flow chart showing a method of controlling a position of reduction of a four mill of still another embodiment of the present invention.

Referring to FIG. 17, explanations will be given to a preferable embodiment of a four rolling mill in which a thrust force acting between a work roll and a workpiece to be rolled can not be neglected.

First, under the condition that an absolute value of the work roll bending force is made to be a value of not more than ½ of that of the roll balance condition, preferably under the condition that an absolute value of the work roll bending force is made to be zero, the roll forces of the backup rolls acting on the roll fulcrum positions of the top 24 and the bottom backup roll 36 are measured by the load cells 10*a* to 10*d* in the process of rolling, and also the thrust counterforces of the top 28 and the bottom work roll 32 are measured by the load cells 10*e*, 10*f* (step S92).

Next, by the equation of equilibrium condition of the forces in the axial direction of the roll acting on the backup rolls 24, 36 and the work rolls 28, 32 and also by the equation of equilibrium condition of the moment, the thrust counterforces of the backup rolls 24, 36 are calculated, and also the difference between the thrust forces on the work side and the drive side, which act between the backup roll 24 and the work roll 28 and also between the work roll 32 and the backup roll 36, is calculated, and also the difference of the linear load distribution between the work side and the drive side is calculated, and also the difference between the thrust forces on the work side and the drive side, which act between the work rolls 28, 32 and the workpiece to be rolled (not shown), is calculated, and also the difference of the linear load distribution between the work side and the drive side is calculated (step S94).

In this example, a quantity of off-center of the workpiece to be rolled is already known because it is measured by a sensor. Therefore, the above procedure of calculation can be carried out in the same manner as that of the case of reduction zero point adjustment shown in FIG. 3. When the load distribution between the rolls is used and also the load distribution between the workpiece to be rolled and the work roll is used, which are obtained by this calculation, the bend deformation and the flattening deformation of the backup rolls 24, 36 and the work rolls 28, 32 are calculated including a difference between the work and the drive side. At the same time, the deformation of the housing and the reduction system is calculated as a function of the roll forces of the backup rolls 24, 36 measured by the load cells 10*a* to 10*d*, so that the strip thickness distribution at the present time is calculated (step 596). At this time, concerning the deformation characteristic of the housing and reduction system, it is preferable to use the deformation characteristic obtained by the method shown in FIG. 6.

From the strip thickness distribution which is previously determined as a target of the rolling operation and also from the estimated values of the actual result of the strip thickness distribution at the present time which has been calculated in the above manner, a increments of the roll positioning devices to accomplish the above target value is calculated (step S98). According to this target value, the roll forces control is executed (step S100).

When the above method is adopted, asymmetry of the strip thickness distribution which occurs right below the roll bite can be accurately determined without causing any delay of time. Therefore, this method can provide a great effect to stabilize the threading of a leading end and a trailing end of a steel strip in the process of finish-rolling of a hot strip mill for which a quick and appropriate roll forces control is required. In this connection, it is effective that the above information obtained from the single body of the rolling mill is combined with the information obtained from a detection device arranged on the entry side and the delivery side of the rolling mill such as a (lateral) traveling sensor and a looper load cell. Further, in the case of tandem rolling, it is effective that the above information obtained from the single body of the rolling mill is combined with the information obtained from other rolling mills arranged on the upstream side and the downstream side.

In FIG. 17, a control method in which consideration is given to a thrust force acting between the work rolls 28, 32 and the workpiece to be rolled is shown. However, in the case of a common four rolling mill which is not a roll-cross type rolling mill, a thrust force acting between the work roll and the workpiece to be rolled is negligibly small as explained before. Therefore, it is possible to conduct the same control as that shown in FIG. 17 even when information of one of the top and the bottom roll system is obtained. When the measured values of both the top and the bottom roll system can be utilized, the number of unknowns can be decreased by one. Accordingly, when the least square solution is found by utilizing the equation of equilibrium condition of the force in the axial direction of the roll and the equation of equilibrium condition of the moment, it becomes possible to find a more accurate solution.

Figure 18:
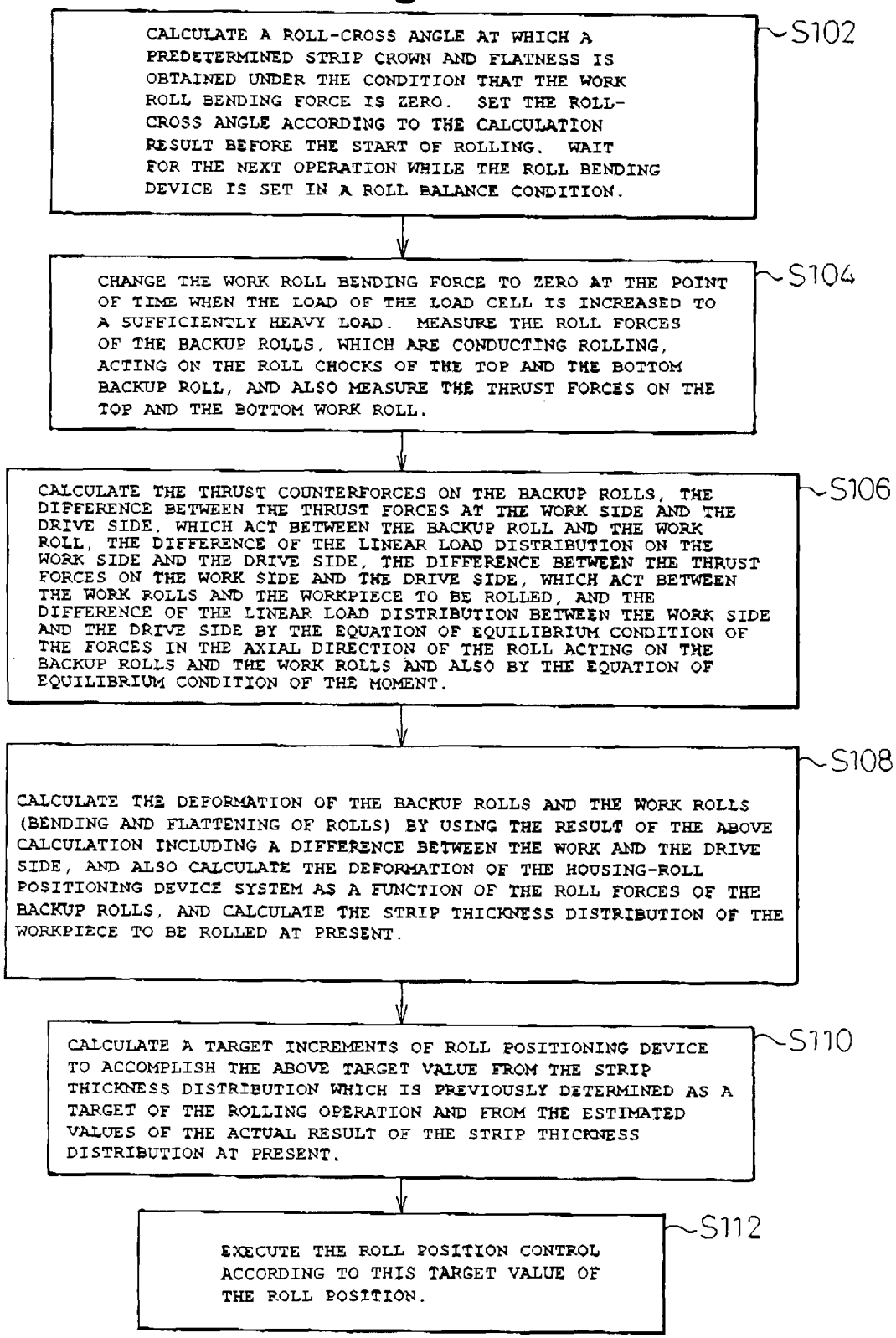
FIG. 18 is a flow chart showing a method of controlling a position of reduction of a roll-cross type four mill of still another embodiment of the present invention.

Referring to FIG. 18, another embodiment of roll forces control of a roll-cross type four mill will be explained below.

Referring to FIG. 18, another embodiment of roll forces control of a roll-cross type four rolling mill will be explained below.

First, in the setting calculation conducted before rolling, under the condition that the work roll bending force is zero, a roll-cross angle for accomplishing a predetermined strip crown and flatness is calculated. According to the result of the calculation, the roll-cross angle is set, and the roll forces, the circumferential speed of the roll and others are set. In this way, the roll bending device is set in a roll balance condition and waits for the next operation (step S102). Under the above condition, rolling is started, and the work roll bending force is changed to zero at the point of time when the load cell load is increased to a sufficiently heavy load. Under the above condition, the roll forces of the backup rolls, which are conducting rolling, acting at the roll fulcrum positions of the top 24 and the bottom backup roll 36 are measured by the load cells 10*a* to 10*d*, and the thrust forces of the top 28 and the bottom work roll 32 are measured by the load cells 10*e*, 10*f* (step S104), Next, by the equation of equilibrium condition of the forces in the axial direction of the roll acting on the backup rolls 24, 36 and the work rolls 28, 32 and also by the equation of equilibrium condition of the moment, the thrust counterforces of the backup rolls 24, 36 are calculated, and also the difference between the thrust forces on the work side and the drive side, which act between the backup roll 24 and the work roll 28 and also between the work roll 32 and the backup roll 36, is calculated, and also the difference of the linear load distribution on the work side and the drive side is calculated, and also the difference between the thrust forces on the work side and the drive side, which act between the work rolls 28, 32 and the workpiece to be rolled, is calculated, and also the difference of the linear load distribution between the work side and the drive side is calculated (step S106).

In this example, a quantity of off-center of the workpiece to be rolled is measured by a sensor, and it is already known. Therefore, the above procedure of calculation can be carried out in the same manner as that of the case of adjusting the zero point of reduction shown in FIG. 3.

Next, when the load distribution between the rolls is used and also the load distribution between the workpiece to be rolled and the work roll is used, which are obtained by this calculation, the bend deformation and the flattening deformation of the backup rolls 24, 36 and the work rolls 28, 32 are calculated including a difference between the work and the drive side. At the same time, the deformation of the housing and the reduction system is calculated as a function of the roll forces of the backup rolls 24, 36, so that the strip thickness distribution at the present time is calculated (step S108). At this time, concerning the deformation characteristic of the housing and reduction system, it is preferable to use the deformation characteristic obtained by the method shown in FIG. 16.

From the strip thickness distribution which is previously determined as a target of the rolling operation and also from the estimated values of the actual result of the strip thickness distribution at the present time which has been calculated in the above manner, a increments of the roll positioning devices to accomplish the above target value is calculated (step S110). According to this target value, the roll forces control is executed (step S112).

When the above method is adopted, asymmetry of the strip thickness distribution which occurs right below the roll bite can be accurately determined without causing any delay of time. Therefore, this method can provide a great effect to stabilize the threading of a leading end and a trailing end of a steel strip in the process of finish-rolling of a hot strip mill for which a quick and appropriate roll forces control is required. In this connection, it is effective that the above information obtained from the single body of the rolling mill is combined with the information obtained from a detection device arranged on the entry side and the delivery side of the rolling mill such as a (lateral) traveling sensor and a looper load cell. Further, in the case of tandem rolling, it is effective that the above information obtained from the single body of the rolling mill is combined with the information obtained from other rolling mills arranged on the upstream side and the downstream side.

In FIG. 18, the pair-cross type rolling mill is an object, and a control method in which consideration is given to a thrust force acting between the work rolls 28, 32 and the workpiece to be rolled is shown. However, in the case of a common four rolling mill which is not a pair-cross type rolling mill, a thrust force acting between the work roll and the workpiece to be rolled is negligibly small as explained before. Therefore, it is possible to conduct the same control as that shown in FIG. 18 even when information of one of the top and the bottom roll system is obtained. When the measured values of both the top and the bottom roll system can be utilized, the number of unknowns can be decreased by one. Accordingly, when the least square solution is found by utilizing the equation of equilibrium condition of the force in the axial direction of the roll and the equation of equilibrium condition of the moment, it becomes possible to find a more accurate solution.

Figure 19:
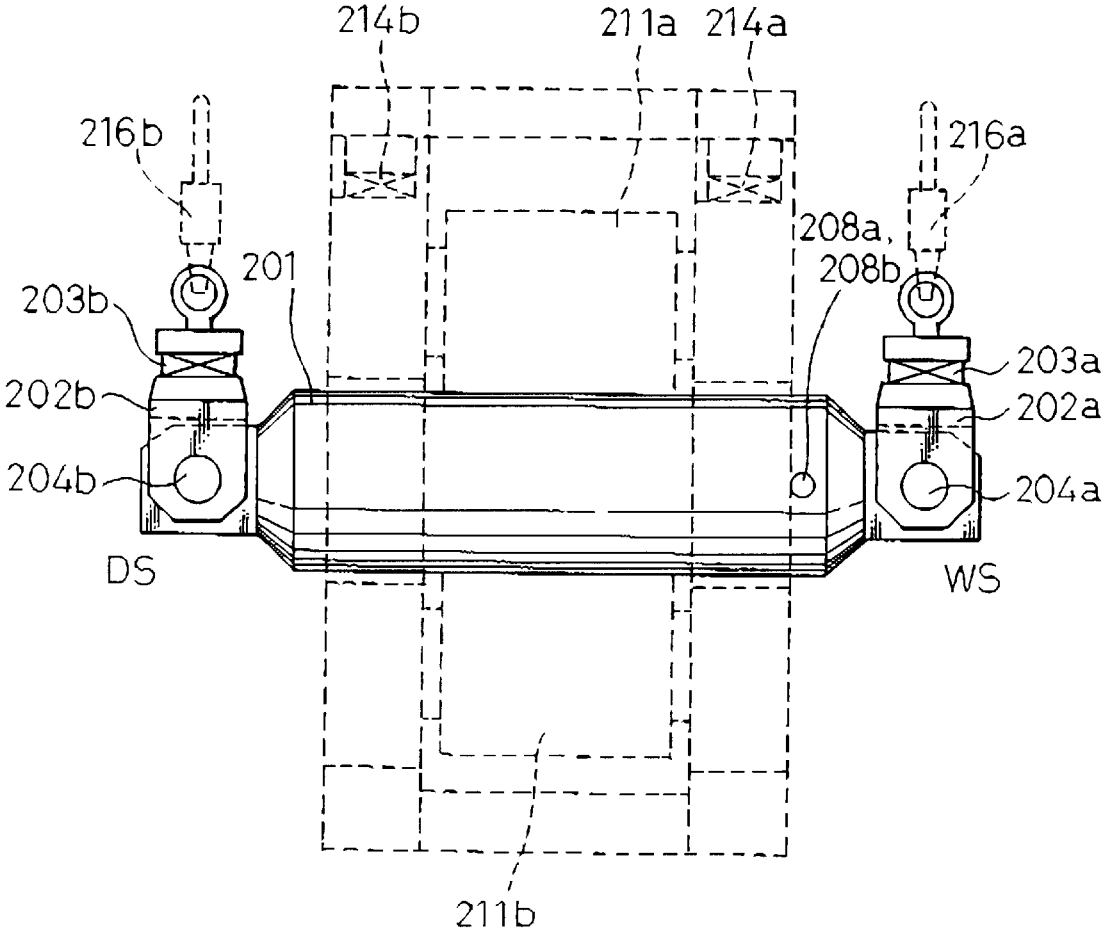
FIG. 19 is a front view showing an outline of a calibration device of a strip rolling mill of an embodiment of the present invention.
Figure 20:
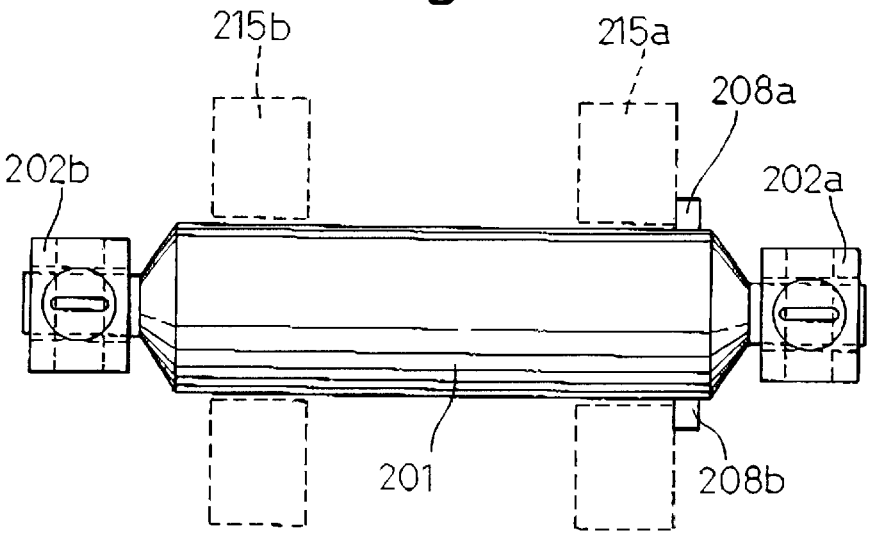
FIG. 20 is a plan view of the calibration device of a strip rolling mill shown in FIG. 1.

Referring to FIGS. 19 and 20, a strip rolling mill calibration device of a preferred embodiment of the present invention will be explained below. The strip rolling mill calibration device includes: a calibration device body 201; vertical external force transmitting members 202*a*, 202*b* for receiving an external force given in the vertical direction; and load cells 203*a*, 203*b* for measuring the external force given in the vertical direction. A size in the vertical direction of the calibration device body is approximately the same as the total size of the top and the bottom work roll (not shown in FIGS. 19 and 20) of the rolling mill. Accordingly, after the top and the bottom work roll have been removed from the rolling mill, the calibration device body can be incorporated into the rolling mill as shown in FIGS. 19 and 20.

In the example shown in FIGS. 19 and 20, the vertical direction external force transmitting members 202*a*, 202*b* are rotated round the pivots 204*a*, 204*b* so that they can not interfere with other components when the calibration device is incorporated in the rolling mill. Therefore, the height of the overall calibration device can be decreased when the calibration device is incorporated into the rolling mill. When these pivots 204*a*, 204*b* are arranged in this way, it is possible to prevent the vertical direction external force transmission members 202*a*, 202*b* from transmitting moment to the calibration device body 1. Therefore, it is preferable to arrange these pivots 204*a*, 204*b*.

On work side WS of the calibration device body 201, there are provided calibration device positioning members 208*a*, 208*b* which are protruding from the calibration device body 201. When the calibration device body 201 is incorporated into the rolling mill from work side WS, these calibration device positioning members 208*a*, 208*b* come into contact with the housing post, so that the calibration device body 201 can be positioned in the axial direction of the roll. However, after the calibration device has been once positioned, loads should not be given to the calibration device positioning members 208*a*, 208*b*. For example, after the calibration device body 201 has been incorporated into the rolling mill, it is preferable that the calibration device positioning members 208*a*, 208*b* can be moved onto work side WS or retracted into the calibration device body 201.

In this case, a cross-membersal configuration of the calibration device body 201 is not shown in the drawing. However, in principle, this calibration device is used when the rolling mill is stopped. Therefore, unlike the work roll, it is unnecessary that the cross-members of the calibration device body 201 is formed into a circle. That is, the cross-members of the calibration device body 201 should be concave rather than circular in order to decrease Hertz stress acting between the calibration device body 201 and the backup roll 212*a*, 212*b*. In other words, it is practical that a portion of the calibration device body 201 in contact with the backup roll is formed into a concave configuration.

An external force in the vertical direction, the intensity of which is known, can be given to the rolling mill as follows. As shown by broken lines in FIGS. 19 and 20, a force in the upward direction is given via the vertical direction external force transmitting members 202*a*, 202*b*, for example, by an overhead crane, and an intensity of this force is measured by the load cells 203*a*, 203*b* for measuring the external force in the vertical direction. In this way, the rolling mill can be given the external force in the vertical direction, the intensity of which is already known.

Figure 21:
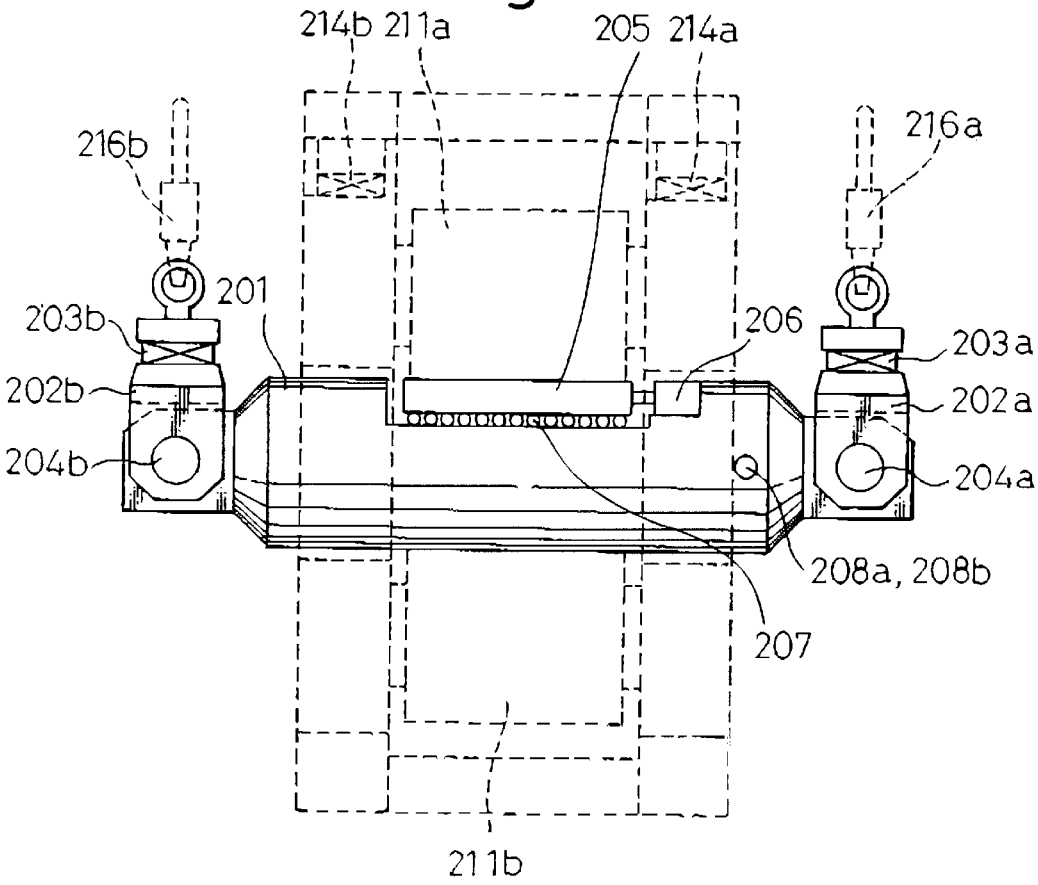
FIG. 21 is a front view showing an outline of a calibration device of a strip rolling mill of still another embodiment of the present invention.
Figure 22:
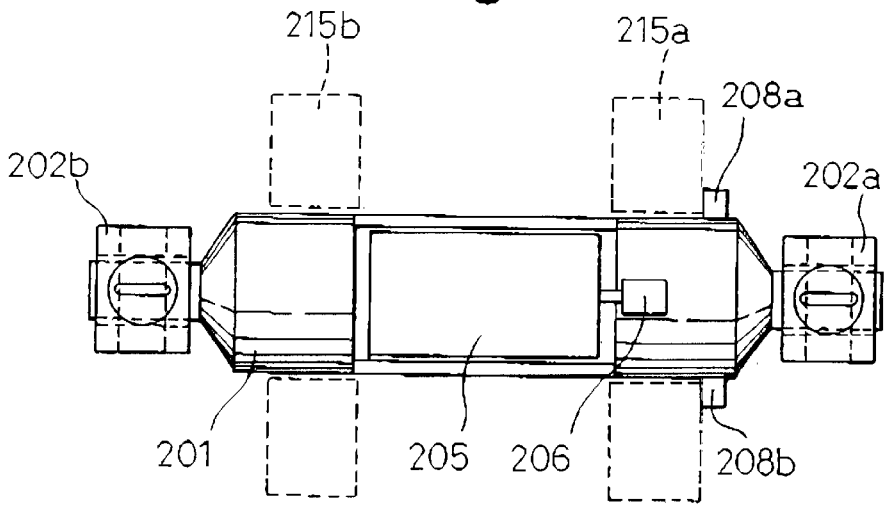
FIG. 22 is a plan view of the calibration device of a strip rolling mill shown in FIG. 21.

Referring to FIGS. 21 and 22, still another embodiment of the strip rolling mill calibration device of the present invention will be explained below.

The strip rolling mill shown in FIGS. 21 and 22 is composed in such a manner that a slide member 205 is provided in a portion in contact with the top backup roll 212*a* in addition to the structure of the rolling mill shown in FIGS. 19 and 20. The slide member 205 is slidably attached to the calibration device body 201 via the slide bearing 207 so that it can freely slide in the axial direction of the calibration device body 201. A position of the slide member 205 is controlled by the slide member position control unit 206.

While the calibration device is being incorporated into the rolling mill or while a load is being given by the roll positioning devices or the external device of the rolling mill in the vertical direction, this slide member position control device 206 fixes a relative position of the sliding member with respect to the calibration device body 201, and after the load in the vertical direction has been given, the thrust force given to the slide member is released. The above can be easily accomplished by a hydraulic drive system. When the calibration device is composed as described above, a thrust force generated by a frictional force acting between the calibration device and the backup roll can be released under the condition that the calibration device is incorporated into the rolling mill. Therefore, the load given to the rolling mill can be accurately determined.

In this connection, in the example shown in FIGS. 21 and 22, the slide member is provided only on the upper side, however, the slide member may be provided on the lower side. However, in the case of the calibration device of this embodiment, after the calibration device has been incorporated into the rolling mill, the calibration device positioning members 208*a*, 208*b* are preferably moved and retracted. In the above case, only the frictional forces acting on the contact faces with the top and the bottom backup roll are thrust forces acting on the calibration device. Therefore, when a slide member is provided in one of the top and the bottom roll so as to release the thrust force, another thrust force, which is roll forces, becomes zero. For the above reasons, it not indispensable to provide the slide member in both the upper and the lower calibration device. When the slide member is provided in one of the upper and the lower calibration device, it is preferable that the slide member is provided on the upper side like the example shown in FIGS. 21 and 22 from the viewpoint of enhancing the stability of the calibration device body 201.

Figure 23:
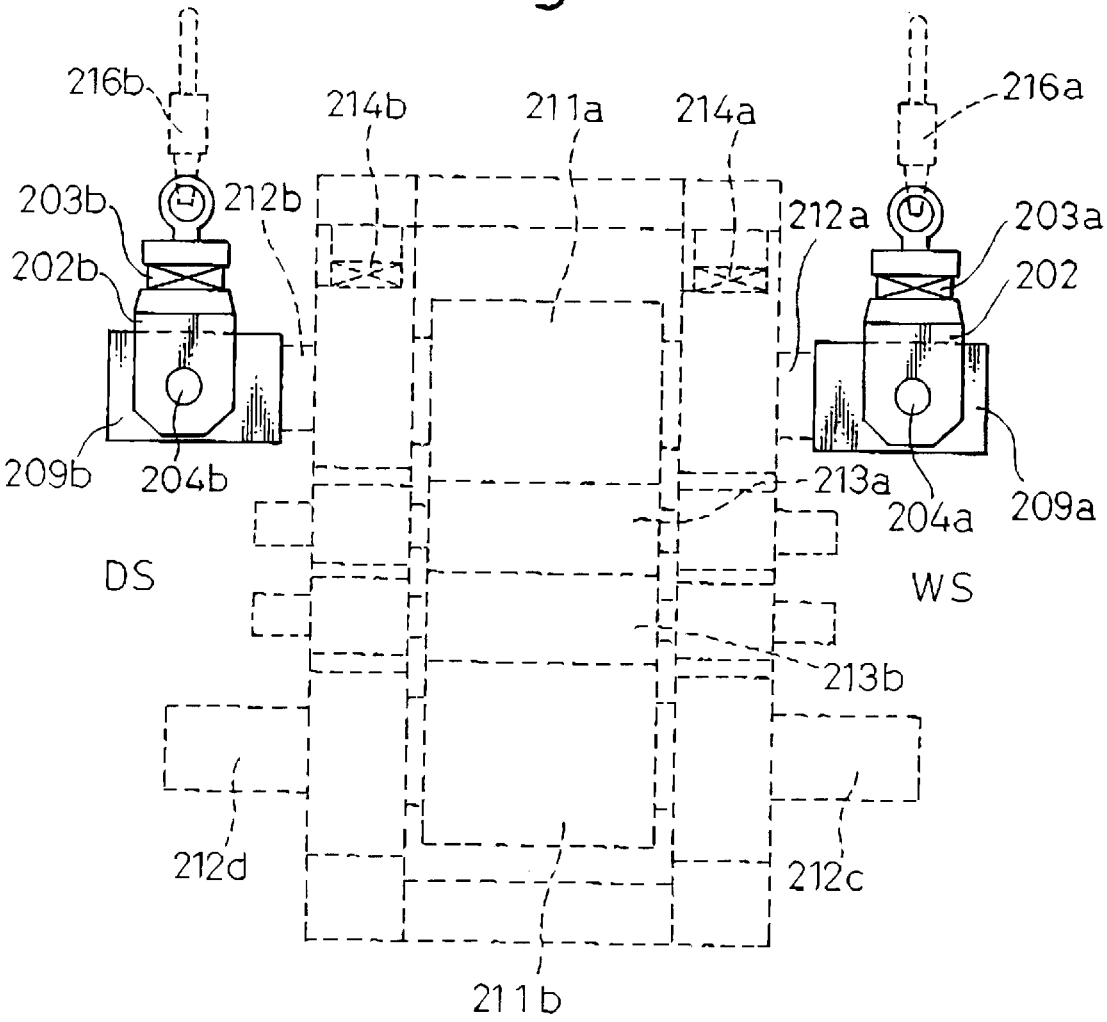
FIG. 23 is a front view showing an outline of a calibration device of a strip rolling mill of still another embodiment of the present invention.

Referring to FIG. 23, a strip rolling mill calibration device of still another embodiment of the present invention will be explained below.

The calibration devices 209*a*, 209*b* are attached to the neck portions 212*a*, 212*b* protruding outside from the roll chocks of the top backup roll 211*a*. An external force given from the outside to the rolling mill is transmitted to the backup roll necks 212*a*, 212*b* by the vertical direction external force transmission members 202*a*, 202*b*. Also in this example, there are provided pivots 204*a*, 204*b* between the calibration device bodies 209*a*, 209*b*, which are attached to the roll end portions, and the vertical direction external force transmitting members 202*a*, 202*b*. Due to the above structure, no moment is directly transmitted between them.

For example, when a force in the upper direction is given by an overhead crane (not shown) to the calibration devices 209*a*, 209*b* attached to the backup roll necks 212*a*, 212*b* so as to measure an intensity of the force by the load cells 203*a*, 203*b* for measuring the external force in the vertical direction, it becomes possible to give an external force in the vertical direction, the intensity of which is already known, to the rolling mill.

FIG. 23 shows an example in which a pair of calibration devices are arranged on work WS and drive DS side. However, from the viewpoint of giving a load which is asymmetrical with respect to the upper and lower sides, one of the calibration devices may be arranged on work WS or drive DS side. It is possible to attach the calibration devices 209*a*, 209*b* not to the backup roll necks but the backup roll chocks.

The calibration work can be conducted more simply by this calibration device when the rolling mill is stopped than when the rolling mill is operated. However, in order to determine the deformation characteristic of the roll bearing members in the process of rolling, bearings may be arranged in the calibration devices 209*a*, 209*b*. In general, this calibration device may be attached to the rolling mill only when the calibration work is carried out. However, even if the calibration devices are attached to the backup roll chocks or the backup roll necks, when the bearings are arranged inside, the calibration devices can be attached to the rolling mill at all times.

In the example shown in FIG. 21, an external force is given from the outside of the rolling mill to the top backup roll. However, the present invention is not limited to the above specific example, but an external force may be given from the outside of the rolling mill to the bottom backup roll, and further an external force may be given to one of the top and the bottom work roll.

In the examples explained above, the external force in the vertical direction is given by an overhead crane. However, the external force may be given by utilizing power of a roll changing carriage or by utilizing a hydraulic device specifically arranged on a floor foundation of a factory.

Figure 24:
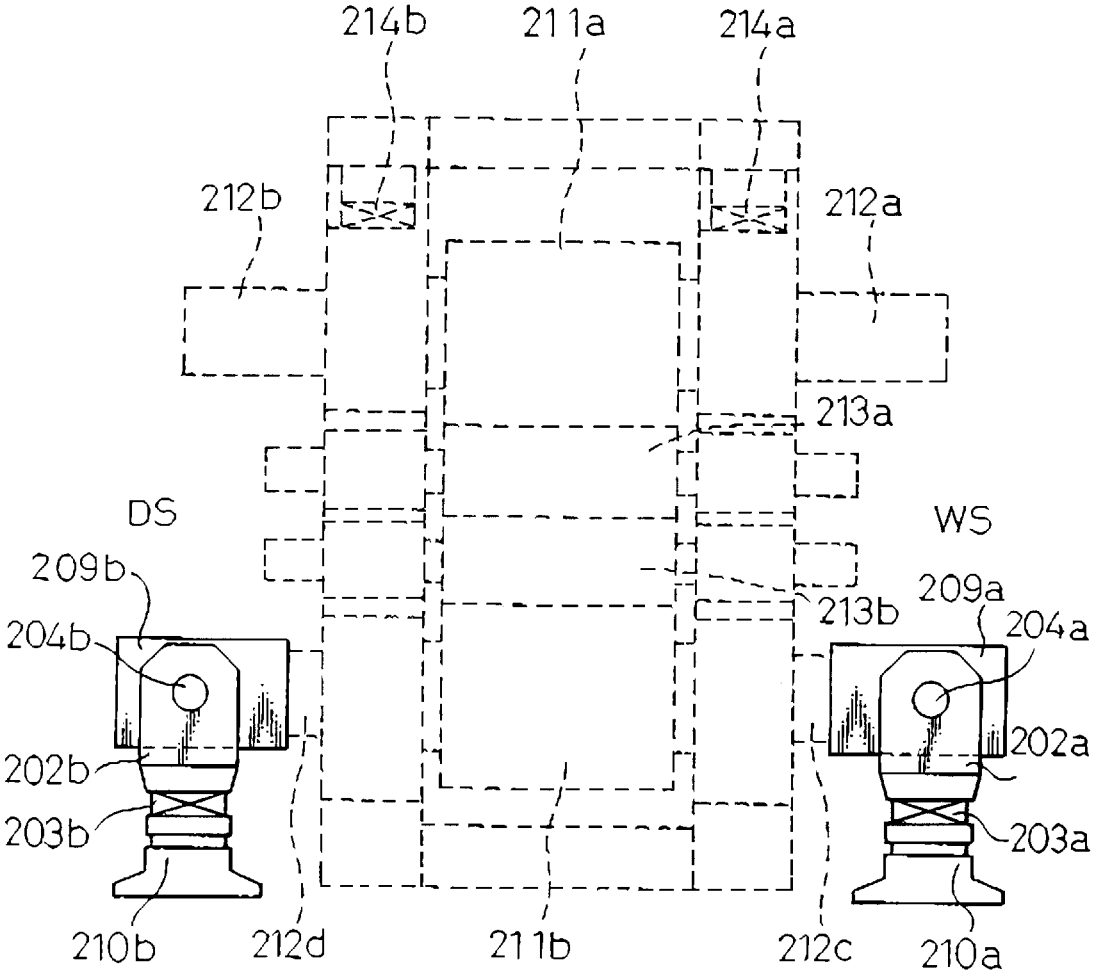
FIG. 24 is a front view showing an outline of a calibration device of a strip rolling mill of still another embodiment of the present invention.

Referring to FIG. 24, a strip rolling mill calibration device of still another embodiment of the present invention will be explained below.

In the example shown in FIG. 24, the calibration devices 209*a*, 209*b* are attached to the neck portions of the bottom backup roll. The vertical direction external force transmitting members 202*a*, 202*b* connected with the pivots 204*a*, 204*b* are given an external force in the vertical direction by the vertical direction external force loading actuators 210*a*, 210*b*. The vertical direction external force loading actuators 210*a*, 210*b* are fixed to the foundation on the floor in the vertical direction. Therefore, external forces in the vertical direction can be given by the vertical direction external force loading actuators 210*a*, 210*b* to the vertical direction external force transmitting members 202*a*, 202*b* via the load cells 203*a*, 203*b*.

When the vertical direction external force loading actuators 210*a*, 210*b* are of a hydraulic drive type, it is possible to make the apparatus compact, however, it is possible to adopt the vertical direction external force loading actuators of an electric drive type. In this type calibration device, it is necessary to remove the calibration devices 209*a*, 209*b* when the backup rolls are changed. In the example shown in FIG. 24, the calibration devices 209*a*, 209*b* including the vertical direction external force loading actuators 210*a*, 210*b* are slid in both the axial direction of the roll and the rolling direction, so that they can be detached from the backup roll necks 212*c*, 212*d*.

When the above Strip rolling mill calibration device is used, an external force, the intensity of which is known, can be given to the rolling mill. In this connection, even in the example in which an external force is given from the floor foundation as shown in FIG. 24, the external force may be given to not only the bottom backup roll but also the top backup roll or one of the top and the bottom work roll.

Figure 25:
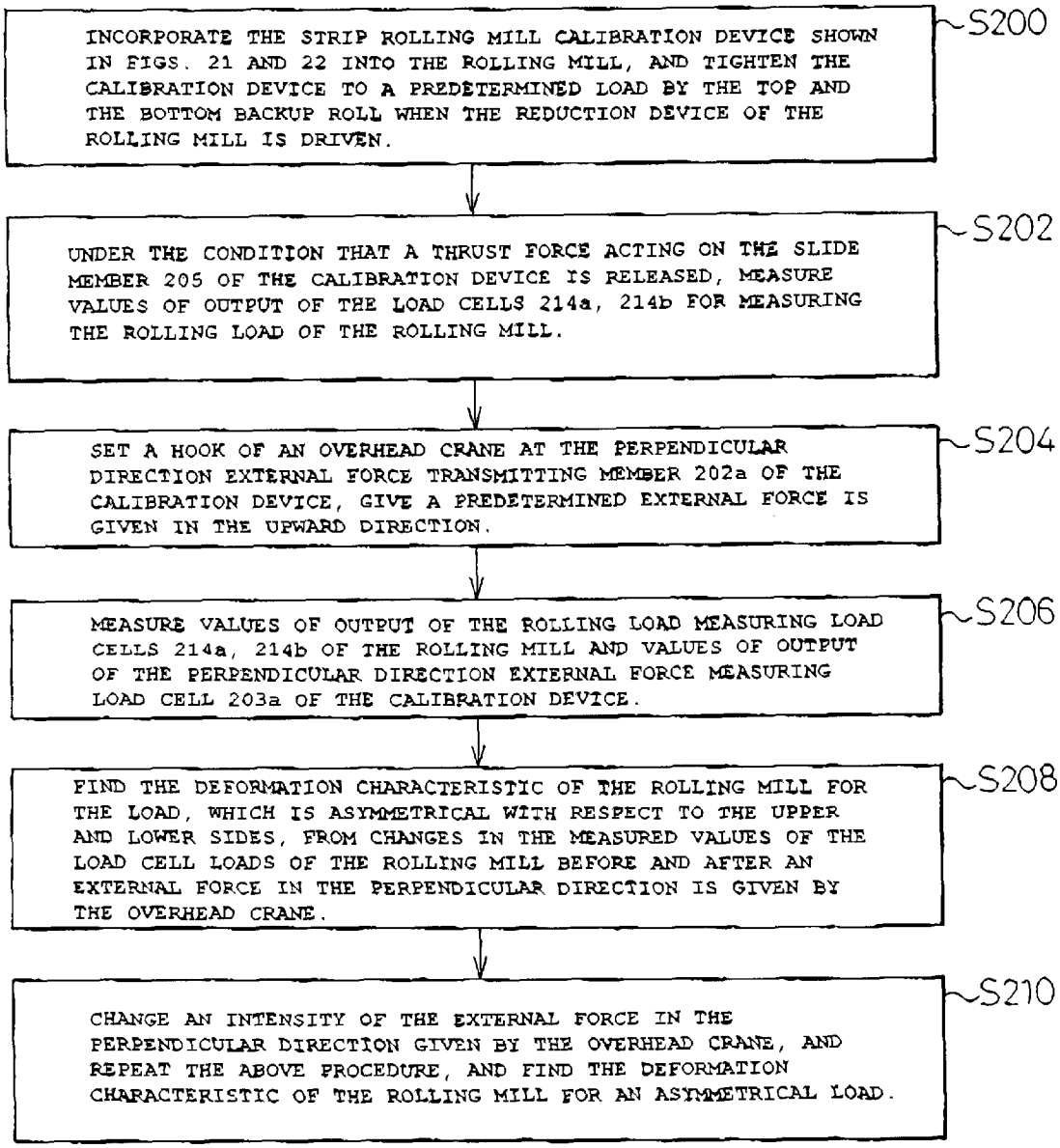
FIG. 25 is a flow chart showing a method of calibration of a strip rolling mill in which the device of calibration of a rolling mill shown in FIGS. 21 and 22 is used.

Next, referring to FIG. 25, a preferred embodiment of a method of calibration of a strip rolling mill of the present invention, in which the strip rolling mill calibration device shown in FIGS. 21 and 22 is used, will be explained below.

First, the strip rolling mill calibration device shown in FIGS. 21 and 22 is incorporated into a four rolling mill from which the top and the bottom work roll are removed (step S200). At this time, the slide member 205 is fixed at a position in the axial direction of the roll, and the calibration device 209 is tightened by the top 211*a* and the bottom backup roll 211*b* when the roll positioning devices 1 is driven. In this way, the calibration device 209 is given a load in the vertical direction. The roll positioning devices 1 is controlled while an intensity of the load in the vertical direction is being measured by the load cells 214*a*, 214*b* used for measuring the rolling load so that the intensity of the load in the vertical direction can become a predetermined value.

Next, the slide member position control device 206 of the calibration device, which has been set at the position fixing mode until now, is released, so that a thrust force acting on the slide member 205 is substantially made to be zero. Under the above condition, values of output of the load cells 214*a*, 214*b* for measuring the rolling load of the rolling mill are measured (step S202). Next, a hook 216*a* of an overhead crane is set at the vertical direction external force transmitting member 202*a* of the calibration device. While the load is being monitored by the vertical is direction external force measuring load cell 203*a*, the overhead crane is operated, so that a predetermined external force is given in the upward direction (step S204). Under the above condition, values of output of the rolling load measuring load cells 214*a*, 214*b* of the rolling mill and values of output of the vertical direction external force measuring load cell 203*a* of the calibration device are measured (step S206).

As described above, from changes in the measured values of the load cell loads 214*a*, 214*b* of the rolling mill before and after a load, the intensity of which is already known, is given by the overhead crane, the deformation characteristic of the rolling mill for the load, which is asymmetrical with respect to the upper and lower sides, is found (step S208). A specific example of this method of calculation will be further explained as follows.

First, under the condition that no external load in the vertical direction is given to the calibration device, load distributions acting on the calibration device and the backup roll become symmetrical with respect to the upper and lower sides from the equilibrium condition of the force in the vertical direction of the overall calibration device and also from the equilibrium condition of the moment. Actually, the load on the lower side is heavier than the load on the upper side by the weight of the calibration device itself. However, in this case, the important thing is a difference between the rolling mill deformation when an external force in the vertical direction is given from the outside of the rolling mill and the rolling mill deformation when no external force in the vertical direction is given from the outside of the rolling mill. Since no changes are caused between them with respect to the weight of the calibration device. Therefore, it is possible to conduct calculation while the weight of the calibration device is neglected. For the same reasons, when a load acting between the bottom backup roll chock and the rolling mill housing is considered, it is unnecessary to give consideration to the weight of the bottom backup roll.

Accordingly, in the rolling mill having no load cells on the lower side shown in FIGS. 21 and 22, a load in the vertical direction given to the chocks of the bottom backup roll 211*b* on work WS and drive DS side can be calculated by the equations of equilibrium condition of the force in the vertical direction and the moment of a thing in which the top backup roll 211*a*, the calibration device 201 and the bottom backup roll 211*b* are totaled. This state becomes a reference state. A distribution in the axial direction of the roll in this reference state of the load in the vertical direction acting on the contact portion of the calibration device with the top and the bottom backup roll can be accurately calculated including an asymmetrical component between work WS and drive DS side by the equations of equilibrium condition of the force and moment of the top and the bottom backup roll.

Next, in the case where an external force, the intensity of which is already known, is given to the vertical direction external force transmitting member of the calibration device, a state of balance of the load given to the rolling mill in the vertical and the traverse direction is different from the reference state described above. In this case, a force acting between the bottom backup roll chock and the rolling mill housing is calculated by the equations of equilibrium condition of the force in the vertical direction and the moment of a thing in which the top backup roll 211*a*, the calibration device 201 and the bottom backup roll 211*b* are totaled. This is different from the above reference state at the point in which not only the force given by the top and the bottom backup roll chock but also the external force in the upward direction given to the vertical direction external force transmitting member 202*a* is considered.

The unknown numbers in the above forces are two forces acting on the bottom backup roll chock. Therefore, when the two equations of equilibrium condition of the force and moment described above are solved, the above unknown numbers can be immediately found. Next, the load distributions in the vertical direction acting between the top backup roll 211*a* and the calibration device 201 and also between the bottom backup roll 211*b* and the calibration device 201 are respectively found by solving the equations of equilibrium condition of the force and moment acting on the top and the bottom backup roll. The bend of the top and the bottom backup roll and the flattening deformation at the contact portions of the top and the bottom backup roll with the calibration device are calculated from the above load distributions and the forces acting on the backup roll chocks. From the condition in which this quantity of deformation and the quantity of deformation of the rolling mill housing and the reduction system are fitted, it is possible to find a change in the quantity of deformation of the housing and the reduction system.

However, in this case, the flattening deformation characteristic at the contact members of the backup roll with the calibration device is required. This flattening deformation characteristic is previously found as follows. The calibration device is previously incorporated into the rolling mill, and the roll positioning devices is operated under the condition that no external force is acting, and tightening is conducted by the roll positioning devices at various loads including an asymmetrical load acting between work WS and drive DS side. In this way, the flattening deformation characteristic is found with respect to the roll forces and the output of the load cell for measuring the rolling load. When a quantity of deformation of the rolling mill housing and the reduction system is calculated for various external forces, it becomes possible to find the deformation characteristic of the rolling mill for the asymmetrical load with respect to the upper and lower sides (step S210).

In this connection, in the above embodiments, an external force in the upward direction is given by an overhead crane on only work WS side of the rolling mill so as to find the deformation characteristic of the rolling mill for the asymmetrical load with respect to the upper and lower side of the rolling mill. However, in order to give asymmetry in the reverse direction, it is preferable that an external force in the upward direction is also given to drive DS side via the vertical direction external force transmitting member 202*b* and the same procedure is taken. It is also preferable that an external force is simultaneously given to the vertical direction external force transmitting members 202*a* and 202*b*.

Figure 26:
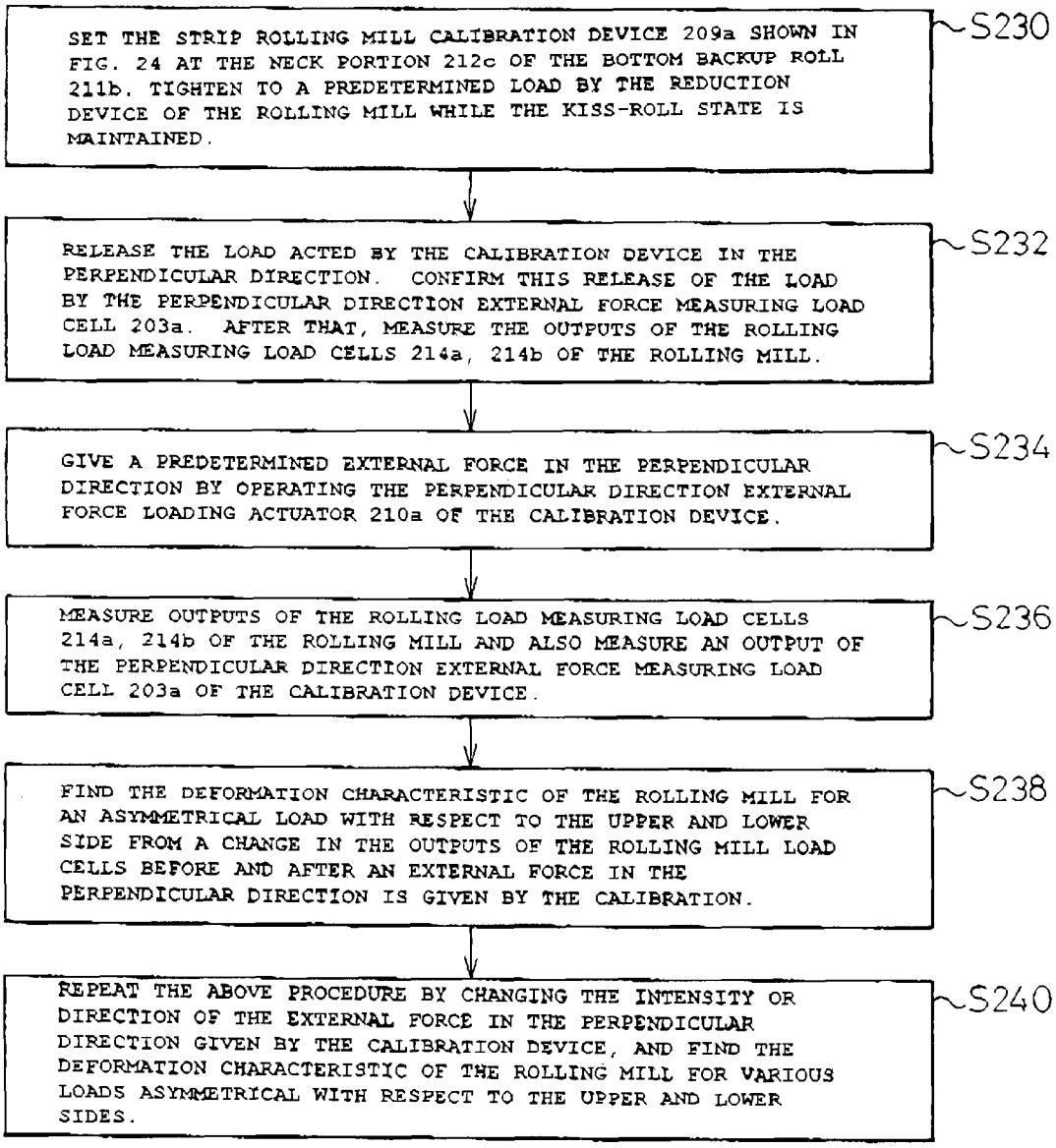
FIG. 26 is a flow chart showing a method of calibration of a strip rolling mill in which the device of calibration of a rolling mill shown in FIG. 24 is used.
Figure 27:
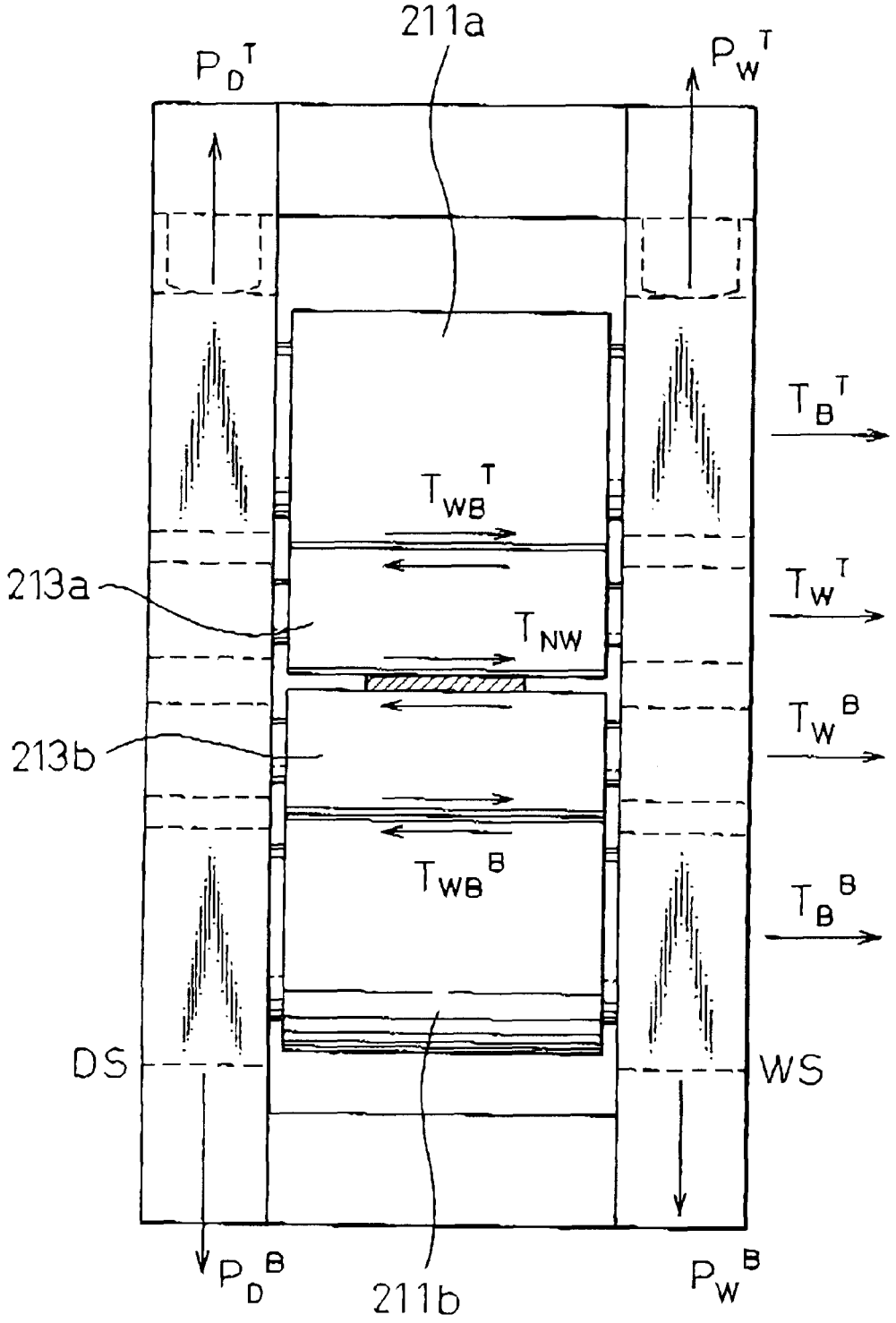
FIG. 27 is a schematic illustration showing a model of a thrust force acting between the rolls of a four rolling mill and also showing a force acting on the housings of the rolling mill.

Referring to FIG. 26, a preferred embodiment of the strip rolling mill calibration method conducted by the strip rolling mill calibration device shown in FIG. 24 will be explained below.

First, the strip rolling mill calibration device 209*a* shown in FIG. 24 is set at the neck portion 212*c* on the work side of the bottom backup roll 211*b* of a four rolling mill. Under the condition that the work rolls 13*a*, 13*b* and the backup rolls 11*a*, 11*b* are incorporated into the rolling mill, tightening is conducted to a predetermined load by the roll positioning devices of the rolling mill while the kiss-roll state is being maintained (step S230). Usually, the above tightening work is conducted so that a load in the vertical direction can not be given by the calibration device. If the load in the vertical direction is given by the roll positioning devices under the condition that a predetermined tightening load is acting, this load in the vertical direction is released. This release of the load is confirmed by the vertical direction external force measuring load cell 203*a*. After that, outputs of the rolling load measuring load cells 214*a*, 214*b* of the rolling mill are measured (step S232).

Next, the vertical direction external force loading actuator 210*a* of the calibration device is operated, so that a predetermined external force is given in the vertical direction (step S234). Under the above condition, outputs of the rolling load measuring load cells 214*a*, 214*b* of the rolling mill are measured, and also an output of the vertical direction external force measuring load cell 203*a* of the calibration device is measured (step S236).

As described above, from a change in the outputs of the rolling mill load cells 214*a*, 214*b* before and after an external force in the vertical direction, the intensity of which is already known, is given by the calibration device, the deformation characteristic of the rolling mill for an asymmetrical load with respect to the upper and lower side can be found (step S238). The specific calculation method is essentially the same as that of the embodiment shown in FIG. 7. Therefore, only the points different from the above embodiment will be additionally explained here.

First, a load acting between the bottom backup roll chock and the rolling mill roll housing in the reference state is calculated by the equation of equilibrium condition of the force in the vertical direction of a thing in which the top and the bottom backup roll and the top and the bottom work roll are totaled and also by the equation of equilibrium condition of the moment. Next, the load distribution acting on the barrel portion of each roll is calculated from the equation of equilibrium condition of the force in the vertical direction acting on each roll and also from the equation of equilibrium condition of the moment. When an external force different from the reference state is given, the calculation is essentially the same. Only the different point is that consideration is given to an external force in the vertical direction which is given to the bottom backup roll from the calibration device.

In this connection, the deformation characteristic for an asymmetrical load with respect to the upper and lower sides of the rolling mill is found by giving an external force in the vertical direction only on work side WS of the bottom backup roll. It is preferable that an external force in the vertical direction is given onto drive DS side of the bottom backup roll via the calibration device 209*b* and the same procedure is carried out. It is also preferable that the external force is simultaneously given to the vertical direction external force transmitting members 209*a*, 209*b*.

In this connection, an object of the strip rolling mill calibration method of the present invention is to find a deformation characteristic of a rolling mill when an asymmetrical load with respect to the upper and lower sides is given. It is possible to accurately calculate the deformation of the roll system for an asymmetrical load with respect to the upper and lower sides. Therefore, the calculation of the deformation of the roll system results in finding the deformation characteristic of the housing and the reduction system, of a rolling mill. From the above viewpoint, when the following method is adopted, the same object can be accomplished. For example, all the rolls including the backup rolls are removed from the rolling mill, and a calibration device, the configuration of which is the same as the configuration of all the rolls, is incorporated into the rolling mill. Then, an external force in the vertical direction, the intensity of which is already known, is given, and outputs of the rolling load measuring load cells are measured.

In the above embodiment, the rolling load measuring load cells of a rolling mill are arranged at the upper positions of the rolling mill. However, it should be noted that the present invention can be applied to a rolling mill in which the load cells are arranged at the lower positions, and further the present invention can be applied to a rolling mill in which the load cells are arranged at both the upper and the lower position. Especially, in the case of a rolling mill in which the load cells are arranged at the upper and the lower position, it is possible to directly measure the upper and the lower load given to the rolling mill housing. Accordingly, the deformation characteristic for an asymmetrical load with respect to the upper and lower sides of the rolling mill can be more accurately found. The thus found deformation characteristic can be easily utilized for the control conducted during the process of rolling and also it can be easily utilized for the setting calculation conducted before rolling.

Figure 28:
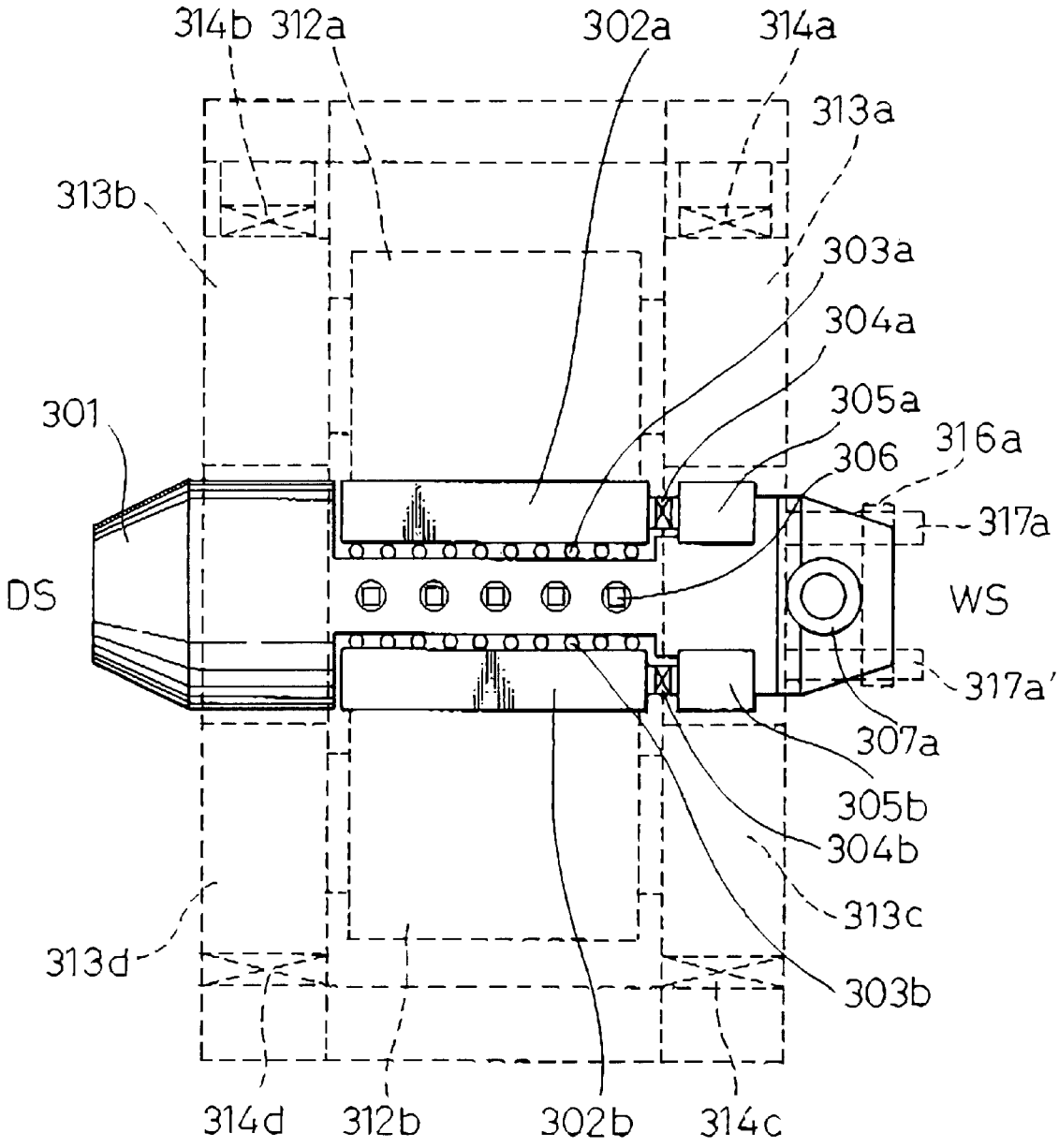
FIG. 28 is a front view showing a device of calibration of a rolling mill of still another embodiment.
Figure 29:
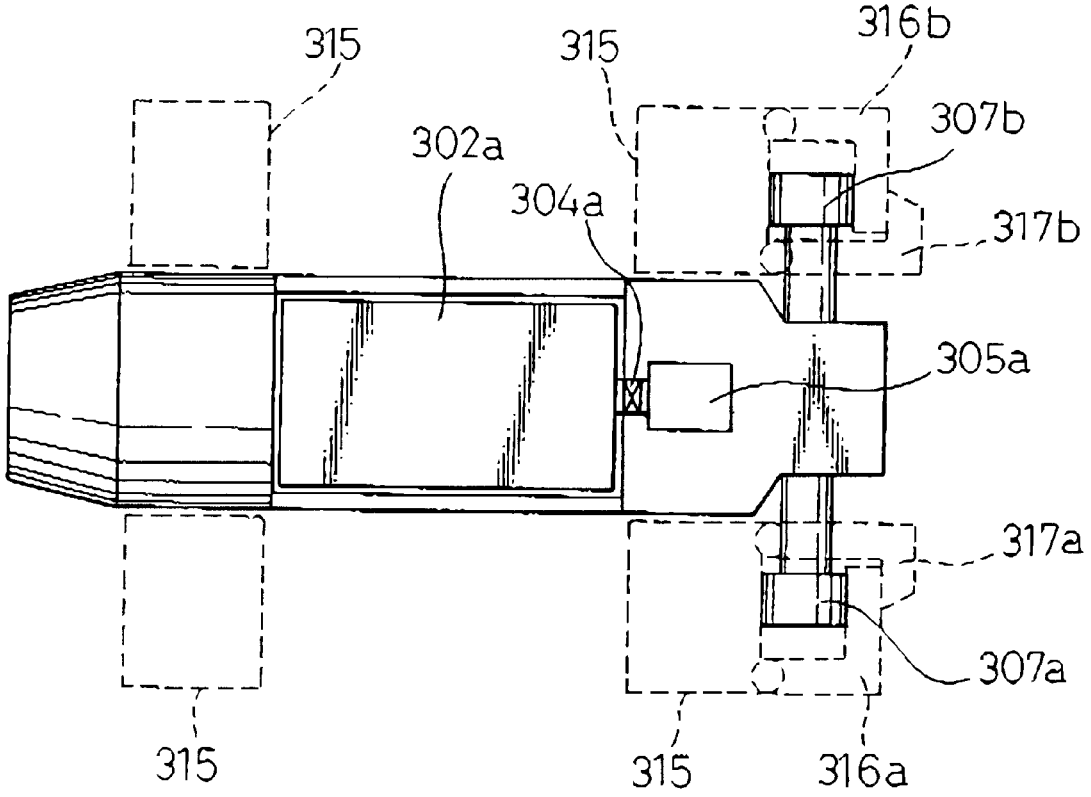
FIG. 29 is a plan view showing a device of calibration of a strip rolling mill in FIG. 28.

Referring to FIGS. 28 and 29, a strip rolling mill calibration device of still another embodiment of the present invention will be explained below.

The strip rolling mill calibration device shown in FIGS. 28 and 29 includes: a calibration device body 301; an upper 302*a* and a lower slide member 302*b* attached to the calibration device body 301 via slide bearings 303*a*, 303*b* so that the slide members can be freely moved in the axial direction of the roll; slide force loading actuators 305*a*, 305*b* which are connected with the slide members via load cells 304*a*, 304*b* and fixed to the calibration device body 301; a vertical direction load distribution measuring device 306 for measuring a vertical direction load given to the calibration device; and rolls 307*a*, 307*b* for supporting a resultant force of the thrust counterforces, which are provided on only work side WS.

Concerning the outside configuration of this strip rolling mill calibration device, its size in the vertical direction is approximately twice as large as the diameter of the work roll in the case of a four rolling mill which is an object of calibration. As shown by the broken lines in FIGS. 28 and 29, this calibration device can be given a tightening load, the intensity of which can be arbitrarily determined, via the top 312*a* and the bottom backup roll 312*b* of the rolling mill which is an object of calibration.

Under the condition that a load in the vertical direction is given between the top backup roll 312*a* and this calibration device and also between the bottom backup roll 312*b* and this calibration device, the actuators 305*a*, 305*b* give thrust forces, the intensities of which are arbitrarily determined, to the top 312*a* and the bottom backup roll 312*b*, and the load cells 304*a*, 304*b* measure the intensities of the thrust forces.

Cross-membersal configurations of the upper 302*a* and the lower slide member 302*b* are not shown in the drawing. However, in principle, this calibration device is used when the rolling mill is stopped. Therefore, unlike the work roll, it is unnecessary that the cross-members of the slide member is formed into a circle. That is, the cross-members of the slide member should be concave rather than circular in order to decrease Hertz stress acting between the slide member and the backup roll 312*a*, 312*b*. In other words, it is practical that a portion of the slide member in contact with the backup roll is formed into a concave configuration and that the slide bearing is formed into a flat shape so that the bearing can be easily arranged.

The actuators 305*a*, 305*b* for giving a thrust force may be of an electric motor drive type, however, it is preferable that the actuators 305*a*, 305*b* for giving a thrust force are of a hydraulic drive type in which hydraulic pressure is supplied from the outside of the calibration device, because the structure of the calibration device can be simplified and a strong thrust force can be easily obtained. It is preferable that the actuators 305*a*, 305*b* for giving a thrust force are operated as follows. When the calibration device is incorporated into the rolling mill or the calibration device is removed from the rolling mill, the actuators 305*a*, 305*b* for giving a thrust force are used for fixing the slide members 302*a*, 302*b*. After the calibration device has been incorporated into the rolling mill and a load in the vertical direction has been given by the backup roll as described before, the actuators 305*a*, 305*b* for giving a thrust force are used in the mode of giving a thrust force.

In the example shown in FIGS. 28 and 29, the slide members 302*a*, 302*b* for giving a thrust force are arranged in the upper and the lower portion of the calibration device body. However, even if only one of the upper slide member 302*a* and the lower slide member 302*b* is arranged, the fundamental function can be accomplished. However, in this case, thrust counterforces given to the slide member becomes substantially the same as the thrust force acting between the other backup roll and the calibration device body. In order to make both the forces to be strictly the same, the thrust reaction forces support members 307*a*, 307*b* may be omitted.

Further, it is possible to provide the following variation. A slide member similar to the slide members 302*a*, 302*b* is arranged only in one of the upper and the lower portion, and a thrust force, the intensity of which is already known, is acted between a thrust reaction forces support member, which is similar to the thrust reaction forces support members 307*a*, 307*b*, and a fixing member such as a rolling mill housing or a keeper strip. Even if the above structure is adopted, the substantially same function as that of the calibration device shown in FIGS. 28 and 29 can be obtained.

In the embodiment shown in FIGS. 28 and 29, there is provided a vertical direction load distribution measuring device 306 at the center of the calibration device body 301. The vertical direction load distribution measuring device 306 may be composed in such a manner that common load cells are arranged in the axial direction of the roll. However, from the viewpoint of mechanical structure, it is preferable to adopt the following structure.

As shown in FIGS. 28 and 29, a plurality of holes arranged in the axial direction of the roll are formed at the center of the calibration device body 301. A change in the size of each hole with respect to the upward and downward direction caused when a load in the vertical direction is given is measured by a compact displacement detector of high resolution such as a differential transformer. When the above structure is adopted, it is impossible to directly measure the load distribution in the vertical direction by a quantity of deformation of each hole. Therefore, it is necessary to previously conduct calibration as follows. Profiles of the backup rolls 312*a*, 312*b* or the upper 302*a* and the lower slide member 302*b* in the axial direction of the roll are previously changed, and tightening is conducted by the roll positioning devices while a difference is made between the roll forces on work side WS and that on drive side DS of the rolling mill. After the above preliminary experiment has been completed, load distributions between the backup roll 312*a* and the calibration device body and also between the backup roll 312*b* and the calibration device body are calculated from the measured values of the loads measured by the load cells 314*a* to 314*d* arranged on work side WS and drive side DS of the rolling mill. The thus obtained load distribution is made to correspond to the measured values of the quantities of changes in the sizes of the holes arranged in the axial direction of the roll. In this way, the calibration for measuring the vertical direction load distribution is executed.

In this connection, in the example shown in FIGS. 28 and 29, five measuring devices 306 described above are arranged in the axial direction of the roll. In order to find a difference between the load in the vertical direction on work side WS and the load in the vertical direction on drive side DS, it is necessary to arrange at least two measuring devices in the axial direction of the roll, and it is preferable that not less than five measuring devices are arranged in the axial direction of the roll.

In the embodiment shown in FIGS. 28 and 29, the vertical direction load distribution measuring device 306 is arranged at the center of the calibration device body 301. When the vertical direction load distribution acting between the top backup roll 312*a* and the calibration device is different from the vertical direction load distribution acting between the bottom backup roll 312*b* and the calibration device, the averaged load distribution is measured. As described later, it is actually necessary to measure the vertical direction load distribution with respect to the axial direction of the roll acting between the top backup roll 312*a* and the calibration device, and also it is actually necessary to measure the vertical direction load distribution with respect to the axial direction of the roll acting between the bottom backup roll 312*b* and the calibration device. In order to directly measure the above load distributions, the vertical direction load distribution measuring devices 306 can be arranged in the upper 302*a* and the lower slide member 302*b*. Further, the following arrangement may be adopted. The upper 302*a* and the lower slide member 302*b* are made as thin as possible, and the vertical direction load distribution measuring devices 306 are arranged at an upper position and a lower position of the calibration device body 301 which are located close to the slide bearings of the upper 302*a* and the lower slide member 302*b*.

In the embodiment shown in FIGS. 28 and 29, a resultant force of the thrust counterforces acting on the calibration device body 301 is supported by the housing post 315 of the rolling mill or the keeper strips 316*a*, 316*b* via the rolls 307*a*, 307*b* for supporting the resultant force which are located at the substantial middle point of the position in the vertical direction of the face on which the calibration device body comes into contact with the top 312*a* and the bottom backup roll 312*b*.

When a resultant force of the thrust counterforces is supported at this position, a new moment generated by the force acting on the resultant force support roll 307*a*, 307*b* can be reduced to the minimum, so that the calibration device 301 seldom receives the new moment. Therefore, the calibration method described later can be simply and highly accurately carried out.

Further, since the resultant force of the thrust counterforces is supported by the support member 307*a*, 307*b* of a roll type in the embodiment shown in FIGS. 28 and 29, a frictional force in the vertical direction acting between the support member and the housing post or the keeper strip of the rolling mill can be suppressed to the minimum. Therefore, it is possible to suppress a redundant moment generated in the calibration device to the minimum. Therefore, the rolling mill calibration method described later can be highly accurately carried out. In this connection, in the embodiment shown in FIGS. 28 and 29, one roll is arranged for each housing post, however, it is possible to arrange a plurality of rolls for housing post. However, in order to prevent the plurality of rolls from giving moment to the calibration device body 301, it is necessary to take a countermeasure such as inserting a pivot mechanism.

In the embodiment shown in FIGS. 28 and 29, the roll, which is a support member of the resultant force of the thrust counterforces, is arranged only on work side WS. Therefore, the calibration device can be easily incorporated into the rolling mill. Further, since the thrust force giving actuator is also arranged only on work side WS, the thrust force is balanced only on work side WS of the calibration device. Accordingly, inner stress caused by the thrust force and the thrust counterforces is not transmitted to the center and drive side DS of the calibration device, and it becomes possible to avoid the occurrence of a redundant deformation of the calibration device. This is advantageous for enhancing the measurement accuracy of the vertical direction load distribution measurement device described before.

Figure 30:
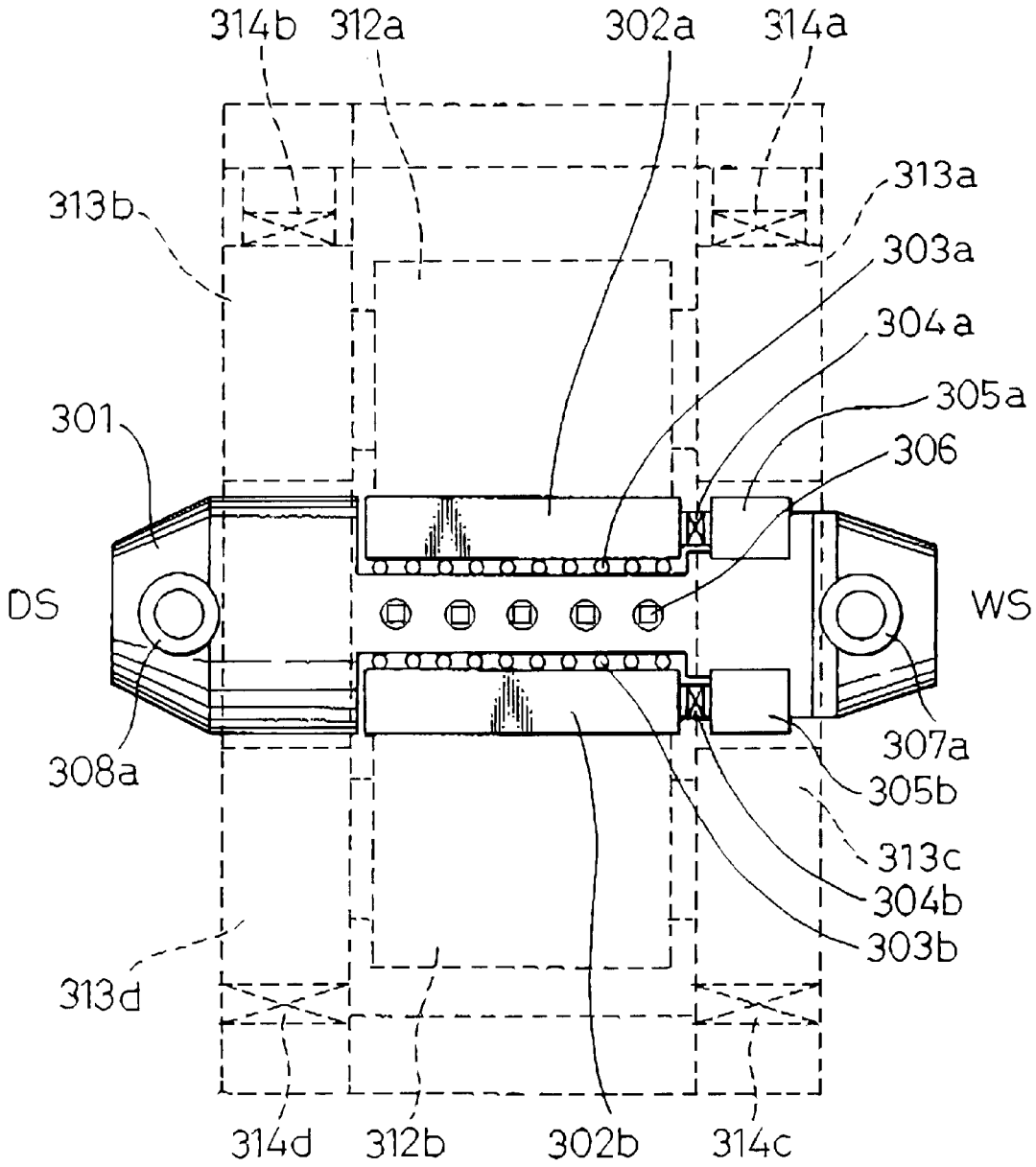
FIG. 30 is a front view showing a device of calibration of a strip rolling mill of still another embodiment.
Figure 31:
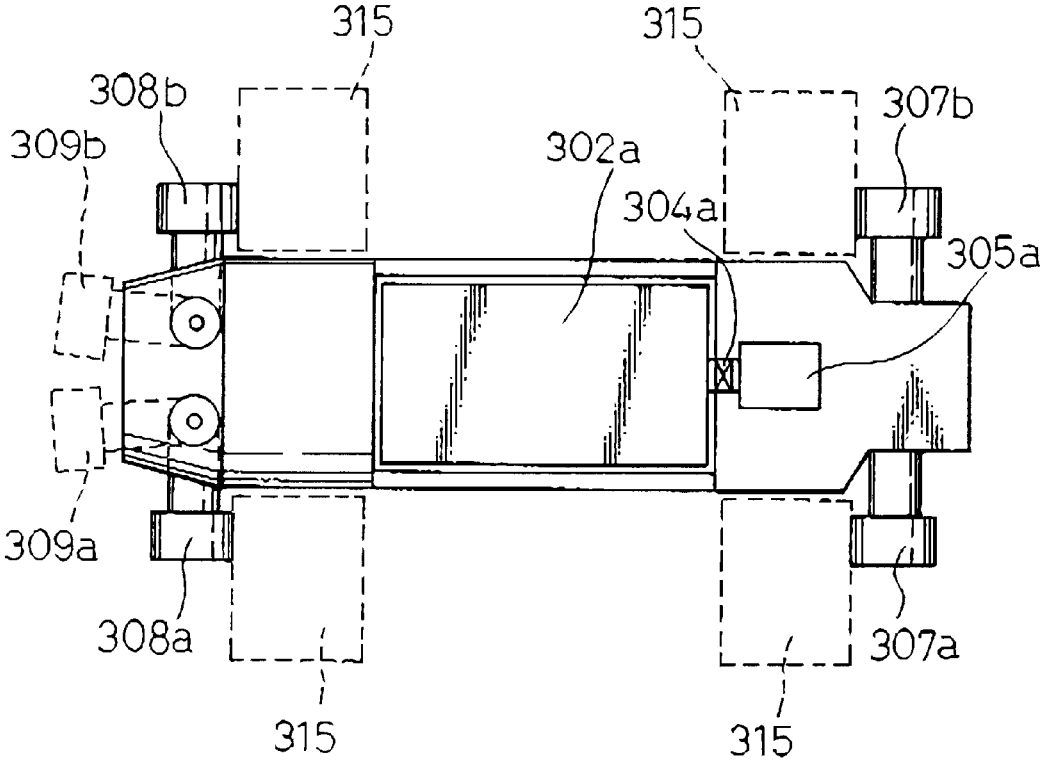
FIG. 31 is a plan view showing a device of calibration of a strip rolling mill in FIG. 30.

Referring to FIGS. 30 and 31, a calibration device of still another embodiment of the present invention will be explained below. In the example shown in FIGS. 30 and 31, there are provided rolls for supporting a resultant force of the thrust counterforces on both work side WS and drive side DS. The above structure is more advantageous than the structure of the embodiment shown in FIGS. 28 and 29 in such a manner that it becomes unnecessary to give consideration to the keeper strips 316*a*, 316*b* and the keeper strip fixing metal fittings 317*a*, 317*b*. On the other hand, in the embodiment shown in FIGS. 30 and 31, there is a possibility that the resultant force supporting rolls 308*a*, 308*b* on drive side DS interfere with the calibration device when the calibration device is incorporated into the rolling mill. In order to solve the above problems, for example, as shown by reference numerals 309*a*, 309*b* in FIGS. 30 and 31, it is necessary to accommodate the resultant force supporting rolls 308*a*, 308*b* on drive side DS. Further, when a force is acting between the resultant force support rolls 308*a*, 308*b* on drive side DS and the housing post 315, a thrust force in the calibration device is transmitted from the thrust force loading actuator to the resultant force supporting rolls 308*a*, 308*b* on drive DS side via the center of the calibration device body 301. Accordingly, compared with a case in which a force is acting between the resultant force supporting rolls 307*a*, 397*b* on work side WS and the housing post, a load given to the calibration device body 301 becomes different and also deformation of the calibration device body 301 becomes different, which could be a cause of deteriorating the measurement accuracy. Therefore, consideration must be given to this matter.

Figure 32:
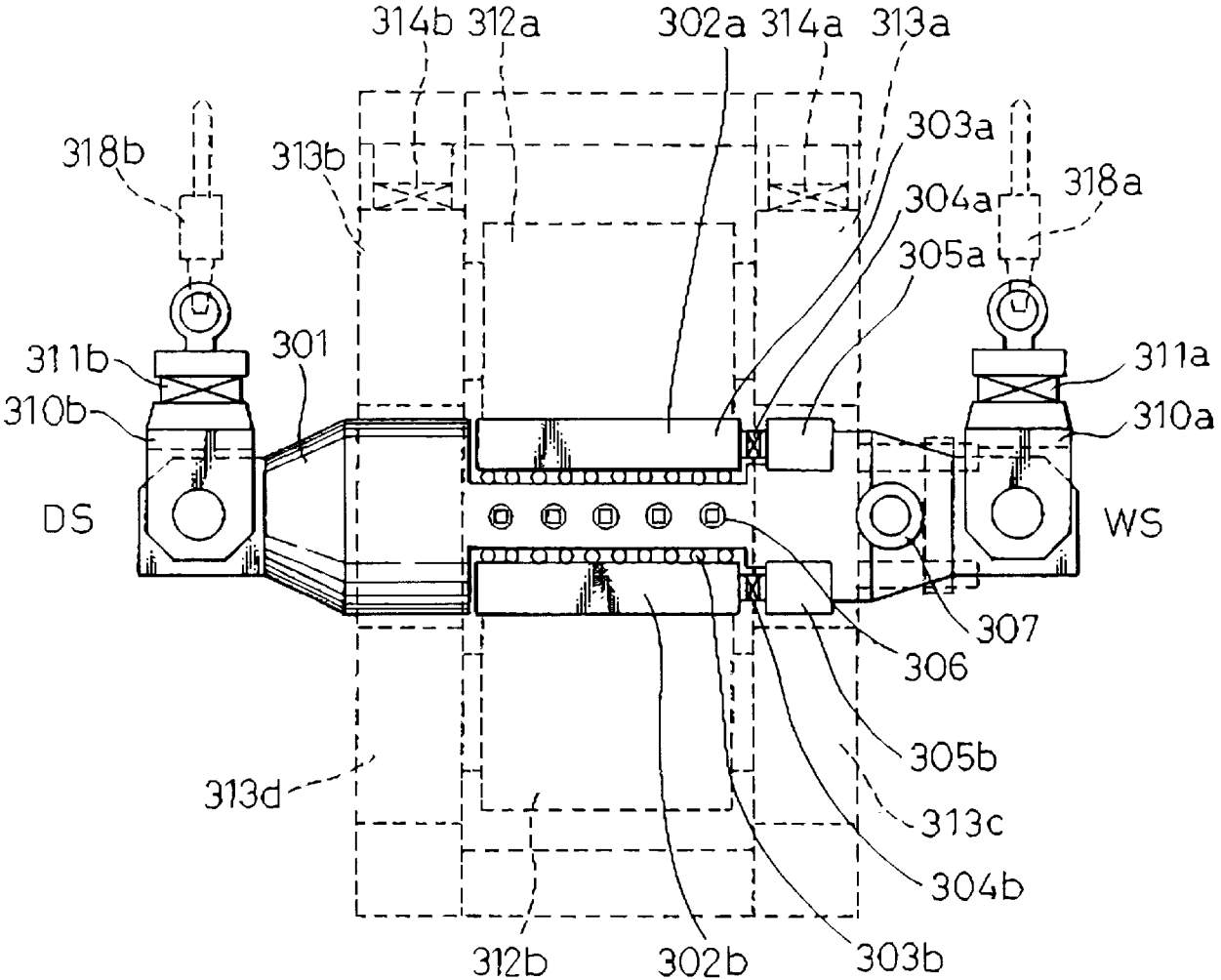
FIG. 32 is a plan view showing a device of calibration of a strip rolling mill of still another embodiment.
Figure 33:
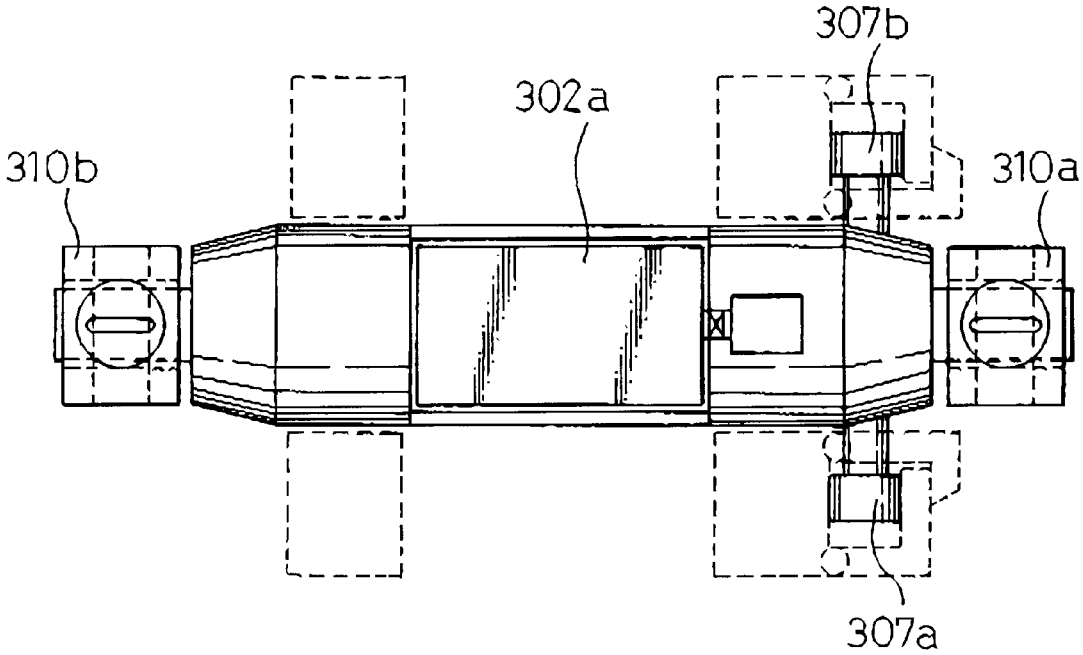
FIG. 33 is a plan view showing a device of calibration of a strip rolling mill in FIG. 32.

Referring to FIGS. 32 and 33, still another embodiment of the calibration device of the present invention will be explained below. In the embodiment shown in FIGS. 32 and 33, in addition to the embodiment shown in FIGS. 28 and 29, there are provided vertical direction external force transmitting members 310*a*, 310*b* through which a force in the vertical direction given from the outside can be received by both end portions of the calibration device body 301, and load cells 311*a*, 311*b* for measuring the external force in the vertical direction.

In the embodiment shown in FIGS. 32 and 33, in order to prevent the vertical direction external force transmitting members 310*a*, 310*b* from interfering with other members when the calibration device is incorporated into the rolling mill, the vertical direction external force transmitting members 310*a*, 310*b* can be rotated so that the height of the overall calibration device can be decreased. This rotating function of the vertical direction external force transmitting members is provided by the structure of pivots. It is preferable to provide the pivots as described above, because it is possible to avoid the vertical direction external force transmitting members 310*a*, 310*b* from transmitting moment to the calibration device body 301. As shown by the broken lines in FIGS. 32 and 33, a load in the vertical direction can be given to the calibration device by an overhead crane 18*a* or 18*b* via the above vertical direction external force transmitting members 310*a*, 310*b*. An intensity of the external force can be accurately measured by the load cell 311*a* or 311*b*.

When the external force in the vertical direction, which is completely independent from the rolling mill, is given to the calibration device, it becomes possible to give a load, which is asymmetrical with respect to the upper and lower sides, the intensity of which is already known, to the rolling mill. Therefore, when a load cell load of the rolling mill is measured and analyzed, it becomes possible to determine the deformation characteristic of the rolling mill for the asymmetrical load with respect to the upper and lower sides which is caused by the thrust force generated between the rolls in the process of rolling. In the calibration device shown in FIGS. 32 and 33, the vertical direction external force transmitting members 310*a*, 310*b* are arranged on both work side WS and drive side DS. However, the vertical direction external force transmitting member may be arranged only on work side WS or drive side DS.

In the embodiment shown in FIGS. 32 and 33, the external force is a tensile load given from the upside. However, it is possible to adopt the following structure. For example, when a pulley (not shown) is provided on a floor under the calibration device, it becomes possible to give a tensile load from the lower side by utilizing an overhead crane or a drive unit of a roll change carriage. Further, the following arrangement may be adopted. A specific external force loading device (not shown) for giving a force in the vertical direction to the calibration device is arranged, and this external force is received.

Figure 34:
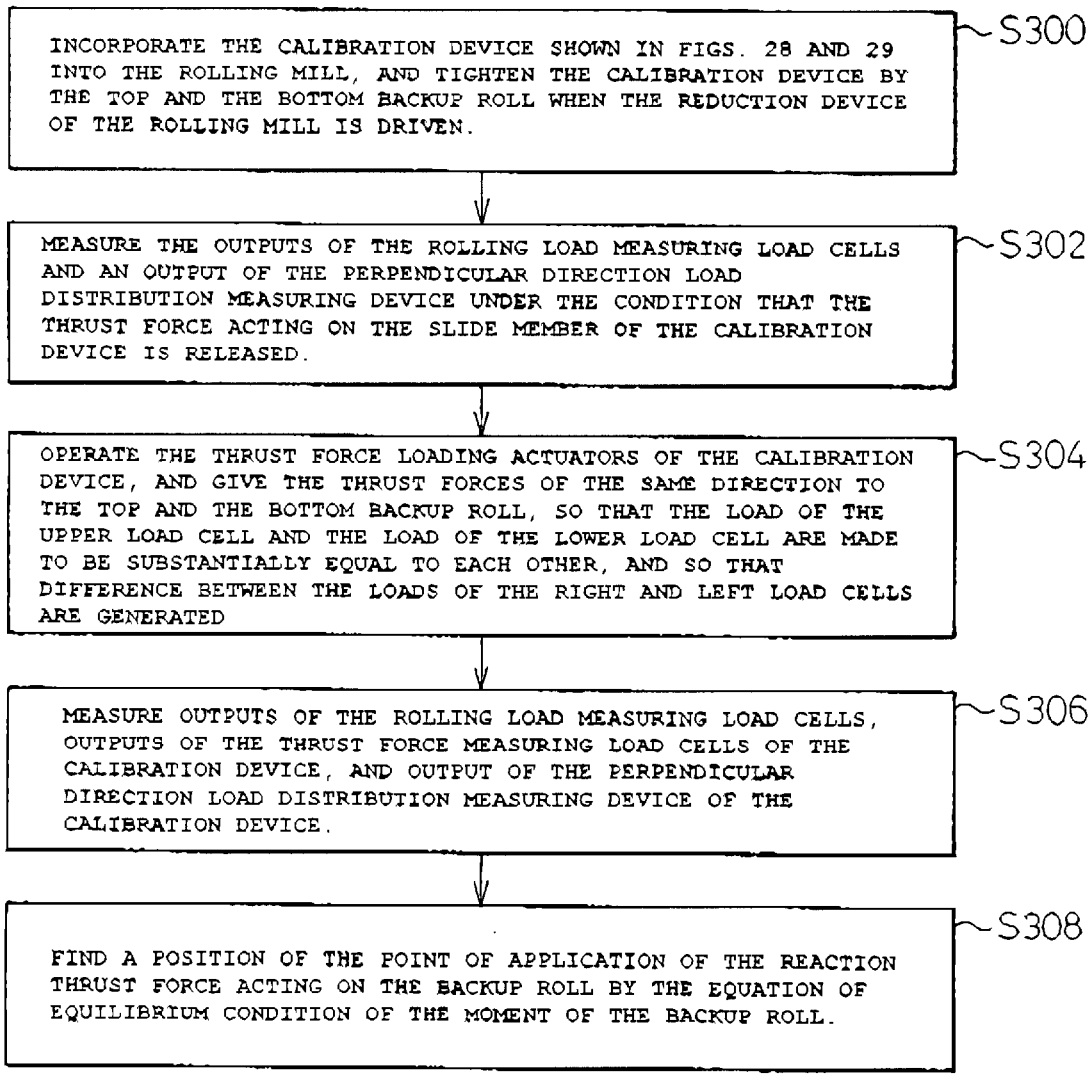
FIG. 34 is a view showing an algorithm of a preferred embodiment of a method by which a position of the point of application of thrust counterforces acting on the backup rolls is found by the method of calibration of a strip rolling mill of claim 24 of the present invention.

Referring to FIG. 34, a preferred embodiment of a method of calibration of a strip rolling mill of the present invention, in which the strip rolling mill calibration device shown in FIGS. 28 and 29 is used, will be explained below.

First, the strip rolling mill calibration device shown in FIGS. 28 and 29 is incorporated into a four rolling mill from which the top and the bottom backup roll have been removed (shown in step S300). At this time, the upper and lower slide members 302*a*, 302*b* are fixed at positions in the axial direction of the roll. In this case, under the condition that the keeper strips 316*a*, 316*b* on work side WS of the rolling mill and the keeper strip fixing metal fittings 317*a*, 317*b* are released, the calibration member is incorporated into the rolling mill. After the calibration member has been incorporated in the rolling mill, the keeper strips 316*a*, 316*b* and the keeper strip fixing metal fittings are returned to positions shown in FIGS. 28 and 29, and the calibration device is fixed in the axial direction of the roll.

At this time, in order to smoothly rotate the rolls 307*a*, 307*b* for supporting the resultant force of the thrust counterforces given to the calibration device, it is preferable that a clearance between the housing post of the rolling mill and the keeper strip is made to be a little larger than the diameter of the roll 307*a*, 307*b*. In order to accurately measure an intensity of the thrust force given to the calibration device, it is preferable that the characteristics of the upper 303*a* and the lower slide bearing 303*b* are determined as follows.

Immediately after the calibration device has been incorporated into the rolling mill, the keeper strips 316*a*, 316*b* are opened, and the calibration device is tightened by the backup rolls 312*a*, 312*b* when the roll positioning devices of the rolling mill is driven. Under the above condition, the upper and lower thrust force loading actuators 305*a*, 305*b* of the calibration device are operated, so that the slide members 302*a*, 302*b* are oscillated by the actuators in the axial direction of the roll. In this case, the slide members 302*a*, 302*b* are given a tightening load by the top 312*a* and the bottom backup roll 312*b* as described above. Therefore, frictional forces are generated on the contact faces of the top 312*a* and the bottom backup roll 312*b*. Due to the above frictional forces, the calibration body 301, which is not fixed in the axial direction of the roll, is oscillated in the axial direction. At this time, it is possible to find coefficients of friction, which is generated by the slide bearings 303*a*, 303*b*, by the loads measured by the load cells 304*a*, 304*b* for measuring the thrust force. It is preferable that this experiment is made when the tightening load given by the backup rolls is changed by several levels.

Next, under the condition that the calibration device is incorporated into the rolling mill, the calibration device is tightened to a predetermined tightening load by the top 312*a* and the bottom backup roll 312*b* when the roll positioning devices of the rolling mill is driven (step S300). The thrust force loading actuators 305*a*, 305*b* of the calibration device, which had been set into the position fixing mode, is set into the thrust force control mode, and the thrust force generated in the process of tightening conducted by the roll positioning devices is released, which is confirmed by the thrust force measuring load cells. Under the above condition, outputs of the rolling load measuring load cells 314*a*, 314*b*, 314*c*, 314*d* are measured, and also an output of the vertical direction load distribution measuring device 306 of the calibration device is measured (step S302).

Next, the thrust force loading actuators 305*a*, 305*b* of the calibration device are operated, and the thrust forces of the same direction are given to the top and the bottom backup roll, so that the load of the upper load cell and the load of the lower load cell are made to be substantially equal to each other, and the load of the right load cell and the load of the left load cell are made to be different from each other (step S304). Under the above condition, outputs of the rolling load measuring load cells 314*a*, 314*b*, 314*c*, 314*d* are measured, and also outputs of the thrust force measuring load cells 304*a*, 304*b* of the calibration device are measured, and also an output of the vertical direction load distribution measuring device 306 of the calibration device is measured (step S306).

Under the above condition, the intensity of the thrust counterforces generated from the upper thrust loading actuator is approximately the same as the intensity of the thrust counterforces generated from the lower thrust loading actuator, and further, the direction of the thrust counterforces generated from the upper thrust loading actuator is the same as the direction of the thrust counterforces generated from the lower thrust loading actuator. Accordingly, the thrust counterforces of the upper and the lower actuator are supported by the housing post 315 or the keeper strips 316*a*, 316*b* of the rolling mill via the resultant force supporting rolls 307*a*, 307*b* for supporting the thrust counterforces. However, due to the above structure of the calibration device shown in FIGS. 28 and 29, this thrust counterforces gives a very low intensity of moment to the calibration device. Accordingly, as long as a big difference is not caused between the thrust counterforces given to the upper slide member and the thrust counterforces given to the lower slide member, a load distribution measured by the vertical direction load distribution measuring device 306 of the calibration device becomes the same as the vertical direction load distribution acting between the top backup roll and the calibration device and also between the bottom backup roll and the calibration device. However, in this case, a thrust force is given by the calibration device so that the load of the upper load cell and the load of the lower load cell can be substantially equal to each other. Therefore, depending upon the characteristic of the rolling mill, there is a possibility that a relatively big difference is caused between the upper thrust force and the lower thrust force. In this case, the moment generated in the calibration device by the difference between the upper thrust counterforces and the lower thrust counterforces can be equilibrated by a change in the moment caused by a change in the vertical direction load distribution acting on the contact portion between the top backup roll and the calibration device and also between the bottom backup roll and the calibration device. Accordingly, even in the above case, by the equilibrium condition of moment of the calibration device, from the difference between the upper and the lower load distribution in the vertical direction measured by the center of the calibration device and also from the difference between the upper and the lower thrust force, the vertical direction load distribution acting between the backup rolls and the calibration device can be accurately found, that is, at least the linear expression component of the coordinate of the axial direction of the roll relating to the moment can be accurately found.

For example, concerning the top roll system, the following can be measured or estimated.

$T_B^T$: Thrust force given by the calibration device to between the backup rolls $p^{df}{}_B^T$: Difference of the vertical direction linear load distribution between the calibration device and the backup roll on the work side and that on the drive side $p^{dfT}$: Difference of the measured value of the rolling mill load cell on the work side and that on the drive side.

In this case, the linear load distribution is defined as a distribution in the axial direction of the roll of the tightening load acting on the roll barrel portion. A load per unit barrel length is referred to as a linear load. In order to clearly express a component relating to moment, a distribution of the vertical direction linear load in the axial direction of the roll is linearly approximated, and $p^{df}{}_B{}^T$ expresses a difference of the vertical direction linear load in the axial direction on the work side and that on the drive side. Of course, even if a component of higher degree such as a cubic expression component or a fifth degree expression component is considered, the same calculation can be performed.

The application point $h_B{}^T$ of the thrust counterforces of the backup roll is found from the above quantities, which have already been known, as follows (step S308). In this case, $h_B{}^T$ is a distance in the vertical direction between a contact face position of the lower face of the top backup roll barrel members with the calibration device and an application point position of the thrust counterforces of the backup roll.

The equilibrium condition of moment of the top backup roll is given by the following equation.

$$T_B{}^T \cdot h_B{}^T + p^{df}{}_B{}^T (l_B{}^T)^2/12 = P^{dfT} \cdot a_B{}^T/2$$

In the above equation, $l_B{}^T$ is a length of the contact region of the top backup roll with the calibration device. Usually, $l_B{}^T$ is equal to the length of the barrel of the top backup roll. Also, $a_B{}^T$ is a distance between the reduction fulcrums of the top backup roll. It is possible to immediately find $h_B{}^T$ from the above equation. It is possible to simply find the position of the application point of the thrust counterforces of the bottom backup roll in the same manner as that described above.

Figure 35:
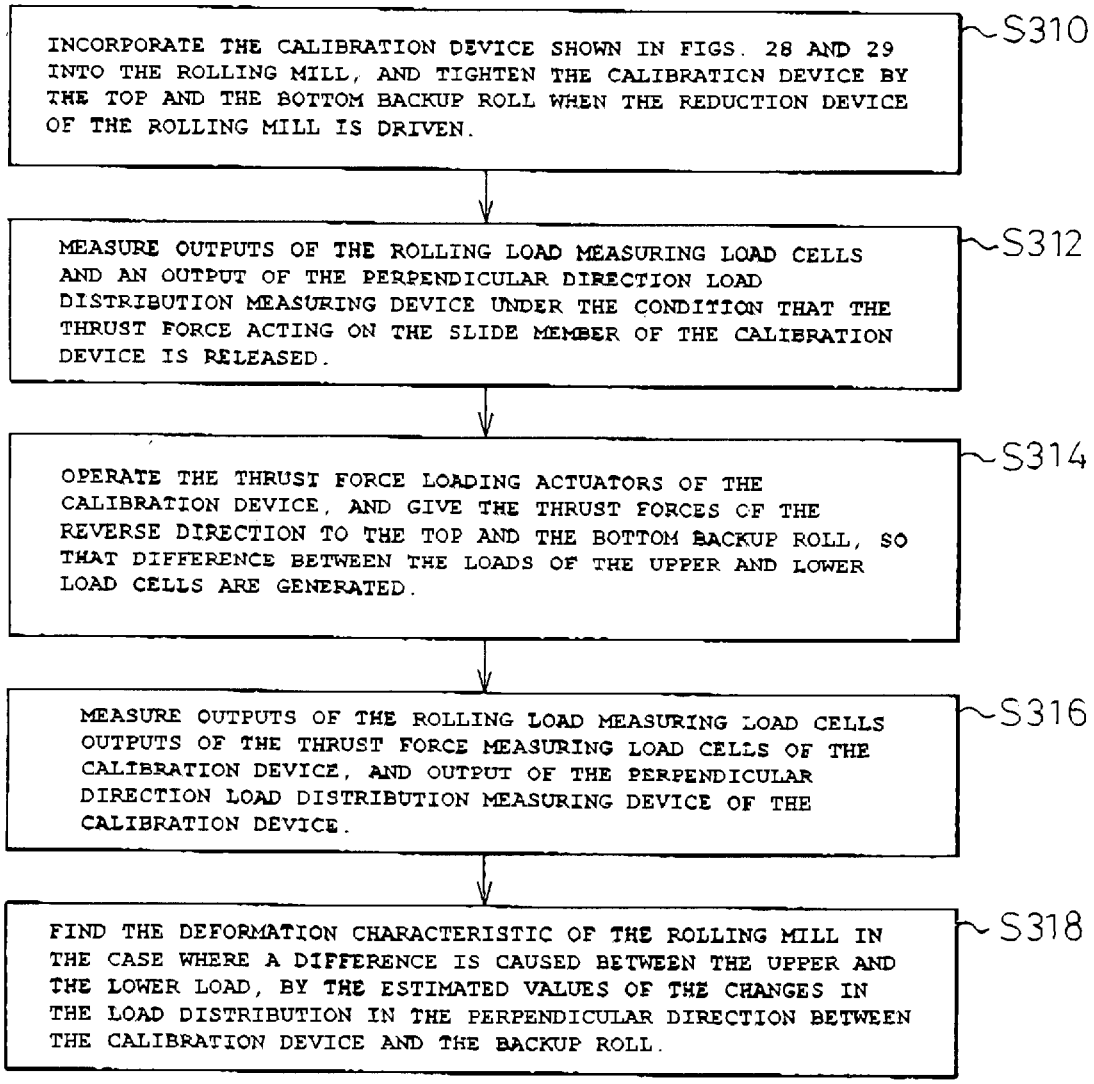
FIG. 35 is a flow chart showing a method of calibration of a rolling mill of another embodiment of the present invention, that is.

Referring to FIG. 35, a preferred embodiment of a method of calibration of a strip rolling mill of the present invention, in which the strip rolling mill calibration device shown in FIGS. 28 and 29 is used, will be explained below.

First, the calibration device is incorporated into the rolling mill in the same manner as that of the embodiment shown in FIG. 34. After that, the keeper strips 316*a*, 316*b* and the keeper strip fixing metal fittings 317*a*, 317*b* are set, so that the calibration device body 301 is substantially fixed in the axial direction of the roll. Under the above condition, the calibration device is tightened to a predetermined tightening load by the top and the bottom backup roll when the roll positioning devices of the rolling mill is driven (step S310). Next, the actuators 305*a*, 305*b* for giving a thrust force, which have been set into the fixed position mode until now, are set in the thrust force control mode, so that a thrust force generated in the process of tightening by the roll positioning devices is released. This release is confirmed by the thrust force measuring load cells 304*a*, 304*b*. Under the above condition, outputs of the rolling load measuring load cells 314*a*, 314*b*, 314*c*, 314*d* are measured, and also an output of the vertical direction load distribution measuring device 306 of the calibration device is measured (step S312).

Next, thrust forces, the intensities of which are substantially the same and the directions of which are reverse to each other, are given the top 312*a* and the bottom backup roll 312*b* by the thrust force giving actuators 305*a*, 305*b* of the calibration device, so that the rolling mill is given a load in such a manner that the load of the upper load cell and that of the lower load cell are different from each other (step S314). Under the above condition, outputs of the rolling load measuring load cells 314*a*, 314*b*, 314*c*, 314*d* are measured, and also outputs of the thrust force measuring load cells 304*a*, 304*b* of the calibration device are measured, and also an output of the vertical direction load distribution measuring device 306 of the calibration device is measured (step S316).

Under the above condition, the intensity of the thrust counterforces generated from the upper thrust loading actuator 305*a* is approximately the same as the intensity of the thrust counterforces generated from the lower thrust loading actuator 305*b*, and the direction of the thrust counterforces generated from the upper thrust loading actuator 305*a* is reverse to the direction of the thrust counterforces generated from the lower thrust loading actuator 305*b*. Accordingly, the roll forces of the upper and the lower thrust force are equilibrated to each other in the calibration device. Therefore, the rolls 307*a*, 307*b* for supporting the resultant force of the thrust counterforces are seldom given a load. For example, when the top backup roll 312*a* is given a thrust force in the direction of work side WS and the bottom backup roll 312*b* is given a thrust force in the direction of drive side DS, an upper load of the rolling mill on work side WS is heavier than a lower load of the rolling mill on work side WS, and an upper load of the rolling mill on drive side DS is lighter than a lower load of the rolling mill on drive side DS. As described above, the rolling mill is given a load which is asymmetrical with respect to the upper and the lower side and also asymmetrical with respect to the work and the drive side. In general, the deformation of the reduction system and that of the housing are asymmetrical with respect to work side WS and drive side DS. As a result, the vertical direction load distribution, which has been substantially symmetrical with respect to work side WS and drive side DS in the beginning, becomes asymmetrical with respect to work side WS and drive side DS. When this change in the vertical direction load distribution is measured by the vertical direction load distribution measuring device 306, it becomes possible to find the deformation characteristic of the reduction system and the housing of the rolling mill (step S318).

In this connection, in order to execute the above method, under the condition that the thrust force is zero, the strip rolling mill calibration device shown in FIG. 28 is previously tightened at various loads while the load on work side WS and that on drive side DS are equilibrated to each other, and the deformation characteristic of the calibration device itself is found from the roll forces and the output of the rolling load measuring load cell.

Next, an embodiment of the strip rolling mill calibration method, in which the strip rolling mill calibration device shown in FIGS. 32 and 33 is used, will be explained as follows. In the same manner as that described above, the strip rolling mill calibration device shown in FIGS. 32 and 33 is incorporated into a rolling mill from which the work rolls haven been removed. The calibration device is tightened to a predetermined load by the top and the bottom backup roll when the roll positioning devices of the rolling mill is driven. Next, a predetermined load in the upward direction is given to the end portion of the calibration device on work side WS by the overhead crane 18*a*. The thus given external force in the vertical direction can be accurately measured by the vertical direction external force measuring load cell arranged at the end portion of the calibration device. Accordingly, in this case, even if the rolling load measuring load cells are not provided in both the upper and the lower members of the rolling mill, as long as one of the upper and the lower load cell load can be measured, the vertical direction load given to the backup roll chock on the side having no load cell can be calculated from the force given to the overall calibration device and the equation of equilibrium condition of moment. Therefore, from a change in the load cell load of the rolling mill before and after the external force in the vertical direction is given by the overhead crane, it becomes possible to find the deformation characteristic of the reduction system and the housing of the rolling mill for the asymmetrical load with respect to the upper and lower sides.

According to the present invention, the leveling setting and control of a rolling mill, which are conventionally conducted by an operator, can be automated. Further, the leveling setting and control can be conducted by the method of the present invention more accurately and appropriately than the conventional method. As a result, the frequency of (lateral) traveling and problems of threading can be greatly decreased in the rolling operation. Furthermore, the occurrence of camber and wedge-shaped strip thickness can be greatly decreased. Therefore, the cost of rolling can be decreased and the quality of products can be enhanced.

When the strip rolling mill calibration device of the present invention is used and the strip rolling mill calibration method of the present invention is executed, it is possible to find the deformation characteristic of the rolling mill by a load asymmetrical with respect to the upper and lower sides generated by the thrust force between the rolls. Therefore, even when the load asymmetrical with respect to the upper and lower sides is generated, it is possible to accurately estimate a state of deformation of the rolling mill for the load. As a result, the reduction leveling setting and control, in which values measured by the detection ends of the rolling load measuring load cells of the rolling mill are used, can be very accurately executed as compared with the method of the prior art. Accordingly, the rolling operation can be highly automatized. As a result, the frequency of (lateral) traveling and problems of threading can be greatly decreased in the rolling operation. Furthermore, the occurrence of camber and wedge-shaped strip thickness can be greatly decreased. Therefore, the cost of rolling can be decreased and the quality of products can be enhanced.

When the strip rolling mill calibration device of the present invention is used and the strip rolling mill calibration method of the present invention is executed, it is possible to find a position of the point of application of the thrust counterforces of the backup roll of the rolling mill, and further it is possible to find the deformation characteristic of the rolling mill for a load asymmetrical with respect to the upper and lower sides. Accordingly, even if a thrust force is generated between the rolls, when the thrust force is measured, it is possible to separate an influence of the thrust force on the load cell load of the rolling mill. Further, it is possible to estimate the deformation characteristic of the rolling mill for an asymmetrical load with respect to the upper and lower sides caused by the thrust force. As a result, the reduction leveling setting and control, in which values measured by the detection ends of the rolling load measuring load cells of the rolling mill are used, can be very quickly and accurately executed as compared with the method of the prior art. Accordingly, the rolling operation can be highly automated. As a result, the frequency of (lateral) traveling and problems of threading can be greatly decreased in the rolling operation. Furthermore, the occurrence of camber and wedge-shaped strip thickness can be greatly decreased. Therefore, the cost of rolling can be decreased and the quality of products can be enhanced.

What is claimed is:

1. A method of rolling a strip with a multi-roll strip rolling mill including at least top and bottom backup rolls and top and bottom work rolls, roll chocks for supporting all of the rolls and roll positioning devices for vertically positioning the roll chocks of the top or bottom backup roll, the method comprising the steps of:

prior to rolling operation, pressing the rolls to each other by the roll positioning devices;

measuring thrust counterforces acting axially on all of the rolls except for the backup rolls;

measuring roll forces acting vertically on backup roll chocks supporting the top and bottom backup rolls;

obtaining zero position of the roll positioning devices and/or deformation characteristics of the strip rolling mill based on the measurement of the thrust counterforces and the roll forces; and determining set-up position of the roll positioning devices and/or controlling the roll positioning devices for actual rolling process based on the obtained zero position and/or deformation characteristics of the multi-roll strip rolling mill.

2. A strip rolling method for a multi-roll strip rolling mill of not less than four rolls comprising a top roll assembly including a top backup roll and a top work roll, a bottom roll assembly including a bottom backup roll and a bottom work roll, roll chocks for supporting all of the rolls, roll positioning devices for vertically positioning the roll chocks of the top or bottom backup roll, the method comprising the steps of:

measuring thrust counterforces acting axially on all of the rolls except the backup roll in at least one of the top roll assembly and the bottom roll assembly;

measuring roll forces acting vertically on the backup roll chocks of the backup roll in the roll assembly where said thrust counterforces are measured;

calculating target increments for the roll positioning devices, said target increments calculated based upon said measured thrust counterforces and roll forces;

controlling roll positioning devices in accordance with said calculated target increments.

3. A strip rolling method for a multi-roll strip rolling mill of not less than four rolls comprising a top roll assembly including a top backup roll and a top work roll, a bottom roll assembly including a bottom backup roll and a bottom work roll, roll chocks for supporting all of the rolls, roll positioning devices for vertically positioning the roll chocks of the top or bottom backup roll, said rolling mill having a center, the method comprising the steps of:

measuring thrust counterforces acting axially on all of the rolls except the backup roll in at least one of the top roll assembly and the bottom roll assembly;

measuring roll forces acting vertically on the backup roll chocks of the backup roll in the roll assembly where said thrust counterforces are measured;

calculating asymmetry of load distribution which acts between a workpiece to be rolled and the work roll in the work roll axial direction with respect to the rolling mill center for the work roll in the roll assembly where said thrust counterforces and roll forces are measured, said calculated asymmetry being based upon said measured thrust counterforces and roll forces;

calculating target increments for roll positioning devices in the roll assembly, said target increments calculated based upon said calculated asymmetry;

controlling said roll positioning devices in accordance with said calculated target increments.

4. A multi-roll strip rolling mill of not less than four rolls comprising a top roll assembly including a top backup roll and a top work roll, a bottom roll assembly including a bottom backup roll and a bottom work roll, roll chocks for supporting all of the rolls, roll positioning devices for vertically positioning the roll chocks of the top backup roll or roll chocks of the bottom backup roll, said rolling mill having a center, said strip rolling mill further comprising:

a measurement device for measuring thrust counterforces acting axially on all of the rolls except the backup rolls;

a measurement device for measuring roll forces acting vertically on the backup roll chocks of the top backup roll and the backup roll chocks of the bottom backup roll.

5. A multi-roll strip rolling mill of not less than four rolls according to claim 4 comprising:

a roll bending device arranged between at least two adjacent rolls except for the backup rolls, the roll chocks of at least one roll of the two adjacent rolls having the roll bending device arranged therebetween supporting radial forces;

said at least one roll of the two adjacent rolls having the roll bending device arranged therebetween further having thrust reaction forces support chocks supporting axial thrust counterforces;

said thrust reaction forces support chocks connected to said measurement device for measuring axial thrust counterforces.

6. A multi-roll strip rolling mill of not less than four rolls according to claim 4 comprising:

a roll bending device arranged between at least two adjacent rolls except for the backup rolls;

said roll bending device having a mechanism for giving an oscillation component of not less than 5 Hz to a preselected roll bending force.

7. A multi-roll strip rolling mill of not less than four rolls according to claim 4 comprising:

a roll bending device arranged between the roll chocks of at least two adjacent rolls except for the backup rolls;

a load transmission member located between the roll bending device and one of an upper roll chock and a lower roll chock between which said roll bending device is arranged;

a slide bearing having an axial degree of freedom located between the load transmission member and the one of the upper roll chock and the lower roll chock.

8. A multi-roll strip rolling mill of not less than four rolls according to claim 4 comprising:

a roll bending device arranged between the rolls chocks of at least two adjacent rolls except for the backup rolls;

a load transmission member located between the roll bending device and one of an upper roll chock and a lower roll chock between which said roll bending device is arranged;

said load transmission member having an enclosed space, with a liquid disposed in said enclosed space;

at least a portion of said enclosed spaced covered with a thin skin, said thin skin having an elastic deformation resistance with respect to out-of-plane deformation of not more than 5% of maximum value of roll bending force.

9. A multi-roll strip rolling mill of not less than four rolls according to claim 4 comprising:

a roll shifting device for axially shifting a pair of rolls comprising one in the top roll assembly and the other in the bottom roll assembly;

said roll shifting device having a mechanism for providing a minute oscillation to said pair of rolls; said minute oscillation having an amplitude of not less than 1 mm and a period of not more than 30 seconds.

10. A multi-roll strip rolling mill of not less than four rolls comprising a top roll assembly including a top backup roll and a top work roll, a bottom roll assembly including a bottom backup roll and a bottom work roll, roll chocks for supporting all of the rolls, roll positioning devices for vertically positioning the roll chocks of the top backup roll or the roll chocks of the bottom backup roll, said rolling mill having a center, said rolling mill further comprising:

a measurement device for measuring thrust counterforces acting axially on all of the rolls except the backup rolls;

a measurement device for measuring roll forces acting vertically on the backup roll chocks of the top backup roll and the backup roll chocks of the bottom backup roll;

a calculating device connected to the measurement device for measuring thrust counterforces and the measurement device for measuring roll forces, said calculating device provided for calculating at least one of:

(i) asymmetry of load distribution which acts between a workpiece to be rolled and at least one work roll in the work roll axial direction with respect to the rolling mill center, said calculated asymmetry being based upon said measured thrust counterforces and roll forces; and (ii) asymmetry of load distribution which acts between the top work roll and the bottom work roll in the axial direction of the work rolls with respect to the rolling mill center.

* * * * *